US006953022B1

(12) United States Patent
Itsuki et al.

(10) Patent No.: US 6,953,022 B1
(45) Date of Patent: Oct. 11, 2005

(54) FUEL INJECTION PUMP

(75) Inventors: Seiji Itsuki, Osaka (JP); Satoshi Hattori, Osaka (JP); Hajimu Imanaka, Osaka (JP); Junichi Samo, Osaka (JP); Masamichi Tanaka, Osaka (JP); Yoshihiro Yokome, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 10/297,016

(22) PCT Filed: May 26, 2000

(86) PCT No.: PCT/JP00/03426

§ 371 (c)(1),
(2), (4) Date: Nov. 25, 2002

(87) PCT Pub. No.: WO01/90569

PCT Pub. Date: Nov. 29, 2001

(51) Int. Cl.[7] ..... F02D 31/00
(52) U.S. Cl. ..... 123/364; 123/373
(58) Field of Search ..... 123/496, 449, 123/373, 372, 464, 500, 501, 179.17, 364, 123/495

(56) References Cited

U.S. PATENT DOCUMENTS

| | | | | |
|---|---|---|---|---|
| 2,223,755 A | | 12/1940 | Dillstrom | |
| 3,739,809 A | | 6/1973 | Ulbing | |
| 3,857,374 A | * | 12/1974 | Glikin et al. | 417/294 |
| 4,211,203 A | * | 7/1980 | Kobayashi | 123/387 |
| 4,395,987 A | * | 8/1983 | Kobayashi et al. | 123/458 |
| 4,526,150 A | | 7/1985 | Guntert et al. | |
| 4,593,668 A | * | 6/1986 | Yuzawa | 123/496 |
| 4,625,700 A | * | 12/1986 | Elsbett et al. | 123/500 |
| 4,754,737 A | * | 7/1988 | Ishida et al. | 123/500 |
| 4,800,861 A | * | 1/1989 | Oshizawa et al. | 123/506 |
| 4,831,988 A | | 5/1989 | Hoefken et al. | |
| 5,086,742 A | * | 2/1992 | Vogtmann | 123/449 |
| 5,115,783 A | * | 5/1992 | Nakamura et al. | 123/496 |

(Continued)

FOREIGN PATENT DOCUMENTS

| | | |
|---|---|---|
| DE | 2314596 | 10/1973 |
| EP | 0055245 | 6/1982 |
| GB | 482680 | 4/1938 |

(Continued)

*Primary Examiner*—Carl S. Miller
(74) *Attorney, Agent, or Firm*—Knobbe, Martens, Olson & Bear LLP

(57) ABSTRACT

A fuel injection pump, comprising three sub-mechanism parts; a lower mechanism part (A), a head mechanism part (B), and a governor mechanism part (C), wherein, when the governor mechanism part (C) is assembled into the combination of the lower mechanism part (A) and head mechanism part (B) after the lower mechanism part (A) and head mechanism part (B) are assembled with each other, a governor link (27) installed extendedly from the governor mechanism part (C) is inserted into both mechanism parts (A, B) and, when a hook groove (27*a*) at the tip of the governor link (27) is engaged with a lock pin (21*a*) in a control slider (21) for the rotation of a plunger (7) disposed inside the lower mechanism part (A) and head mechanism part (B), first, with a cut surface (33*b*) of a lift pin (33) facing upward, the governor link (27) is put on the cut surface (33*b*) so as to position the hook groove (27*a*) under the lock pin (21*a*), and then the lift pin (33) is rotated to face the cut surface (33*b*) downward, and the governor link (27) is swung upward by a cam part (33*a*) so as to engage the hook groove (27*a*) with the lock pin (21*a*).

7 Claims, 41 Drawing Sheets

U.S. PATENT DOCUMENTS

| | | | | | |
|---|---|---|---|---|---|
| 5,273,017 | A | * | 12/1993 | Braun et al. | 123/506 |
| 5,396,871 | A | * | 3/1995 | Faupel et al. | 123/500 |
| 5,592,915 | A | * | 1/1997 | Ishiwata et al. | 123/300 |

FOREIGN PATENT DOCUMENTS

| | | |
|---|---|---|
| GB | 1 462 210 | 1/1977 |
| JP | 48-14816 | 2/1974 |
| JP | JU 50-61216 | 10/1975 |
| JP | JU 51-21020 | 8/1976 |
| JP | JU 55-156219 | 4/1980 |
| JP | JU 58-27574 | 8/1981 |
| JP | JU 59-68143 | 5/1984 |
| JP | 04-066772 | 3/1992 |
| JP | JU 04-32258 | 3/1992 |
| JP | 06-050237 | 2/1994 |
| JP | 10-030515 | 2/1998 |
| JP | 10-196405 | 7/1998 |

* cited by examiner

FUEL INJECTION PUMP

This application is the U.S. National Phase under 35 U.S.C. §371 of International Application PCT/JP00/03426, filed May 26, 2000. The International Application was not published under PCT Article 21(2) in English.

TECHNICAL FIELD

This invention relates to a fuel injection pump used for a diesel type internal-combustion engine.

BACKGROUND ART

A fuel injection pump for diesel engines includes a governor, which adjusts the amount of fuel injection by rotating a plunger and adjusting the opening time of a plunger lead. For constituting the governor, a linearly movable control member directly engages with a control sleeve which is rotatable integrally with the plunger, and an actuator for moving the control member is connected to the control member by a governor link. For serving as the control member, there are a control rack meshing with a pinion provided on the control sleeve, a control slider whose fork arm pinches a lock pin provided on the control sleeve, and so on. For serving as the actuator for moving the control member, if the governor is a centrifugally operated governor, there is a governor sleeve which is moved with the centrifugal force of a camshaft, for example. If the governor is an electronic governor, for example, an electromagnetic solenoid may serve as the actuator.

Since a governor mechanism part including a governor weight and the governor sleeve etc. in the case of the centrifugally operated governor, or an electromagnetic solenoid part in the case of the electronic governor is large-scale, it is offset from a pump mechanism part equipped with a plunger, a delivery valve, etc. On the other hand, the above-mentioned link must engage with the control member in the pump mechanism part. Therefore, when attaching the plunger to the pump mechanism part, the governor link needs to be inserted together with the plunger into the pump mechanism and engaged to the control member while being finely tuned in its positioning, thereby complicating assembly operation of the pump mechanism part itself. Suppose that the governor link previously included in the governor mechanism part is automatically made to engage with the control member in the pump mechanism part during the assembling for combination of the governor mechanism part with the pump mechanism part incorporating the plunger etc. In this case, the assembly of a fuel injection pump becomes very easy. However, there is no conventional fuel injection pump of such a configuration.

Moreover, an end of the camshaft of a fuel injection pump is projected outside from a bearing of pump housing, and provided thereon with a key such as a woodruff key through which a reduction gear is fixedly provided thereon so as to be interlockingly connected to a crankshaft in a crankcase. If the bearing allows the key to pass therethrough, in the insertion process of the camshaft to the pump housing, this key can be provided only by passing the camshaft previously loaded with the key through the bearing to project the outer end of this camshaft outward. However, if the camshaft is loaded with a key in a conventional manner, the distance between the axis of the camshaft and a part of the key that is radially farthest from the axis of the camshaft will become larger than the radius of inner periphery of the bearing. Therefore, it becomes inevitable that the key is loaded on the projection end of the camshaft after the camshaft is passed through the pump housing and projected at its outer end outward from the pump housing. Furthermore, for removing the camshaft from the pump housing, not only the gear but also the key must be removed from the pump shaft so as to allow the projection end of the camshaft to pass the bearing.

Next, the problem of the conventional diesel engine will be explained in relation to the injection time of a fuel injection pump. In a diesel engine, the fuel pressurized by hundreds atmospheric pressure with the fuel injection pump is injected into a combustion chamber from a nozzle of a fuel injection valve attached to a cylinder head at about 20 degrees prior to the top dead center of the crankshaft in its rotational angle (in lead zone of crank angle).

Since combustion is performed in the integrity that air is superfluous, there is little concentration of CO and HC in exhaust gas of a diesel engine far compared with that of a gasoline engine. However, a diesel engine exhausts much NOx. Reduction of exhaustion of NOx is the most important problem for diesel engines.

NOx is generated when nitrogen and oxygen are heated to combine with each other. Therefore, generally, the better combustion is, the more NOx is exhausted. That is, the abundance of NOx increases, so that the combustion temperature is high and the duration of combustion is long. Furthermore, when the mixture ratio of air and a fuel is a certain value, this abundance reaches maximum.

In order to reduce NOx under exhaust gas, it is possible to adopt EGR system or a crankcase emission control system besides improvement of the combustion chamber in an engine, or improvement of an air intake-and-exhaust system. However, if EGR system is performed, the soot under exhaust gas will mix in lube through inhalation air, and early degradation of lube and wear of an engine sliding part will pose a problem. Moreover, when it is equipped with a crankcase emission control system, soot accumulates on the lube adhering to the wall in an intake manifold so as to choke the intake manifold, thereby reducing an engine performance.

As another reduction method of NOx, it is improvement of an injection system, especially a fuel injection pump so as to delay the start time of fuel injection. However, this leads to aggravation of combustion so as to decline the output force and thermal efficiency, increase CO or HC, aggravate the engine starting at low-temperature, and increase black smoke concentration, etc. Therefore, when an engine starts or high load is applied on the engine, priority should be given over advancing of fuel injection starting time for efficient combustion to reduction of NOx under exhaust gas. Thus, since the required time of a fuel injection start changes with engine operation situations, it becomes important how fuel injection start time is controllable so as to agree with conflicted required times.

Such control of fuel-injection time is well known by JP6-50237A. According to this document, a sub lead other than an original plunger lead (main lead) is formed in the head of a plunger. Corresponding to this sub lead, a leak port which is open for free passage to a fuel escaping circuit is formed in a plunger barrel. By bringing the sub lead into communication with the leak port, the fuel in a fuel-compression chamber is made to escape in early stages of the fuel-discharging stroke of the plunger so as to delay the fuel-injection time substantially.

In the cited plunger, when the rotational location of the plunger by the governor goes within a fixed range (for example, a range corresponding to the time of an engine start, or if the plunger is controlled by an electronic governor, a range corresponding to the time when the engine is high-loaded), the sub lead is located apart from the leak port so as to be shut off from the leak port so that the plunger starts discharging fuel of the predetermined pressure to the delivery valve shortly after it closes the inhalation port to finalize the fuel-inhaling stroke thereof. Whereby, the fuel-injection time can be advanced.

However, in the case of this cited example, strict accuracy is required in processing of the sub lead, the leak port and the like as well as positioning of the plunger. When an error is in these process tolerances, the fuel-injection start time does not correspond well to the control of fuel oil consumption based on engine operation situations. In this regard, if the amount of fuel escaping from each leak port is not unified exactly, the engine performance varies among fuel injection pumps. Particularly, it comes to be considered that a train type fuel injection pump or the like has a plurality of plungers whose injection characteristics are different from one another so as to cause variation of combustion ability among the cylinders of an engine. On the other hand, the amount of leaking fuel may be requested to increase or decrease according to variation of engines. Neither the dissolution of the variation in the engine performance by such process error nor adjusting of the amount of fuel leaks as occasion demands is attained depending on the above-mentioned reference technique.

DISCLOSURE OF THE INVENTION

A first object of the invention is to provide a fuel injection pump (especially, a distributor type pump) that is excellent in ease of assembly, especially in that of a governor linkage during the whole assembly.

To achieve the object, the fuel injection pump of this invention can be disassembled into three parts: a lower mechanism part which has pump driving means; a head mechanism part which has a rotatable plunger, a control sleeve that is rotatable integrally with the plunger and a linearly movable member for rotating the control sleeve; and a governor mechanism part having a governor link.

Especially in the lower mechanism part, a camshaft for actuating the plunger is passed through a bearing of a main body housing for its journalling so that the camshaft projects outward from the bearing so as to be loaded with a key for positioning fixation of a cam reduction gear onto the camshaft. Since the distance in the radial direction of the camshaft between a portion of the key which is the farthest from an axis of the camshaft and this axis is made smaller than the inner periphery radius of this bearing, the arrangement of the camshaft can be finished just when the camshaft loaded with the key beforehand is passed through the bearing, thereby simplifying assembly of the lower mechanism part.

Moreover, in the head mechanism part, a plunger barrel and a support member are attached in a pump head. The plunger is slidably and rotatably inserted in the plunger barrel so as to partly project from the plunger barrel. The control sleeve is provided on the projection of the plunger. The linearly movable member for rotating the control sleeve engages with the control sleeve while the linearly movable member being supported by the support member to be guided for enabling its linear movement. Moreover, a receptacle member fittingly retained by the support member retains the plunger and the control sleeve so as to prevent them from escaping from the plunger barrel. In this way, the head mechanism part as a single block is composed.

After combining the lower mechanism part and the head mechanism part, the governor connection part is attached to the combined lower and head mechanism parts, thereby completing the assembly of the fuel injection pump as the whole. On attaching of the governor connection part to both the lower and head mechanism parts, a governor link extended from the governor mechanism part is detachably connected to the linearly movable member, thereby completing the governor.

For attachment and detachment of the governor link to and from the linearly movable member, the governor link pivotally supported by the governor mechanism part through a pivot point may be rotated centering on the pivot point after it is inserted into the combined lower and head mechanism parts and positioned therein. Alternatively, the governor link or the whole governor mechanism part may be rotated while the length of the positioned governor link is used as a fulcrum shaft.

Moreover, the engagement of the control sleeve with the linearly movable member may be configured as follows. In the head mechanism part, the control sleeve is provided with a lock pin, and the linearly movable member with a fork arm. The linearly movable member made to be rotatable is rotated so as to removably engage the fork arm with the lock pin when the lower mechanism part and the head mechanism part are combined with each other.

A second object of the invention is to provide a fuel injection pump that is excellent in the control of fuel-injection start time. In detail, without greatly depending on processing accuracy of a fuel channel and the like, an actual fuel-injection start time is made to properly correspond to the required time of the fuel-injection start which varies with engine operation situations, thereby offering high combustion efficiency during an engine start and effects such as reduction of NOx in exhaust gas in the phase in which the engine got warm.

The fuel injection pump has a fundamental structure as follows: A plunger is reciprocally and rotatably inserted in a plunger barrel so as to face the head of the plunger into a fuel-compression chamber formed in a plunger barrel. By reciprocation of the plunger, fuel is absorbed from a fuel gallery to the fuel-compression chamber and fed from the fuel-compression chamber to a delivery valve. In the plunger barrel is provided an inhalation port to be communicated with the fuel gallery and a leak port to be communicated with a fuel escaping circuit. A sub lead is formed in the head of the plunger. During the sliding of the plunger toward the fuel-compression chamber, the fuel-inhaling stroke for communicating the inhalation port with the fuel-compression chamber, and the fuel discharging-delay stroke for communicating the leak port with the fuel-compression chamber through the sub lead so as to leak fuel in the fuel-compression chamber to the fuel escaping circuit are finalized, and then the fuel-discharging stroke for discharging fuel of the predetermined injection pressure to the delivery valve is begun.

In this fundamental structure, according to the present invention, the sub lead is formed so as to prepare a variation in the depth thereof so that the confrontation period to the leak port of the sub lead in reciprocation of the plunger may vary with alteration of the rotation location of the plunger. Accordingly, the finalizing time of the discharging-delay stroke varies with control of the injection quantity so that, correspondingly to various situations of an engine, the fuel-injection start time can be changed by tie up thereof with control of the amount of injected fuel.

Moreover, in the above-mentioned fundamental structure, according to the invention, means for control the flow of fuel leaking from the leak port is attached to the fuel injection pump so that the means can be operated for the adjustment from the exterior of the fuel injection pump. Therefore, even if there is variation in the amount of leaking fuel among a plurality of fuel injection pumps having the same specification or among a plurality of plungers in a fuel injection pump such as a train type fuel injection pump because of processing error, the amount of leaking fuel flow can be unified among the pumps or the plungers by the flow control means. The flow control means may also be operated for adjusting the leak amount of fuel when the amount is desired to vary in correspondence to an engine operation situation or so on. The means may be so constructed so as to be manipulated outside the fuel injection pump or be connected to a controller so as to be electrically controlled, thereby facilitating its operation.

As an aspect of the flow control means, a valve chamber, which opens to a fuel passage from the leak port, is formed in a pump body. In the valve chamber are arranged a valve element which is shaped to close a junction between the valve chamber and the fuel channel, and a biasing member for biasing the valve element to close the junction. The pressured leaking fuel pushes the valve element against the biasing force of the biasing member so as to open the valve chamber to the fuel channel. Adjusting means for restricting and adjusting the movement of the valve element caused by the pressure of leaking fuel is arranged so as to be operable from the exterior of the fuel injection pump. This adjustment enables the amount of leaking fuel to be adjusted.

In this structure, the adjusting means may be an electromagnetic-controlled actuator. If the actuator is controlled in association with control of an electronic governor, the adjustment of leaking fuel flow tied up with the fuel-injection control corresponding to an engine speed and an engine load becomes exact.

Moreover, according to the invention, in the above-mentioned fundamental structure, an on-off valve is arranged in an intermediate portion of the fuel escaping circuit. By closing the on-off valve, the fuel-discharging stroke starts immediately after the fuel-inhaling stroke finalizing, without passing through the discharging-delay stroke. Therefore, for example, if it is made to perform opening-and-closing control of the on-off valve corresponding to an engine operation situation, an actual fuel-injection start time can be made to correspond at the required time of the fuel-injection start which changes with engine operation situations (for example, the low-temperature situation at the time of an engine start and the situation where the engine is driven for a while so as to get warm).

Furthermore, a timer for fuel-injection time control is composed. The timer has such a configuration that the movable on-off valve, a valve actuator and a biasing member are arranged in a valve chamber in communication with the fuel escaping circuit so that the on-off valve is sandwiched between the valve actuator and the biasing member.

The valve actuator is provided with a temperature sensing member so as to move the on-off valve against the biasing force of the biasing member according to increase of the temperature so that the on-off valve is closed when the temperature sensed by the temperature sensing member is under the predetermined, and it is open when not under the predetermined. Therefore, when an engine is in a low-temperature situation at its starting, the temperature of the fuel injection pump is also so low as to close the on-off valve, thereby bringing the injection start time of fuel forward. On the other hand, if an engine is operated for a while and the fuel injection pump gets warm more than a constant temperature, the on-off valve is opened so as to delay the injection start time.

Alternatively, the valve actuator may be provided with an operation member which operates by oil-pressure variation of engine lube so as to move the on-off valve against the biasing force of the biasing member according to increase of engine lube pressure so that the on-off valve is closed when the oil-pressure is under the predetermined, and it is open when not under the predetermined. Like the above, the injection start time will be advanced in the low-temperature situation when the engine starts, and the injection start time will become late in the elevated-temperature situation after driving the engine for a while. However, in this structure, since the valve actuator operates by the variation of lube pressure in immediate response to the temperature change in an engine, it can realize the on-off valve control that corresponds to the engine temperature situation exactly.

Alternatively, the valve actuator may be electromagnetically controlled so as to selectively put the on-off valve into either its valve-opening mode or valve-closing mode depending upon whether the valve actuator is energized or not energized. In this structure, the fuel-injection start time is controllable according to various conditions of the engine such as rotary speed and load as well as temperature.

Furthermore, in the fuel escaping circuit, means for adjusting the fuel flow from the leak port may be arranged between the leak port and the on-off valve. Whereby, besides the control effectiveness of the fuel-injection start time according to the on-off valve control, the above-mentioned unification of the fuel leaks regardless of processing error can be obtained or the amount of leaking fuel leak flow can be adjusted corresponding to an engine situation or so on.

BEST MODE FOR CARRYING OUT THE INVENTION

Figure 1:
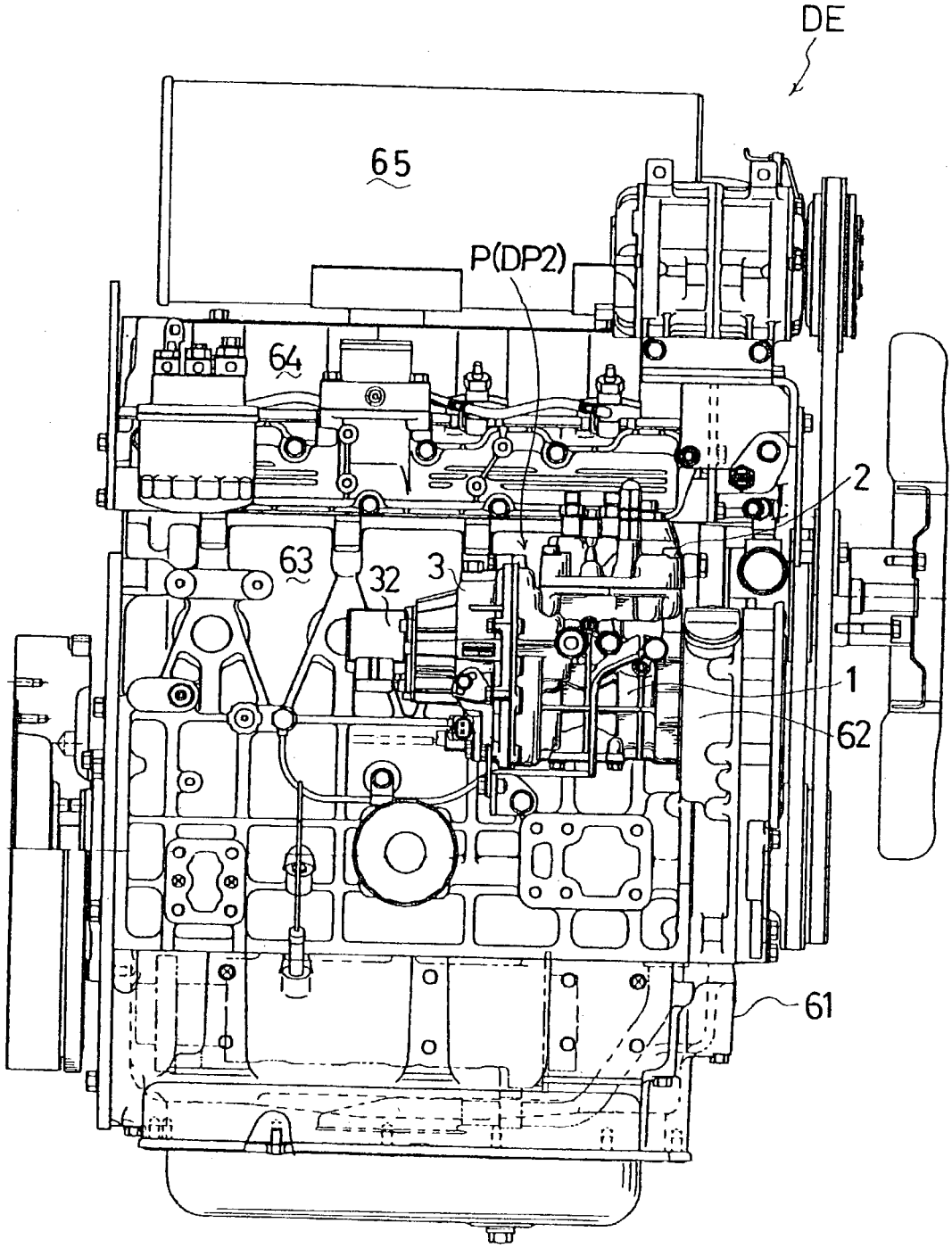
FIG. 1 is a side view of a diesel engine DE equipped with a (distributor type) fuel injection pump P.

First, in accordance with FIGS. 1 and 2, a structure of a diesel engine equipped with a fuel injection pump according to the present invention will be described.

A cylinder portion 63 is formed in an upper part of a crankcase 61, and a cylinder head 64 is attached onto cylinder portion 63, thereby constituting a diesel engine DE. In cylinder portion 63 are formed one or more cylinders. Fuel injection valves and valve mechanism (intake and exhaust valves) for the respective cylinders are incorporated in cylinder head 64. A reference numeral 65 is an exhaust-air muffler and a reference numeral 66 is an exhaust manifold. A crankshaft (not shown) is journalled in crankcase 61. In a side base 62 attached to one end (in this embodiment, a front end) of crankcase 61, one end of the crankshaft is interlockingly connected through timing gears to camshafts for a fuel injection pump and the valve mechanism.

A front end of a fuel-injection-pump P is attached to side base 62, as shown in FIG. 1, thereby arranging pump P laterally adjacent to cylinder portion 63. Delivery valves 18 which are as many as the cylinders formed in cylinder portion 63 protrude on fuel-injection-pump P. Pump P carries out pump operation by the revolution of the camshaft engaging with the crankshaft through gears. Every time of inhaling fuel supplied from a fuel tank (not shown), fuel is breathed out from each delivery valves 18 at fixed timing into each of fuel injection valves provided to respective cylinders in cylinder portion 63 so as to make each fuel injection valve inject the fuel into a combustion chamber in each of the cylinders.

Air is introduced into each of the cylinders from an intake valve in the fixed degree zone of crank angle regarding a piston in the cylinder, and fuel is injected into the combustion chamber of each cylinder from the fuel injection valve in the compression stroke (just before a top dead center, i.e., a lead zone of crank angle) of this piston, so that the compressed air is exploded and expanded in this cylinder. The air is scavenged after its explosion through an exhaust valve. The exhaust air from all the cylinders is collected together through an exhaust manifold 66 from cylinder head 64 and ejected outside through an exhaust-air muffler 65.

Figure 2:
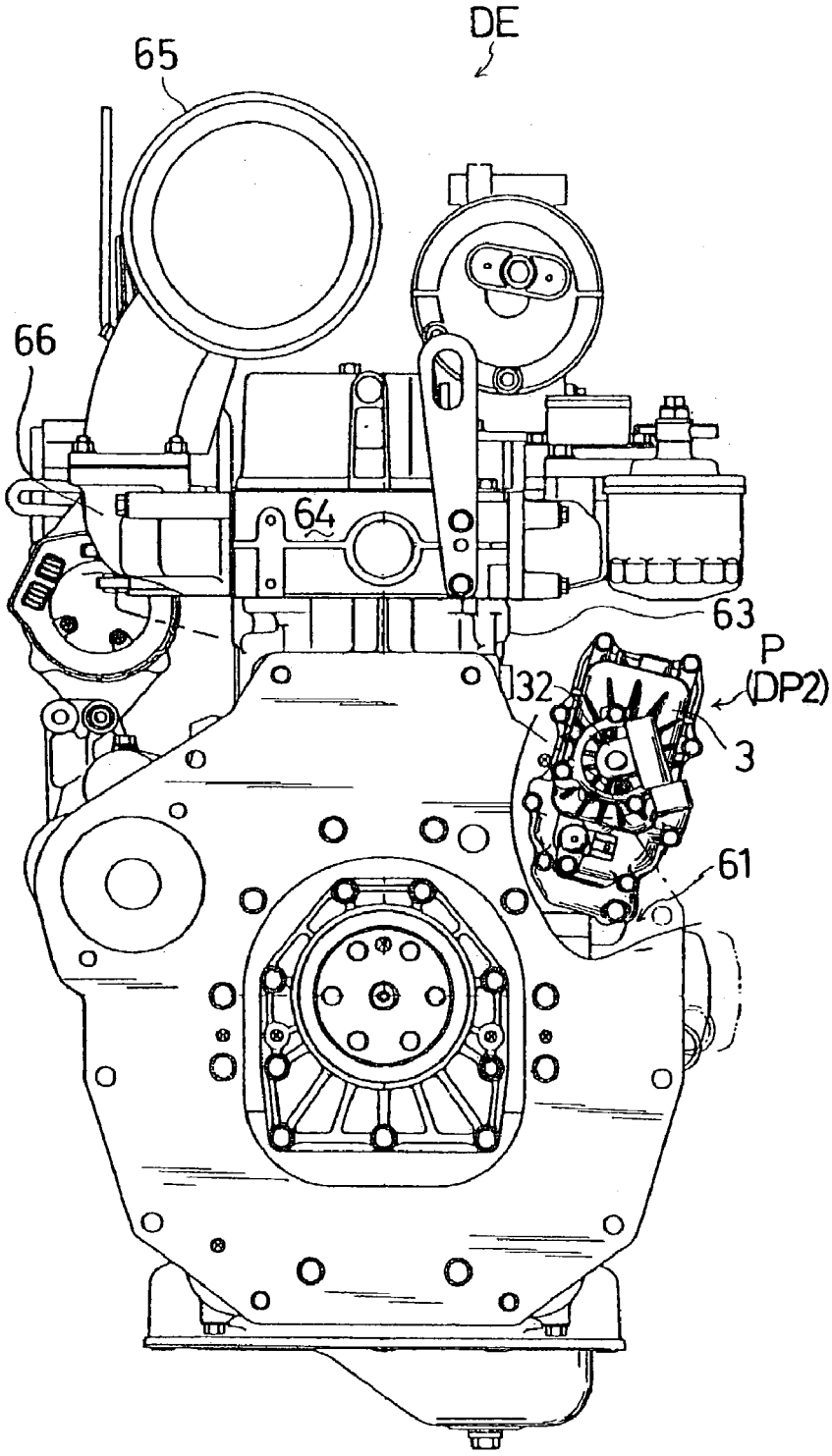
FIG. 2 is a rear view of the same.

Fuel-injection-pump P shown in FIGS. 1 and 2 is a distributor-type pump DP2 shown in FIG. 4, which will be detailed later. However, FIGS. 1 and 2 are merely intended to illustrate the condition of a fuel injection pump during assembly. The illustrated pump may be replaced with another distributor-type pump (for example, a distributor-type fuel injection pump DP1 having a centrifugally operated governor, which serves as a later-discussed third embodiment) or another type pump such as a later-discussed train-type fuel injection pumpP.

The configuration of fuel-injection-pump P will now be described. Incidentally, in fact, fuel-injection-pump P may be attached to diesel engine DE in the shape of an inclination, as shown in FIG. 1 and FIG. 2. However, in description of each following pump configuration, the location of each part will be demonstrated on the assumption that a horizontal camshaft 4 is disposed below a vertical plunger 7.

Figure 3:
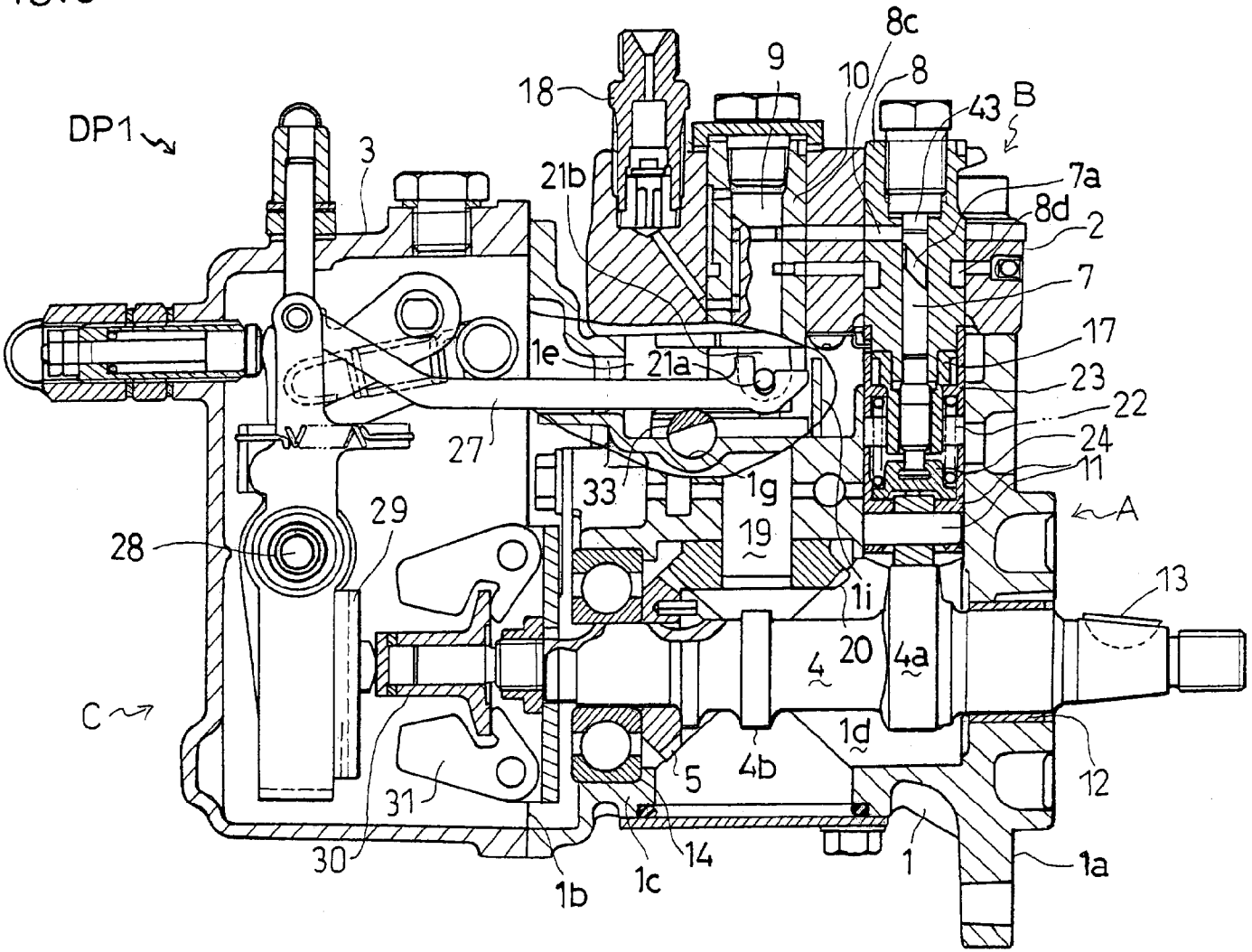
FIG. 3 is a sectional side view of a distributor-type fuel injection pump DP1 having a centrifugally operated governor assembled together according to the invention.

The distributor type fuel injection pump according to the invention, which is excellent in the ease of assembling, will be described. A distributor type pump may be provided with plural plungers or plural distributor shafts so as to distribute fuel from each distributor shaft to plural delivery valves. However, each of the distributor type pumps of the invention shown in FIGS. 3 to 5 etc. has single plunger 7 and a single distributor shaft 9 so as to distribute fuel fed through distributor shaft 9 to a plurality of delivery valves 18 which are as many as cylinders. Distributor-type-pump DP1 shown in FIG. 3 is equipped with a mechanical (centrifugally operated) governor. Distributor-type-pump DP2 shown in FIG. 4 is equipped with an electronic governor. FIG. 5 is a common sectional front view of each of distributor-type pumps DP1 and DP2. Hereinafter, unless the governor of an illustrated pump is specified in a centrifugally operated governor or an electronic governor, suppose that the distributor type pump according to the invention, which is excellent in the ease of assembly, is generically called fuel-injection-pump DP.

Fuel-injection-pump DP can be disassembled into three parts of a lower mechanism part A, a head mechanism part B and a governor mechanism part C. Lower mechanism part A comprises a main body housing 1 which rotatably supports camshaft 4 for driving plunger 7 and distributor shaft 9. Head mechanism part B comprises a head housing 2 in which plunger 7, distributor shaft 9 and delivery valves 18 are provided. Governor mechanism part C comprises a governor housing 3, which incorporates a governor arm 29 and a governor link 27 at least among component parts of a governor.

Figure 6:
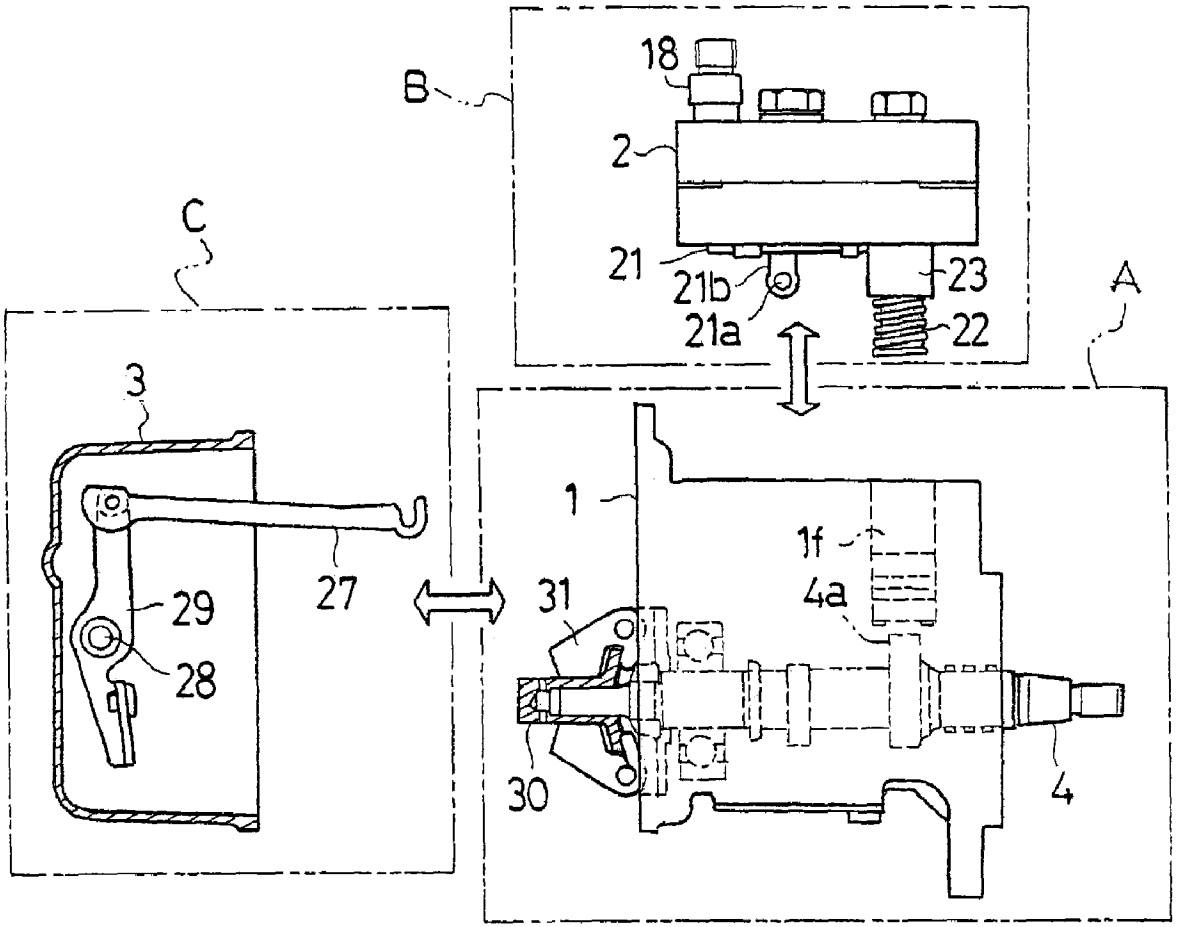
FIG. 6 is an exploded side view of a distributor-type fuel injection pump DP (having a centrifugally operated governor) which is divided into a lower mechanism part A, a head mechanism part B, and a governor mechanism part C according to the present invention.

Referring to FIG. 6, pump DP with a centrifugally operated governor is disassembled into three parts A, B and C. A governor weight 31 and a governor sleeve 30, which serve as an actuator for governor arm 29 actuation, are provided on a tip of camshaft 4. In the case that pump P is disassembled, they become components of lower mechanism part A. Pump DP2 with an electronic governor can be disassembled into the three parts similarly (this situation is not shown). However, pump DP2 has neither governor weight 31 nor governor sleeve 30. If pump DP2 is disassembled into the three parts, an electromagnetic solenoid 32 serving as an actuator for governor arm 29 actuation is incorporated in governor mechanism part C.

Figure 13:
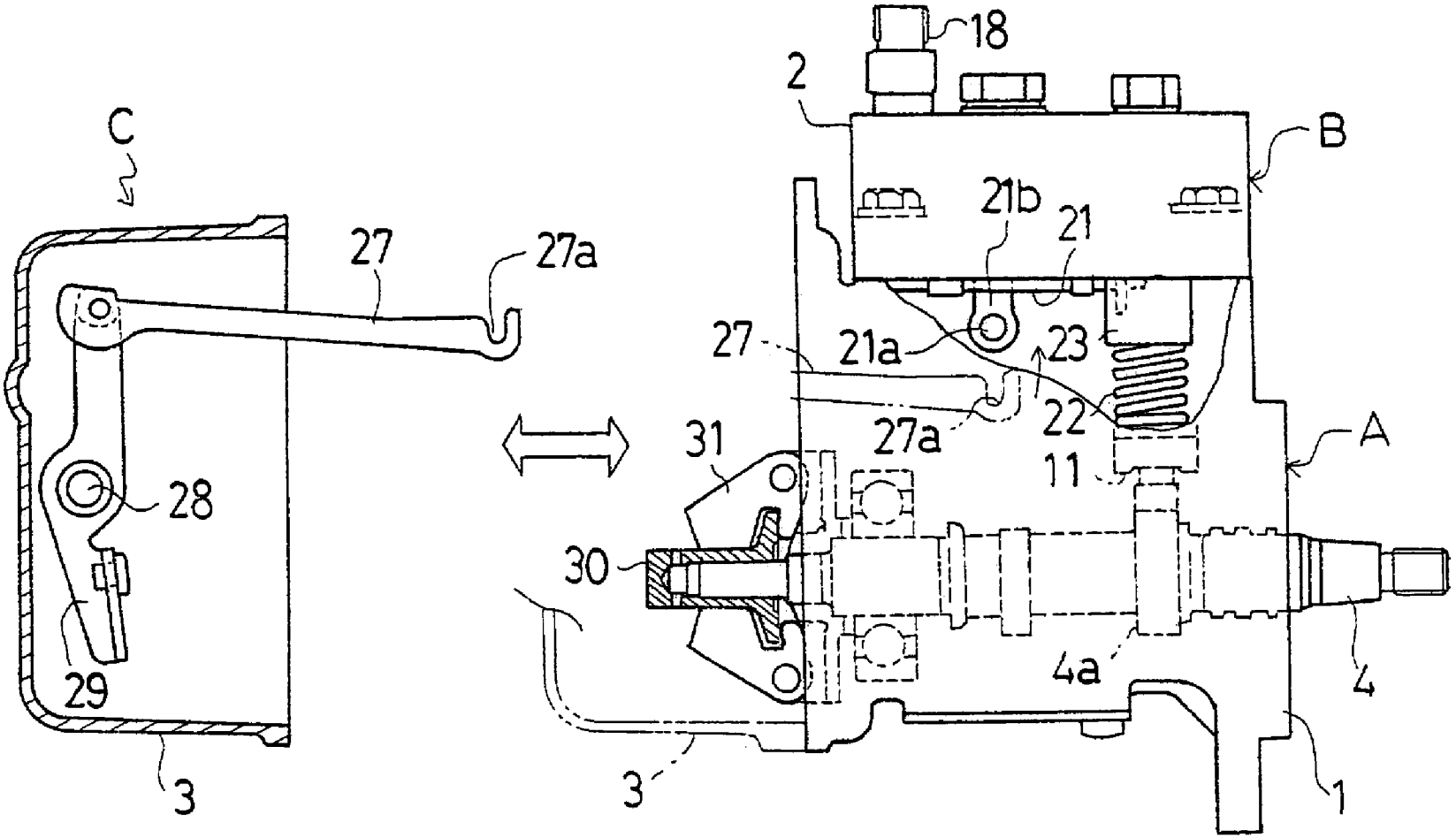
FIG. 13 is a side view of lower mechanism part A, head mechanism part B and governor mechanism part C while governor mechanism part C is being attached to lower and upper mechanism parts A and B which have been combined with each other.

During assembling, as shown in FIG. 13, head mechanism part B and lower mechanism part A are combined up and down, and then, governor mechanism part C is attached to these sides.

Figure 7:
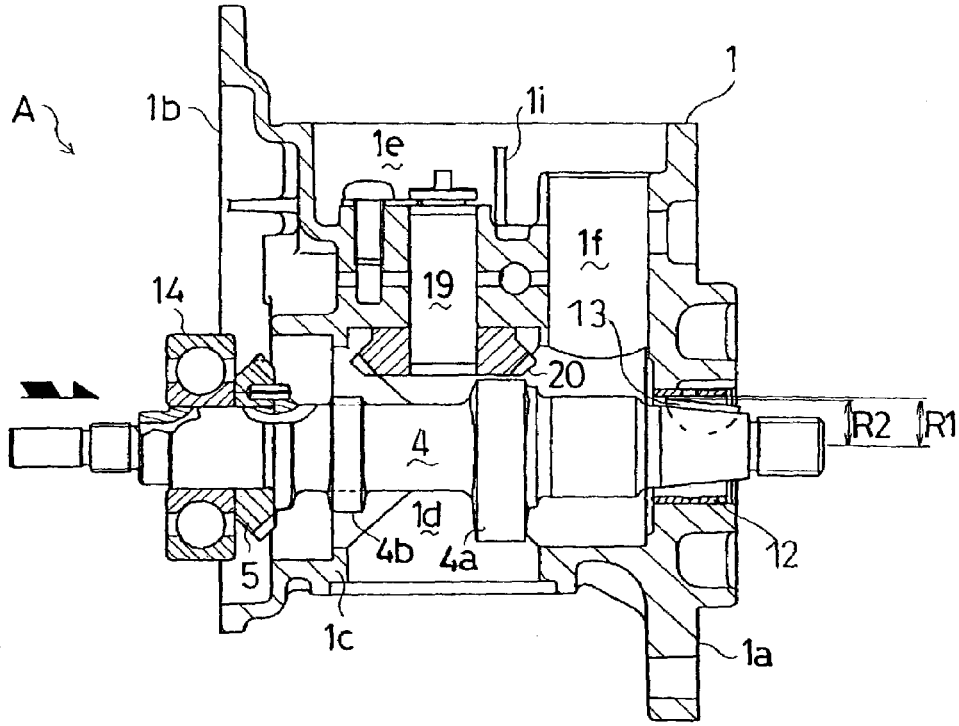
FIG. 7 is a sectional side view of lower mechanism part A under assembly wherein a camshaft 4 is inserted into a main body housing 1.
Figure 8:
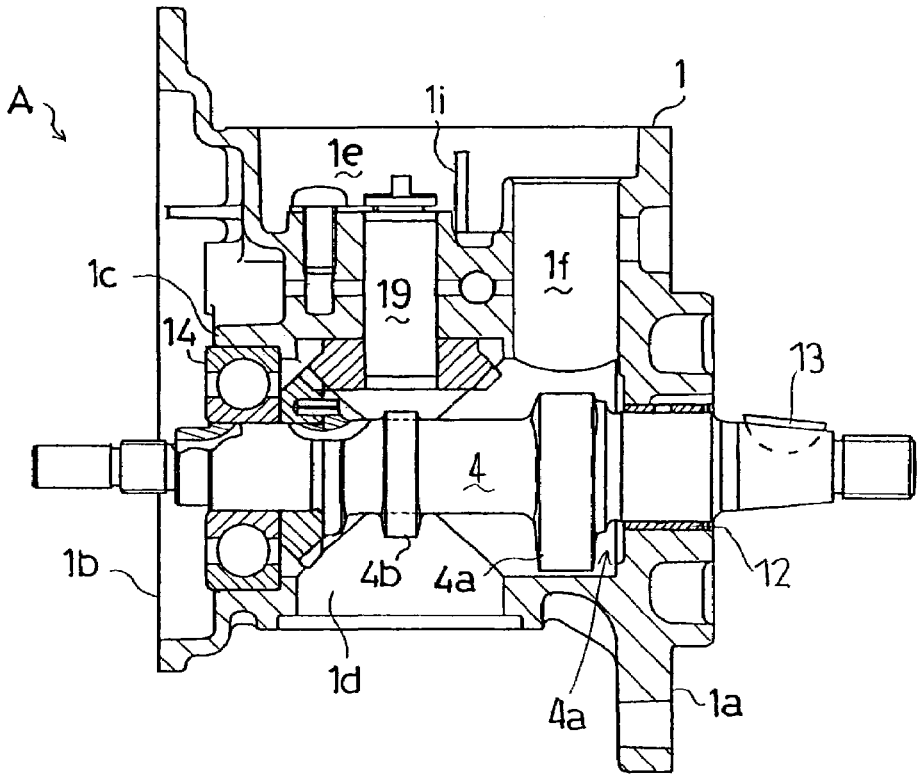
FIG. 8 is a sectional side view of lower mechanism A wherein camshaft 4 is completely journalled by main body housing 1.

In accordance with FIGS. 7, 8, etc., description will be given of the assembly structure of lower mechanism part A. On the assumption that the right of FIGS. 7 and 8 is made into the front, the front-end surface of main body housing 1 is formed into flange 1*a* to be fastened to side base 62 of engine DE. A bearing sleeve 12 is disposed in a hole, which is bored through flange 1*a* for insertion of the camshaft. The rear end surface of main body housing 1 serves as a joint surface 1*b* to be joined with governor housing 3. A bearing wall 1*c* is formed at a little bosom (in front) of joint surface 1*b* so as to counter flange 1*a*. Between flange 1*a* and bearing wall 1*c*, a cam chamber 1*d* is formed approximately cylindrically in the fore-and-aft direction. A portion above cam chamber 1*d* serves as a block portion in which lube passages are bored optionally. The block portion is generally recessed at its upside so as to be open upward. The recess is partly provided as a governor link chamber 1*e* (which is arranged leftward from plunger 7 and distributor shaft 9, according to the present embodiment of FIG. 7). The rear end thereof is open toward joint surface 1*b* for insertion of later-discussed governor link 27. Incidentally, a stopper plate 1*i* is erected in governor link chamber 1*e* so as to be able to contact with a tip of governor link 27, thereby defining the bound of the tip of governor link 27 in approach. A vertical tappet chamber 1*f* is formed between the approximately laterally middle of the recess and cam chamber 1*d* so as to penetrate the block portion. A vertically columnar distributor-drive shaft 19 rotatably penetrates the block portion in parallel to tappet chamber 1*f*. A bevel gear 20 is fixed to a bottom end of distributor-drive shaft 19 within cam chamber 1*d*.

A cam 4*a* for plunger actuation and a cam 4*b* for fuel-feed-pump actuation are formed of camshaft 4. They may be separate members fixed on camshaft 4. Moreover, a front end portion of camshaft 4 is integrally loaded with a woodruff key 13, another portion thereof behind cam 4*b* with a bevel gear 5, and another portion thereof just behind bevel gear 5 with a bearing 14.

For setting such camshaft 4 into main body housing 1, first, the front end portion of camshaft 4 is inserted from the back of joint surface 1*b* into cam chamber 1*d* through a bearing hole formed in bearing wall 1*c*. Camshaft 4 is further inserted forward so that the front end portion thereof is passed through bearing sleeve 12 and projected forward from flange 1*a*, whereby camshaft 4 is completely journalled.

Consequently, the front end portion of camshaft 4 loaded with woodruff key 13 projects forward from flange 1*a*. The forward projecting end thereof is arranged in side base 62 of engine DE shown in FIG. 1 so as to be provided thereon with a cam gear serving as a timing gear. Woodruff key 13 is used for positioning fixation of this cam gear.

In the conventional way of providing a key for positioning fixation of a cam gear onto a camshaft, the camshaft is completely journalled in a main body housing and then the key is provided on the outward projecting end of the camshaft, because a portion of the key farthest from axis of the camshaft in the radial direction of the camshaft is farther from the axis than the inner periphery of a bearing (in this embodiment, it is bearing sleeve 12) from the axis. In this embodiment, as shown in FIG. 7, the portion of woodruff key 13 farthest from axis of camshaft 4 in the radial direction of camshaft 4 has a distance R2 from the axis of camshaft, that is smaller than an inner periphery radius R2 of bearing sleeve 12. Accordingly, as shown in FIG. 8, when camshaft 4 is passed through bearing sleeve 12, woodruff key 13 provided on camshaft 4 is also allowed to pass through bearing sleeve 12. Therefore, camshaft 4 previously provided with woodruff key 13 can be set in main body housing 1. Even if camshaft 4 is pulled out backward from main body housing 1, woodruff key 13 does not have to be removed. Incidentally, the key for positioning fixation of a cam gear and the bearing for a camshaft are only required to have such configuration that the key provided on the camshaft is allowed to pass through the bearing. Thus, the key and the bearing are not limited to those according to this embodiment in shape or structure.

With respect to the inside of cam chamber 1*d*, cam 4*a* is disposed just below tappet chamber 1*f*, bevel gears 5 and 20 engage with each other, and bearing 14 is fit in the bearing hole of bearing wall 1*c*.

The rear end portion of camshaft 4 completely journalled in main body housing 1 is extended backward from bearing wall 1*b* so as to project through joint surface 1*b* into governor housing 3 which is attached to main body housing 1 in a later-discussed way. In order to compose a centrifugally operated governor, the rear end portion of camshaft 4 is provided thereon with flyweight 31 and governor sleeve 30, as shown in FIG. 6. These are unnecessary when an electronic governor is composed. In addition, tappet 11 is arranged in tappet chamber 1*f*, and some other works are performed, thereby completing lower mechanism part A. Incidentally, by post-installation, as shown in FIG. 5, a fuel feed pump 6 may be attached to the outside of a portion of main body housing 1 which is formed into cam chamber 1*d* so as to be actuated by cam 4*d*.

In addition, components needed for engagement and disengagement of later-discussed governor link 27 and control slider 21 are incorporated in lower mechanism part A.

Description will now be given of head mechanism part B in accordance with FIGS. 9 to 12. Vertically axial plunger barrel 9 and distributor-shaft sleeve 10 are attached into pump head 2 and fixed thereto, thereby penetrating pump housing 2 vertically. Plunger 7 is disposed along the vertical axis of plunger barrel 8 so as to be slidably reciprocally fit in plunger barrel 8. Distributor shaft 9 is disposed along the vertical axis of distributor-shaft sleeve 10 and inserted therein rotatably about the vertical axis.

A lower portion of plunger 7 projects downward from plunger barrel 8. As shown in FIG. 6, the lower projecting portion of plunger 7 is provided thereon with a control sleeve 17, which is not rotatable but axially slidable in relative to plunger 7. A retaining ring 25 prevents control sleeve 17 from falling out from plunger 7. Moreover, an upper portion of control sleeve 17 is relatively rotatably provided around the bottom portion of plunger barrel 8.

As shown in FIG. 5, lock pin 17*a* protrudes upward from a part of control sleeve 17. Lock pin 17*a* is inserted in a slot of a fork-arm 21*c* formed in a control slide block 21 serving as a linearly movable member for rotating control sleeve 17. Control slider 21 slides horizontally along a bottom surface of pump head 2, thereby rotating control sleeve 17 integrally with plunger 7. This rotation adjusts a period of free passage between a plunger lead (main lead) 7*a* formed in plunger 7 and an inhalation port 8*a* formed in plunger barrel 8 during the reciprocation of plunger 7, thereby adjusting the amount of fuel discharging of plunger 7.

Incidentally, in order to compose a governor (irrespective of a centrifugally operated governor or an electronic governor), a tab 21*b* provided with a lock pin 21*a* is integrally hung down from control slider 21 so as to be connected to later-discussed governor link 27. This governor structure will be detailed later.

Figure 9:
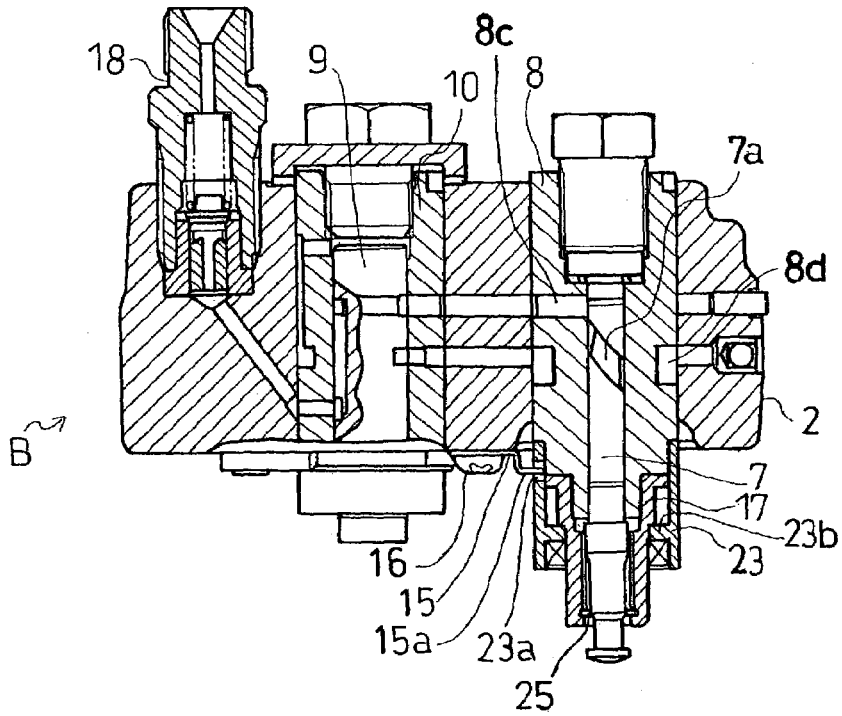
FIG. 9 is a sectional side view of head mechanism part B.
Figure 10:
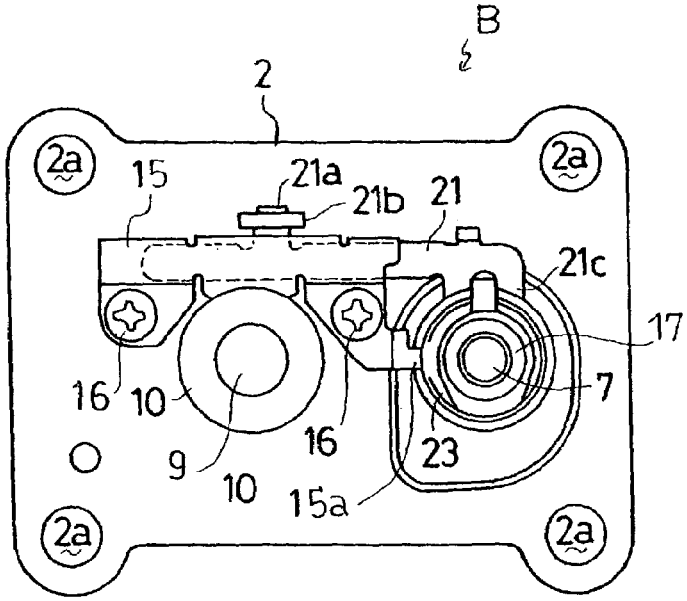
FIG. 10 is a bottom view of the same.

As shown in FIGS. 9 and 10, a slider guide 15 is fastened to the bottom surface of pump head 2 together with a screw 16. Control slider 21 is horizontally slidably guided so as to be inserted between slider guide 15 and the bottom surface of pump head 2.

Furthermore, an upper spring bracket 23 is provided around control sleeve 17. Upper spring bracket 23 functions as a member which receives an upper end of a later-discussed plunger spring 22, and also as a retainer for preventing plunger 7 and control sleeve 17 from escaping. Plunger barrel 8 and control sleeve 17 are formed with respective steps for positioning upper spring bracket 23. The top of upper spring bracket 23 is made to abut against the step of plunger barrel 8. Furthermore, an annular engaging portion 23*b* integrally formed within upper spring bracket 23 is made to abut against the step of control sleeve 17, thereby positioning upper spring bracket 23. Moreover, a stop hole 23*a* is formed in a side wall portion of upper spring bracket 23. A stop portion 15*a* extensionally formed of slider guide 15 is inserted into stop hole 23*a*, thereby fixing upper spring bracket 23 to pump head 2 so as to prevent upper spring bracket 23 from falling out.

As the assembly sequence of upper spring bracket 23, control slider 21 and slider guide 15 shown in FIGS. 9 and 10, upper spring bracket 23 is located in the above-mentioned way with respect to control sleeve 17 and plunger barrel 8 which are previously attached to pump head 2 or plunger 7, control slider 21 is inserted, stop portion 15*a* of slider guide 15 is inserted into stop hole 23*a*, and then, slider guide 15 is fastened to the bottom surface of pump head 2 by screw 16.

Figure 11:
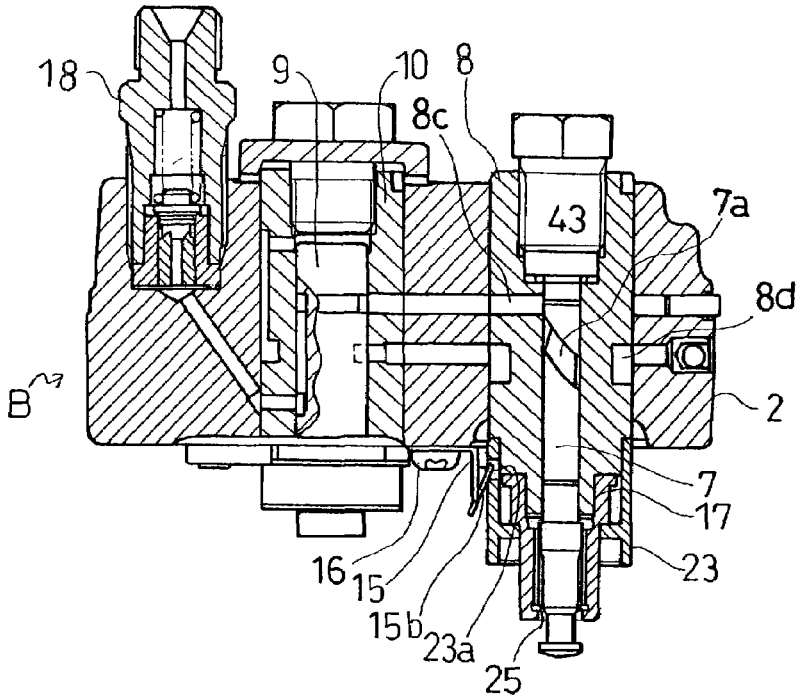
FIG. 11 is a sectional side view of head mechanism part B to which an upper spring bracket 23 is being attached by use of a slider guide 15 serving as a modification of that shown in FIGS. 8 and 9.
Figure 12:
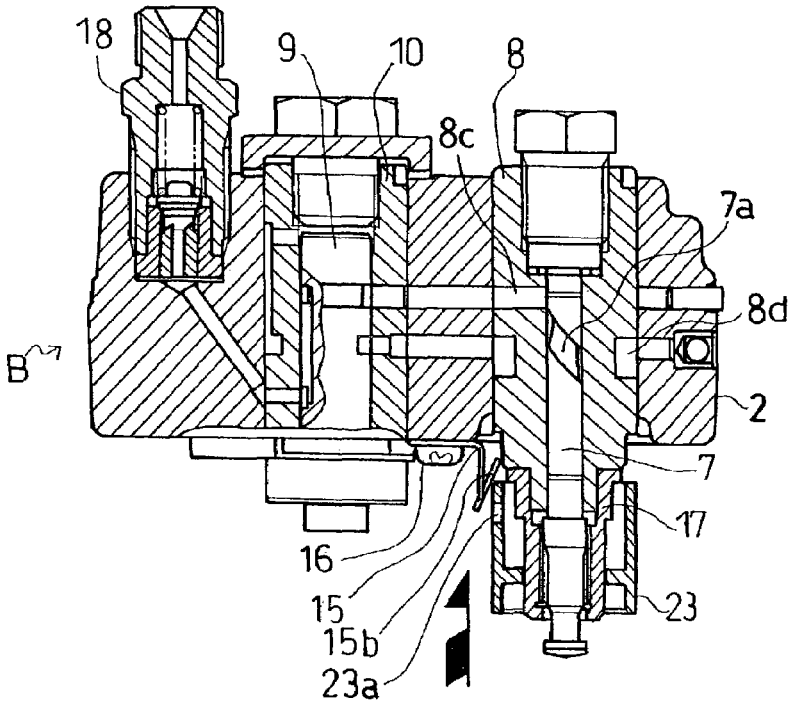
FIG. 12 is a sectional side view of head mechanism part B to which upper spring bracket 23 is completely attached in the same way.

In an embodiment shown in FIGS. 11 and 12, slider guide 15 having stop portion 15*a* shown in FIGS. 9 and 10 is replaced with a slider guide 15 having an elastic prong portion 15*b*. Slider guide 15 may be entirely made of an elastic member. In this case, before positioning of upper spring bracket 23, slider guide 15 is fastened to the bottom surface of pump head 2 by screw 16, and then, upper spring bracket 23 is made to slide along the axis of plunger 7 from the stage shown in FIG. 11 to the stage shown in FIG. 12. During this sliding, elastic prong portion 15*b* is naturally pressed against the external surface of upper spring bracket 23, thereby allowing upper spring bracket 23 to slide. When upper spring bracket 23 reaches its fixed position as shown in FIG. 12, prong portion 15*b* naturally restores so as to be inserted into stop hole 23*a*. That is, in the embodiment of FIGS. 11 and 12, upper spring bracket 23 is naturally incorporated in head mechanism part B without its falling out only by being positioned with respect to pump head 2.

Figure 4:
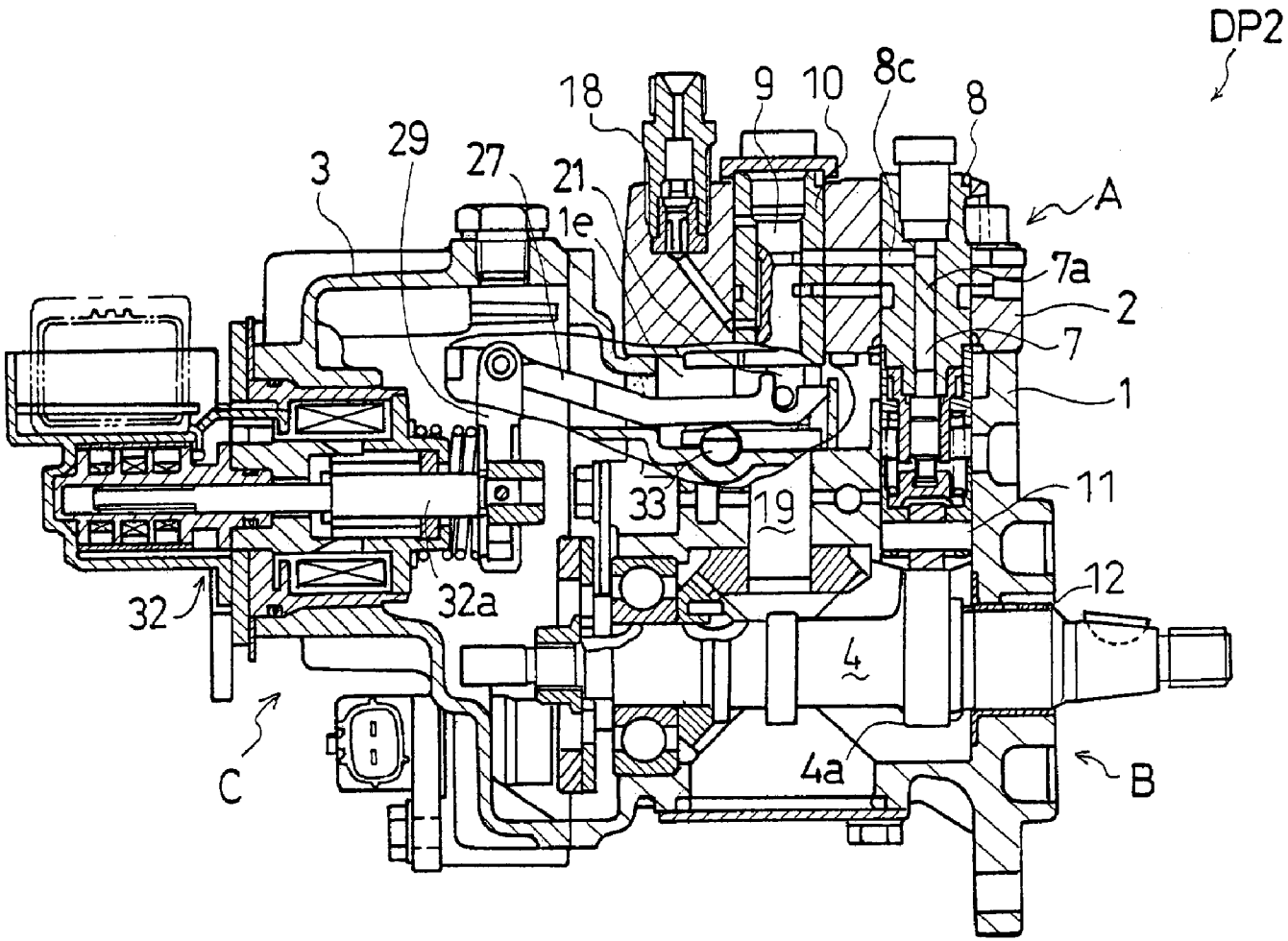
FIG. 4 is a sectional side view of a distributor-type fuel injection pump DP2 having an electronic governor assembled in the same way.
Figure 5:
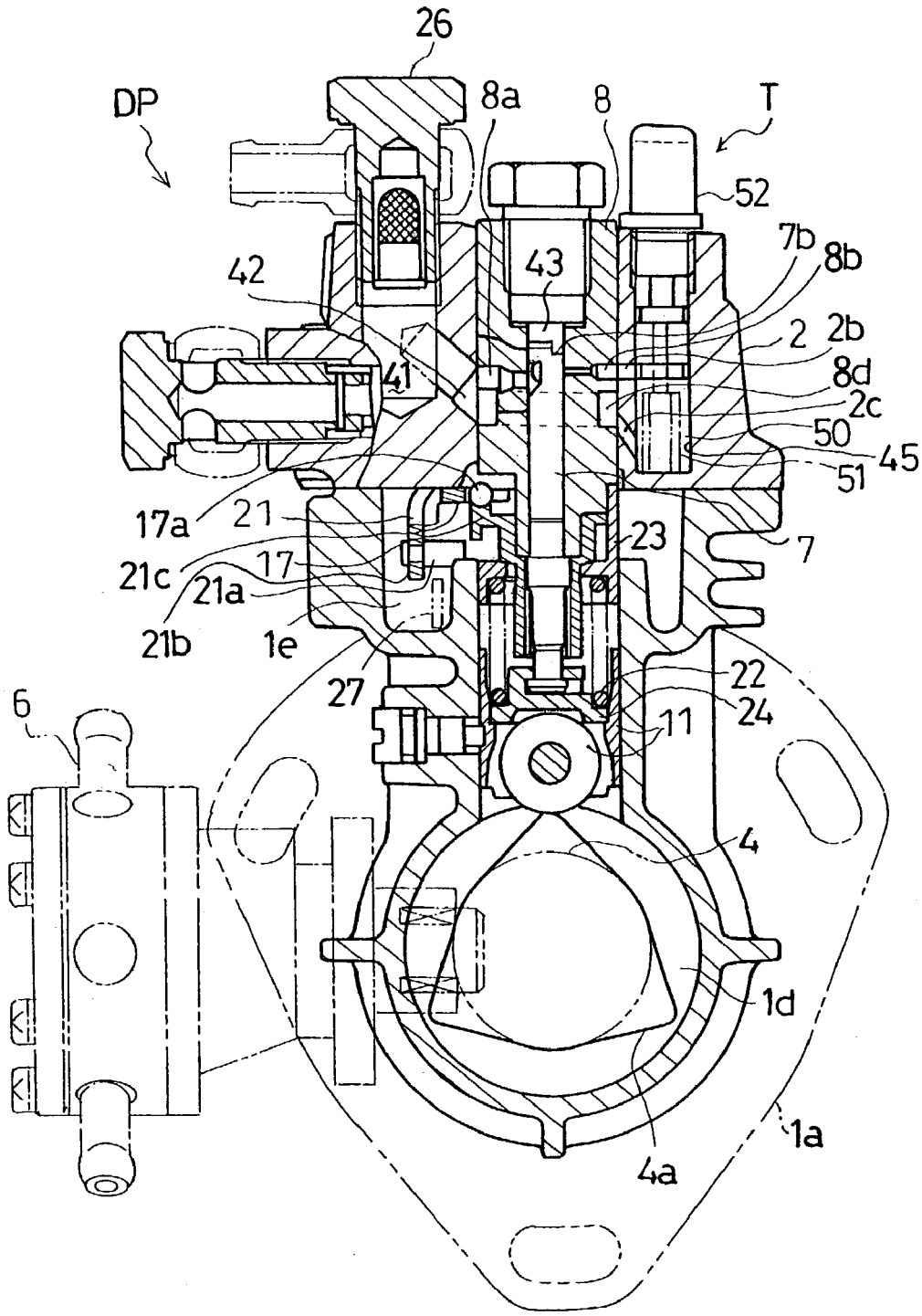
FIG. 5 is a sectional front view of a distributor-type fuel injection pump which may be either pump DP1 or DP2 shown in FIG. 3 or 4.

Furthermore, the bottom end of plunger 7 extended downward from control sleeve 17 is engaged with a lower spring bracket 24, as shown in FIGS. 3 to 5. Plunger spring 22 is interposed between upper and lower spring brackets 23 and 24.

Around distributor-shaft sleeve 10, as shown in FIG. 9 etc., delivery valves 18 as many as the cylinders of engine DE are inserted into pump head 2 so as to project upward, thereby delivering fuel distributed by distributor shaft 9 to the respective fuel injection valves provided in the respective cylinders of engine DE.

Moreover, as shown in FIG. 5, a fuel-feeding-pipe connector 26, which contains an oil filter, is attached to pump head 2 so as to communicate with a fuel-supply chamber 41 formed in pump head 2. In pump head 2, fuel-supply chamber 41 is open for free passage through a fuel gallery 42 to inhalation port 8*a* of plunger barrel 8. In addition, as shown in FIG. 5, a later-discussed timer T for adjusting fuel-injection time is inserted in pump head 2.

Description will now be given of governor mechanism part C. This serves as governor housing 3 incorporating at least a governor arm 29 to be pivotally connected with governor link 27. Incidentally, each of governor housing 3 and governor arm 29 for the centrifugally operated governor shown in FIG. 3 is different from each of those for the electronic governor shown in FIG. 4. However, the same reference numerals are used because they have the same faculty.

In governor housing 3 of governor mechanism part C for centrifugally operated governors, governor arm 29 pivoted on a governor shaft 28, other arms and a governing lever (not shown), etc. are assembled together and appropriately biased by springs, thereby constituting a governor arm mechanism, in which governor arm 29 is pivoted at the top end thereof onto a base end of governor link 27. As described above, as shown in FIG. 6, flyweight 31 and governor sleeve 30 which actuate by the centrifugal force of rotating camshaft 4 are previously provided on a tip (the rear end) of camshaft 4, thereby being incorporated in lower mechanism part A. By assembling three parts A, B and C together so as to complete a fuel injection pump P1, as shown in FIG. 3, fly weight 31 and governor sleeve 30 come to be arranged in governor housing 3, and a tip of governor sleeve 30 is pressed against governor arm 29.

In the completed centrifugally operated governor, governor arm 29 rotates by the movement of the governing lever by accelerator operation, thereby rotating control slider 19 and plunger 7 through control slider 21 so as to change the amount of fuel injection. Moreover, if the rotary speed of camshaft 4 becomes large while the governing lever being held at the fixed position, flyweight 31 is opened and governor sleeve 30 is pushed out. Accordingly, governor arm 29 is rotated so as to rotate plunger 7 to the injection reduction side. As mentioned above, stopper plate 1*i* is erected so as to decide the bound of approaching governor link 27 in governor link chamber 1*e*. However, when governor link 27 abuts against stopper plate 1*i*, the rotational position of plunger 7 becomes the minimum injection position, i.e., a non-injection position. If the rotating speed of camshaft 4 becomes small, the opening of fly weight 31 reduces, governor arm 29 rotates to a reverse side by the biasing force, and governor slider 30 also slides toward governor weight 31, thereby rotating plunger 7 to the increase side in the injection quantity. Thus, engine power output is conserved to the value corresponding to accelerator setting.

In order to compose an electronic governor, as shown in FIG. 4, an electromagnetic solenoid 32 provided with a spool 32*a* which slides substantially horizontally is incorporated in governor mechanism part C so as to serve as an actuator for governor arm 29. Vertically extended governor arm 29 is attached to an active end of governor arm 29. The base end of governor link 27 is vertically rotatably pivoted to the top end of governor arm 29. In the completed electronic governor, the armature voltage of electromagnetic solenoid 32 is controlled based on accelerator setting, an actual engine speed, and a detected value of load etc., thereby moving spool 32*a*. Corresponding to the movement degree of spool 32*a*, governor link 27 is moved in governor link chamber 1*e* so as to rotate control sleeve 21 engaging with governor link 27 together with plunger 7. Incidentally, in the case of an electronic governor, there is freedom of choosing which rotational direction of plunger 7, i.e., which moving direction of governor link 27 is made into the side for increasing the injection quantity of fuel.

As shown in FIGS. 3 and 4, upwardly open hook groove 27*a* is formed in the tip portion of governor link 27 (i.e., the end opposed to the base end thereof pivoted onto governor arm 29) whether it is provided for a centrifugally operated governor or an electronic governor.

In order to assemble distributor-type pump DP, lower mechanism part A and head mechanism part B are combined up and down first. For combining lower mechanism part A and head mechanism part B when pump head 2 of head mechanism part B is installed on main body housing 1 of lower mechanism part A, lower spring bracket 24 and plunger spring 22 are automatically inserted into tappet chamber 1*f*, and while lower spring bracket 24 is positioned on tappet 11 beforehand arranged in tappet chamber 1*f*, tappet 11 is pressed against cam 4*a* by the biasing force of plunger spring 22. Simultaneously, the bottom of distributor shaft 9 integrally engages with the upper end of distributor driving shaft 19, and bevel gear 20 meshes with bevel gear 5. Moreover, governor link chamber 1*e* is formed in the state of being surrounded by main body housing 1 and pump head 2. In governor link chamber 1*e*, control slider 21 and slider guide 15 come to be arranged along the bottom surface of pump head 2.

Finally, by using screwed holes 2*a* bored in pump head 2 as shown in FIG. 10 and using screwed holes bored in main body housing 1, main body housing 1 and pump head 2 are fastened together through bolts so as to complete the combination of both mechanism parts A and B, whereby a plunger transmission system from camshaft 4 to plunger 7 and a distributor-shaft transmission system from camshaft 4 to distributor shaft 9 are completed. In addition, fuel feed pump 6 is attached onto the side of main body housing 1 after the combination of both mechanism parts A and B (fuel feed pump 6 may be previously attached on lower mechanism part A so as to serve as a portion of lower mechanism part A), and a fuel tube is interposed between the discharge port of fuel feed pump 6 and fuel-feeding-pipe connector 26 projecting from pump head 2.

Distributor-type pump DP is perfected by attaching governor mechanism part C to the side of such combined mechanism parts A and B, as shown in FIG. 13 (the same is said of electronic governor type pump DP 2 although only the assembly aspect of centrifugally operated governor type pump DP 1 is indicated.). If the tip of governor link 27 is inserted in the rear end opening of governor link chamber 1*e* formed between main body housing 1 and pump head 2 combined together while governor housing 3 being joined to joint surface 1*b* of main body housing 1, the more governor housing 3 approaches joint surface 1*b*, the deeper governor link 27 enters governor link chamber 1*e*. Then, by using any one of some later-discussed engaging means, lock pin 21*a* of control slider 21 is engaged into hook groove 27*a* so as to complete the governor. In addition to the above work, centrifugally operated governor type pump P1 is perfected by making governor sleeve 30 on camshaft 4 contact governor arm 29 in governor housing 3. Finally, governor housing 3 contacting joint surface 1*b* of main body housing 1 is fastened to main body housing 1, thereby completing distributor-type fuel injection pump DP.

In the completed governor, governor link 27 is moved by rotating governor arm 29 in the above-mentioned way. Then, control slider 21 engaging with governor link 27 slides horizontally so that control sleeve 17 and plunger 7 are rotated together. In this way, the opening time of plunger (main) lead 7*a* to inhalation port 8*a* is altered so as to change the fuel-discharging stroke period of plunger 7, thereby adjusting the amount of injected fuel.

For engaging or removing lock pin 21*a* of control slider 21 with and from hook groove 27*a* of governor link 27, it may be considered that the tip of governor link 27 vertically rotatably supported on governor arm 29 is swung vertically, or that governor link 27 is rotated centering on the length thereof. FIGS. 14 to 29 illustrate various embodiments (first through seventh embodiments) of means for detachably engaging lock pin 21*a* of control slider 21 with hook groove 27*a* of governor link 27, which can be applied when distributor-type fuel injection pump DP1 is assembled. These will be described.

According to a first embodiment shown in FIGS. 3, 4, 14 and 15, a cylindrical lift pin 33 having axis which substantially perpendicularly intersects the length of governor link 27 when viewed in plan is laid in governor link chamber 1*e* of main body housing 1. It is good that lift pin 33 is incorporated in lower mechanism part A so as to serve as a portion of lower mechanism part A. In addition, as shown in FIGS. 3 and 4, the bottom portion of governor link chamber 1*e* is formed therein with a hemicylindrical groove 1*g* for slidably guiding lift pin 33 in the axial direction thereof. Namely, the only necessity for installing lift pin 33 in main body housing 1 is that lift pin 33 is made to slide along groove 1*g* so as to be located at the fixed position. Even if lift pin 33 is replaced with a later-discussed lift pin 34 shown in FIGS. 16 and 17, or with a later-discussed lift pin 35 shown in FIGS. 18 to 21, groove 1*g* can be used for positioning and slidably guiding either lift pin 34 or 35 while it being attached into main body housing 1.

Figure 14:
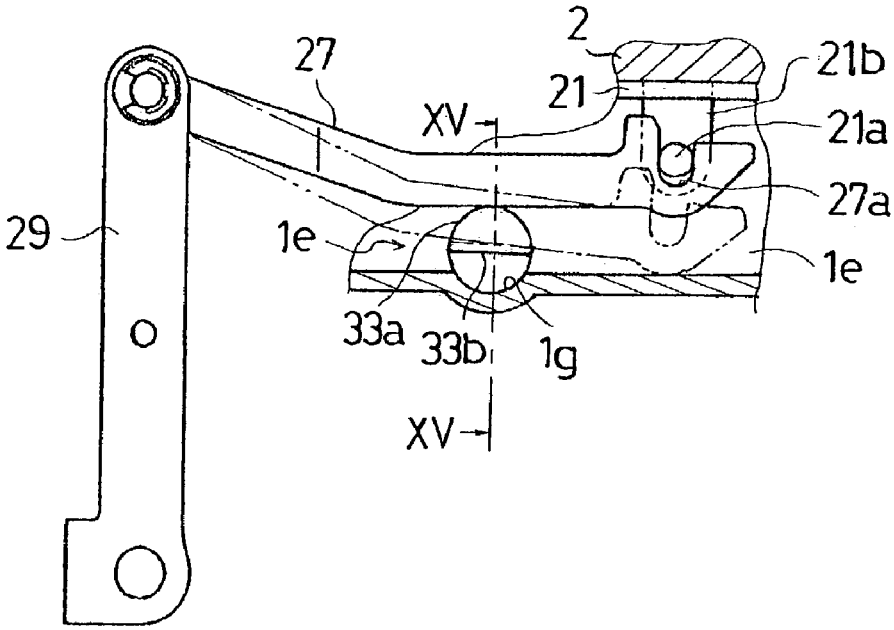
FIG. 14 is a fragmentary sectional side view of a governor link 27 and control slider 21 which detachably engage with each other through a lift pin 33 according to a first embodiment.

Lift pin 33 projects outward from main body housing 1 (not shown) so as to enable its manipulation for rotation from the exterior of main body housing 1. Furthermore, a partial tip of lift pin 33 in main body housing 1 has a subtense-like cut in section so as to form a substantially hemicylindrical cam portion 33*a*. Governor link 27 inserted in governor link chamber 1*e* rides on cam portion 33*a* rectangularly when viewed in plan. When lift pin 33 is rotated so as to place a cut surface 33*b* downward as shown in FIG. 14, governor link 27 rides on the peripheral surface of cam portion 33*a* as the full line drawn in FIG. 14, so that hook groove 27*a* in the tip of governor link 27 swings upward and hooks lock pin 21*a*. On the contrary, if lock pin 21*a* is going to be removed from hook groove 27*a*, lift pin 33 is rotated so as to place cam portion 33*a* under cut surface 33*b*. Thus, as the phantom line drawn in FIG. 14, governor link 27 rotates downward by deadweight and abuts at the bottom edge thereof against cut surface 33*b*, so that the tip of governor link 27 rotates downward so as to separate hook groove 27*a* downward from lock pin 21*a*.

Therefore, in the case that governor mechanism part C is attached to combined mechanism parts A and B, lift pin 33 is previously placed to make cut surface 33*b* face upward. Then, while governor housing 3 approaching joint surface 1*b* of main body housing 1, governor link 27 is fit with cut surface 33*b* on the top of cam portion 33*a* and inserted into governor link chamber 1*e* until governor link 27 reaches the fixed position in governor link chamber 1*e*, that is, hook groove 27*a* reaches the position just under lock pin 21*a*. In addition, above-mentioned stopper plate 1*i* for defining the bound of approaching governor link 27 may be used for positioning of lock pin 21*a* directly under of hook groove 27*a*. That is, if control slider 21 is positioned so as to locate control sleeve 17 in rotation to the non-injection position, and the tip of governor link 27 inserted into governor link chamber 1*e* comes to abut against stopper plate 1*i*, hook groove 27*a* is naturally arranged just under lock pin 21*a*. In the later-discussed second and third embodiments, stopper plate 1*i* can also be used for positioning of governor link 27 similarly.

In this way, after positioning the point of governor link 27, lift pin 33 is rotated so as to make hook groove 27*a* swing upward, thereby bringing governor link 27 into engagement with lock pin 21*a*. For removal of governor mechanism part C from lower mechanism part A, by rotating lift pin 33 so as to make downward cut surface 33*b* face upward, hook groove 27*a* can be removed down from lock pin 21*a*.

Figure 16:
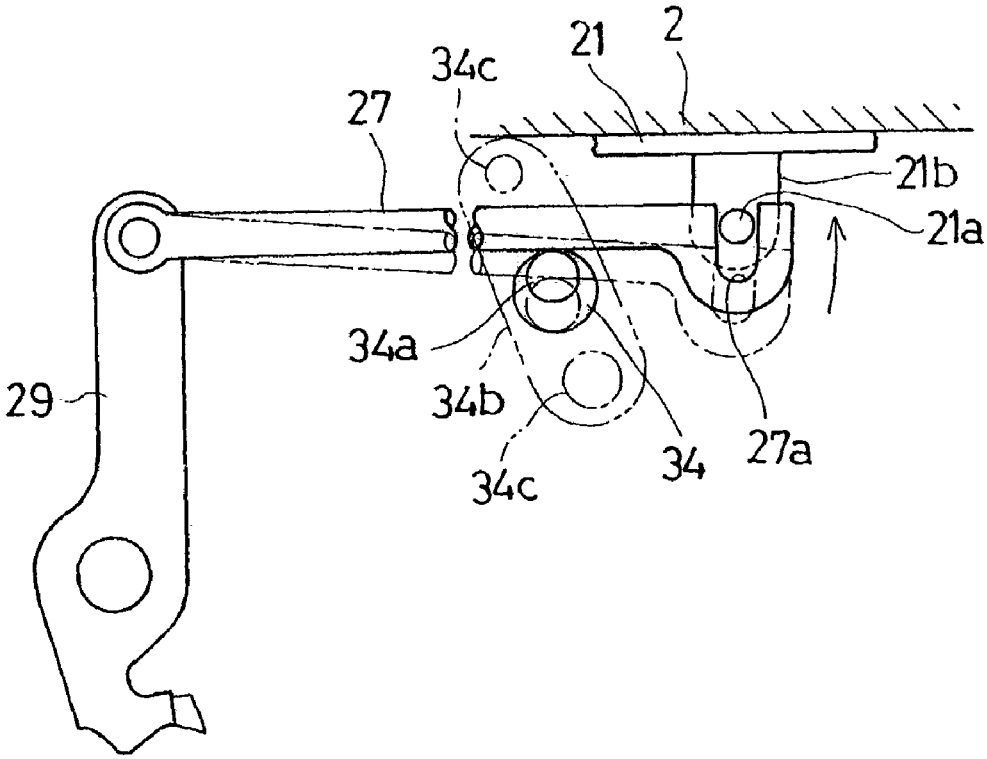
FIG. 16 is a fragmentary sectional side view of governor link 27 and control slider 21 which detachably engage with each other through a lift pin 34 according to a second embodiment.
Figure 17:
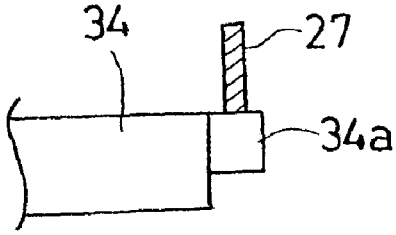
FIG. 17 is a fragmentary rear view partly in section of the same.

In the second embodiment shown in FIGS. 16 and 17, lift pin 34 including an axially eccentric cam portion 34*a* replaces above-mentioned lift pin 33 having a cut as cam portion 33*a*. Similarly to lift pin 33, lift pin 34 is rotatably supported in governor link chamber 1*e* of main body housing 1. Lift pin 34 projects outward from main body housing 1 so as to enable being handled for its rotation from the exterior of main body housing 1. Cam portion 34*a*, which is diametrically smaller than the body of lift pin 34, projects from an end portion of lift pin 34 in main body housing 1 so as to be located eccentrically with respect to axis of lift pin 34. Governor link 27 is placed on cam portion 34*a* by deadweight.

By rotational operation of lift pin 34, cam portion 34*a* revolves around the axis of lift pin 34 between a top dead center as the full line drawn in FIG. 16 above the axis of lift pin 34 and a bottom dead center as the phantom line drawn in FIG. 16 below the axis of lift pin 34. When cam portion 34*a* reaches the top dead center, lock pin 21*a* is engaged in hook groove 27*a* of governor link 27. When cam portion 34*a* reaches the bottom dead center, lock pin 21*a* is disengaged from hook groove 27*a*.

Moreover, a flange 34*b* is integrally formed of lift pin 34. Flange 34*b* is formed with a couple of screwed holes 34*c* in the arrangement of a point symmetry focusing on the axis of lift pin 34 when viewed along the axis of lift pin 34. By screwing flange 34*a* to main body housing 1 using screwed holes 34*c*, cam portion 34*a* is fixed to the above-mentioned top dead center, whereby the connection of governor link 27 with control slider 21 can be conserved. The couple of screwed holes 34*c* also serve as points for location of the upper and bottom dead centers. For locating cam portion 34*a* to the bottom dead center, positions of both screwed holes 34*c* may be exchanged.

In addition, as shown in FIG. 16, the diameters of both screwed holes 34*c* may be different from each other. Thereby, it can be distinguished whether cam portion 34*a* is in the top dead center or the bottom dead center. In this case, when cam portion 34*a* is made into the bottom dead center, both screwed holes 34*c* cannot be used for screwing. However, since it is restricted at the time of attachment and detachment of governor link 27 and control slider 21 to make cam portion 34*a* into the bottom dead center, screwed holes 34*c* are sufficient if they are used only as the points for location.

Figure 15:
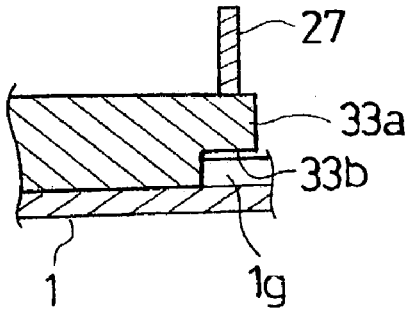
FIG. 15 is a cross sectional view taken along XV—XV line of FIG. 14.

Such a flange structure may be adapted to lift pin 33 of the first embodiment shown in FIGS. 14 and 15.

The third embodiment shown in FIGS. 18 to 21 will be described. According to this embodiment, lift pin 35 is moved approximately perpendicularly to governor link 27 when viewed in plan so as to move governor link 27 vertically. Lift pin 35 is formed at one end thereof into a bolt-head 35*c*, and threaded in a certain length from bolt-head 35*a* so as to form a screw portion 35*b*. A main body portion of lift pin 35 is extended in a certain length from screw portion 35*b*. The other end of lift pin 35 is tapered so as to form a taper portion 35*a*.

Lift pin 35 is so arranged as to make bolt-head 35*c* out of main body housing 1, and to make the main body portion thereof and taper portion 35*a* into main body housing 1 (along groove 1*g* in governor link chamber 1*e*) while screw portion 35*b* engaging with a female screw 1*h* formed in a side wall of main body housing 1. In this way, lift pin 35 is axially moved by rotating bolt-head 35*c* manually or so on in the exterior of main body housing 1.

Figure 18:
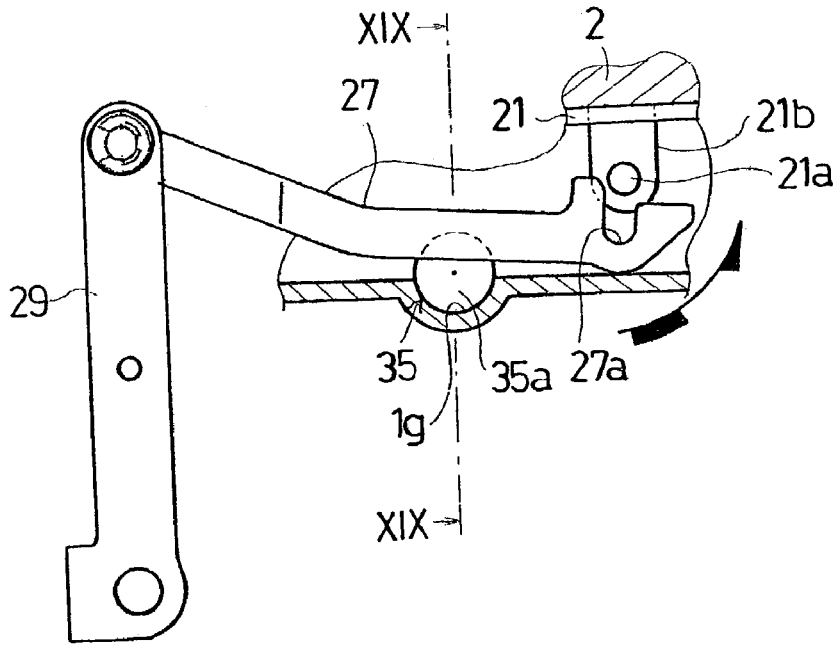
FIG. 18 is a fragmentary sectional side view of governor link 27 and control slider 21 which detachably engage with each other through a lift pin 35 according to a third embodiment, wherein a hook groove 27*a* is removed to the underside of a lock pin 21*a*.
Figure 19:
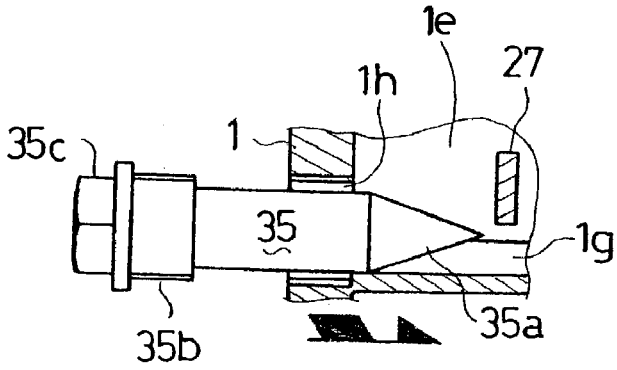
FIG. 19 is a cross sectional view taken along XIX—XIX line of FIG. 18.
Figure 20:
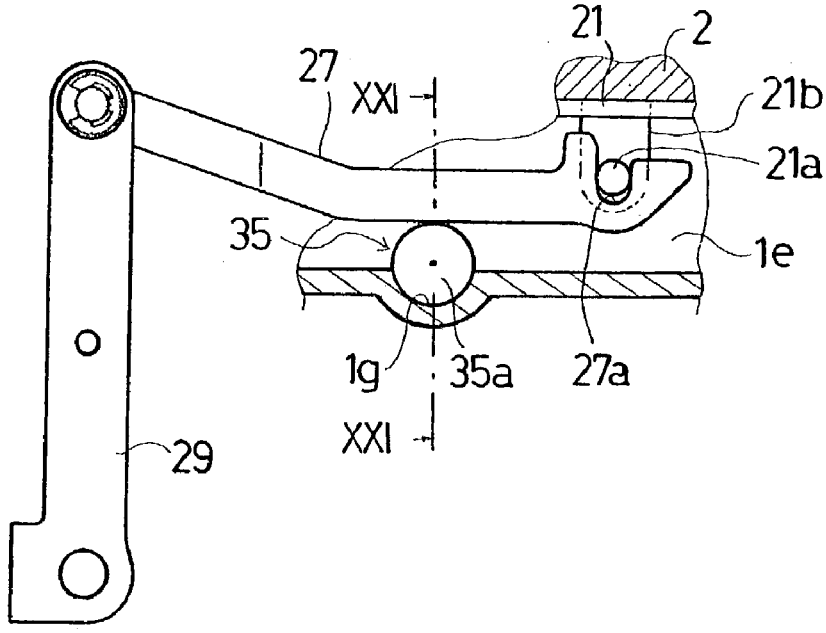
FIG. 20 is a fragmentary sectional side view of the same according to the third embodiment, wherein lock pin 21*a* is engaged in hook groove 27*a*.
Figure 21:
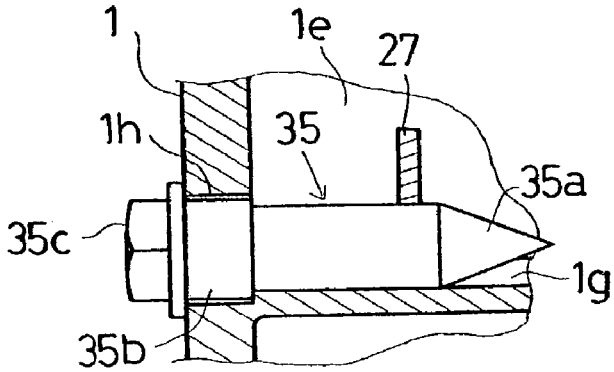
FIG. 21 is a cross sectional view taken along XXI—XXI line of FIG. 20.

Before attaching governor mechanism part C to combined lower mechanism part A and head mechanism part B, as shown in FIGS. 18 and 19, taper portion 35*a* of lift pin 35, which is previously inserted in governor link chamber 1*e* while lift pin 35 being disposed along groove 1*g* through female screw 1*h*, is offset from the approaching course of governor link 27 in governor link chamber 1*e*, or alternatively, lift pin 35 may be entirely arranged outside main body housing 1. In this situation, governor link 27 is inserted into governor link chamber 1*e* so as to arrange hook groove 27*a* just under lock pin 21*a* as shown in FIG. 18. Then, lift pin 35 is made to slide along groove 1*g* to be inserted deeply so that governor link 27 rides on taper portion 35*a* and is raised gradually so as to swing the tip thereof upward. Finally, by handling bolt-head 35*c* so as to rotate lift pin 35, screw portion 35*b* is screwed into female screw 1*h*. When bolt-head 35*c* comes to contact the external side surface of main body housing 1, lift pin 35 is fixed. At this time, governor link 27 is raised over the top end of lift pin 35 so that lock pin 21*a* is perfectly engaged in hook groove 27*a*.

When releasing this engagement, bolt-head 35*c* is rotated in reverse so as to remove screw portion 35*b* outward from female screw 1*h* and further make lift pin 35 slide to the exterior of main body housing 1 so that taper portion 35*a* retreats from the position directly under governor link 27, whereby governor link 27 rotates downward by deadweight so as to remove hook groove 27*a* downward from lock pin 21*a*.

Alternatively, in the exterior of main body housing 1, a flange as mentioned above may be formed on lift pin 35 instead of screw portion 35*b* and bolt-head 35*c*. In this case, it should be configured that the flange comes to contact main body housing 1 just when lift pin 35 slides to the final position thereof for engaging governor link 27 with control slider 21 (the position shown in FIGS. 20 and 21). The flange in contact with main body housing 1 should be screwed up together with main body housing 1.

In the above first through third embodiments, the lift pin is needed and it must be operated for engagement and disengagement of governor link 27 and control slider 21. According to a fourth embodiment shown in FIG. 22, no additional member is necessary for the engagement and disengagement of them. Depending upon processing of main body housing 1, hook groove 27*a* and lock pin 21*a* naturally engage with each other only by insertion of governor link 27 to a certain position in governor link chamber 1*e* during attachment of governor mechanism part C to combined mechanism parts A and B.

In this embodiment, the bottom surface of governor link chamber 1*e* of main body housing 1, which contacts governor link 27 so as to slidably guide it, is formed along the sliding course of governor link 27 so as to serve as a slope surface S and a horizontal surface H. Slope surface S is acclivitous from a bottom edge Sa (toward governor housing 3) to a top edge Sb (opposite to governor housing 3). Horizontal surface H is substantially horizontally formed continuously from top edge Sb of slope surface S.

Especially, governor link 27 used in this embodiment is required to have hook groove 27*a* in the tip thereof formed so that, of both vertical side edges 27*b* and 27*c* sandwiching the bottom of hook groove 27*a*, side edge 27*c* opposite to governor housing 3 has a reduction of the approximately diameter of lock pin 21*a* in height compared with side edge 27*b* toward governor housing 3.

Figure 22:
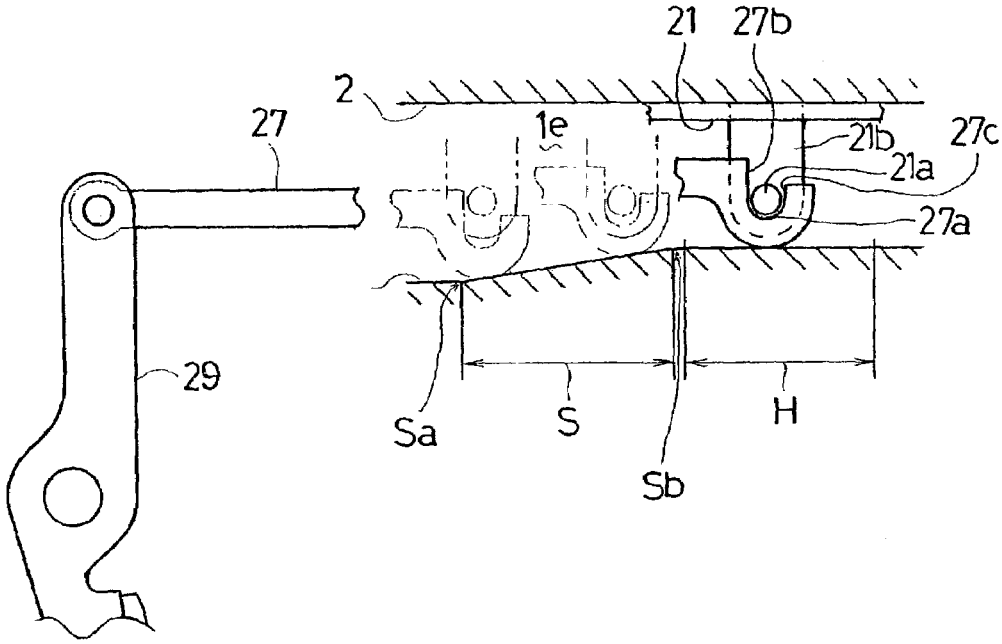
FIG. 22 is a fragmentary sectional side view of governor link 27 and control slider 21 which detachably engage with each other through a slope surface of main body housing 1 according to a fourth embodiment.

On the occasion of attaching governor mechanism part C to both combined mechanism parts A and B, control slider 21 is beforehand positioned so as to place lock pin 21*a* above bottom edge Sa of slope surface S in governor link chamber 1*e*, as the phantom line drawn in FIG. 22. In this situation, in order to attach governor housing 3 to main body housing 1, governor housing 3 is brought horizontally close to joint surface 1*b* of main body housing 1 while the tip of governor link 27 extended from governor housing 3 being inserted into governor link chamber 1*e* so as to contact the bottom surface of governor link chamber 1*e*. At last, the top end of side edge 27*c* of governor housing 27 passes just under lock pin 21*a* and edge 27*b* abuts against lock pin 21*a*.

At this time, hook groove 27*a* is still located under lock pin 21*a* so that they are before engagement.

Further, governor housing 3 is made to approach joint surface 1*b* horizontally, so that the tip of governor link 27 ascends slope surface S, whereby edge 27*b* pushes lock pin 21*a* horizontally so as to make control slider 21 slide. In this way, the higher hook groove 27*a* is moved, the deeper lock pin 21*a* is inserted into hook groove 27*a*. When the tip of governor link 27 passes top edge Sb and rides on horizontal surface H as the full line drawn in FIG. 22, the engagement of lock pin 21*a* and hook groove 27*a* is completed. At this time, governor housing 3 contacts joint surface 1*b* of main body housing 1. Then, governor housing 3 is fastened to main body housing 1.

Incidentally, in completed fuel injection pump DP, by the faculty of the governor, the tip of governor link 27 moves so as to make control slider 21 slide as the rotating speed of camshaft 4 varies. However, the motion range of the tip of governor link 27 in this control is defined only as horizontal surface H, and since the tip does not go down slope surface S, lock pin 21*a* and hook groove 27*a* are not disengaged.

Moreover, if governor housing 3 is removed from main body housing 1 and taken away from joint surface 1*b*, the tip of governor link 27, while engaging with control slider 21, is moved from horizontal surface H to slope surface S. At last, when the tip reaches bottom edge Sa, lock pin 21*a* is removed from hook groove 27*a*. If governor housing 3 is further taken away from main body housing 1, control slider 21 does not slide but governor link 27 further slides on the top surface of main body housing 1. Finally, governor link 27 is removed from main body housing 1, thereby completing the detachment of governor mechanism part C.

Figure 23:
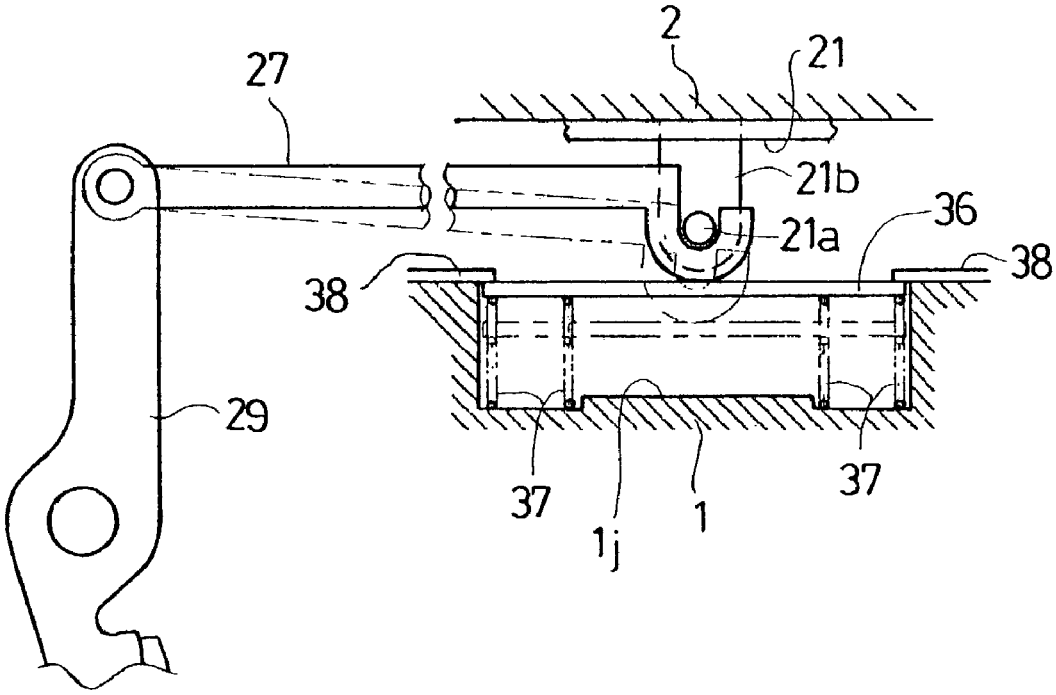
FIG. 23 is a fragmentary sectional side view of governor link 27 and control slider 21 which detachably engage with each other through an upwardly biased lift plate 36 according to a fifth embodiment.
Figure 24:
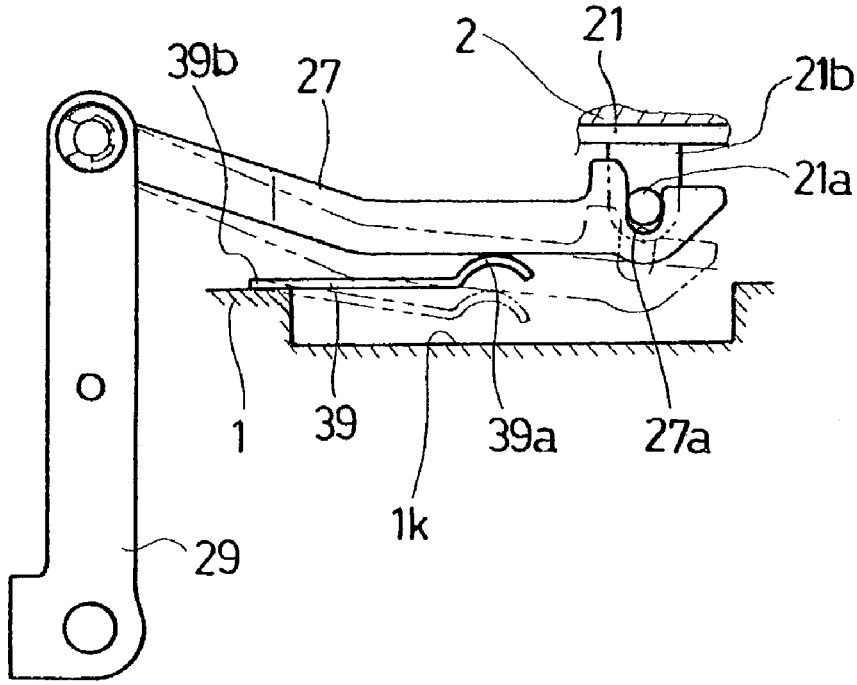
FIG. 24 is a fragmentary sectional side view of governor link 27 and control slider 21 which detachably engage with each other through an upwardly biased flat spring 39 according to a sixth embodiment.
Figure 25:
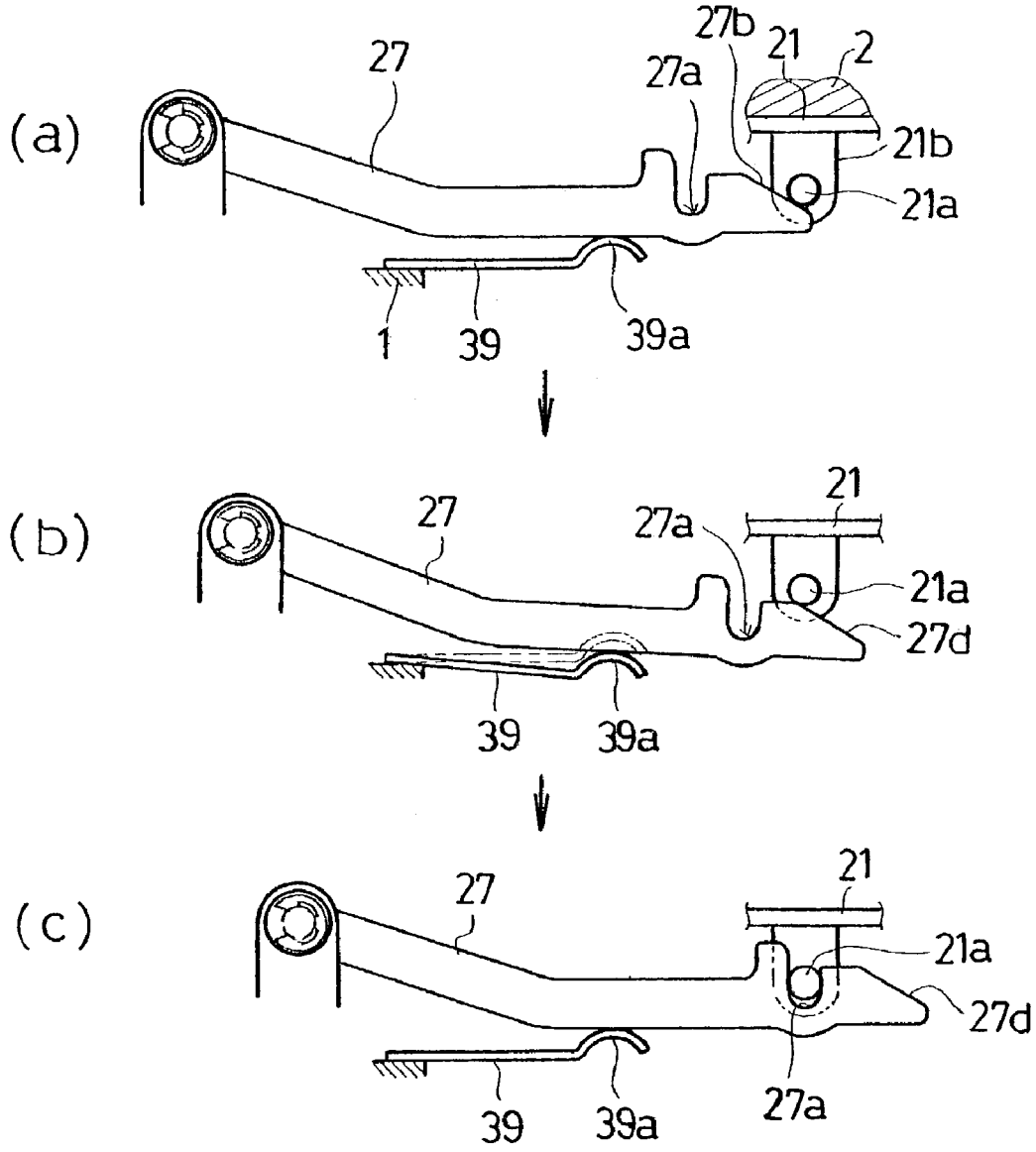
FIG. 25(*a*)–(*c*) are fragmentary sectional side views of governor link 27 and control slider 21 which are being engaged with each other through flat spring 39 wherein governor link 27 is formed with a slope 27*d* so as to enable governor link 27 and control slider 21 to be engaged with each other without forcibly rotating flat spring 39 downward.

According to the fifth embodiment shown in FIG. 23 and the sixth embodiment shown in FIGS. 24 and 25, an upward biasing force is applied to governor link 27. Governor link 27 is made to swing downward against the upward biasing force and swing upward by using the upward biasing force, thereby performing engagement and disengagement of lock pin 21*a* and hook groove 27*a*.

In the fifth embodiment shown in FIG. 23, the bottom surface of governor link chamber 1*e* of main body housing 1 in the sliding course of the tip of governor link 27 is partly recessed so as to be open upward, thereby forming a recess 1*j*. A lift plate 36 is disposed in recess 1*j*. A spring 37 is interposed between the bottom surface of recess 1*i* and lift plate 36 so as to bias lift plate 36 upward. Moreover, a stopper plate 73 is fixed to the bottom surface portion of governor link chamber 1*e* of main body housing 1 surrounding recess 1*j* so as to restrict the rise of lift pin 36 to the approximately same height as the bottom surface of governor link chamber 1*e*.

In the case where governor mechanism part C is attached to both mechanism parts A and B put together, beforehand, lift plate 36 is depressed against spring 37 in any way and control slider 21 is arranged so as to place lock pin 21*a* above lift plate 36. In this situation, the tip of governor link 27 is made to slide on the bottom surface of governor link chamber 1*e*. Soon, the tip of governor link 27 falls onto lift plate 36 which falls a degree within recess 1*j*. When hook groove 27*a* reaches the underside of lock pin 21*a*, lift plate 36 is released from the downward pressure force so that the tip of governor link 27 is pushed up together with lift plate 36 by the biasing force of spring 37, thereby engaging lock pin 21 into hook groove 21*a*.

In addition, the tip of governor link 27 may be formed with a slope portion 27*d* which is shown in governor link 27 of FIG. 25 according to a later-discussed sixth embodiment, so that, only by bringing governor housing 3 close to main body housing 1 without using the means for depressing lift plate 36 compulsorily, hook groove 27*a* and lock pin 21*a* can engage with each other automatically. In this case, the tip of governor link 27 sliding along the bottom surface of governor link chamber 1*e* to be connected to control slider 21 rides on lift plate 36 which is depressed by stopper plate 38 substantially as high as the bottom surface of governor link chamber 1*e*, thereby contacting lock pin 21*a*. And by further inserting the tip of governor link 27 in governor link chamber 1*e*, lock pin 21*a* rides on slope portion 27*d* of governor link 27. At this time, lock pin 21*a* applies a downward pressure force onto the tip of governor link 27 so as to depress lift plate 36 against the biasing force of spring 37, thereby allowing lock pin 21*a* to relatively move on slope portion 27*d*. Soon, hook groove 27*a* reaches directly under lock pin 21*a*, and then, by the upward biasing force of spring 37, lift plate 36 rises automatically with the tip of governor link 27 so as to engage lock pin 21*a* in hook groove 27*a*.

According to the sixth embodiment shown in FIGS. 24 and 25, similarly to the fifth embodiment, elastic means having upward biasing force is arranged just under governor link 27. However, in this embodiment, instead of lift plate 36 and spring 37 of the above embodiment, a flat spring 39 is substantially horizontally arranged along the sliding course of the tip of governor link 27 during attachment of governor mechanism part C so as to be appropriately as high as the bottom surface of governor link chamber 1*e* of main body housing 1. Incidentally, a base end portion 39*b* of flat spring 39 toward governor housing 3 is fixed to the bottom surface of governor link chamber 1*e* of main body housing 1. The opposite end portion of flat spring 39 serves as an active end, which is arcuately curved so as to form an abutting portion 39*a* to abut against the lower end of governor link 27. In addition, the downward rotation of flat spring 39 and governor link 27 is allowed at worst by an upwardly open recess 1*k* which is formed in the bottom surface of governor link chamber 1*e* of main body housing 1 below flat spring 39 and governor link 27.

In the engagement process of the governor link 27 and control slider 21 at the time of attaching governor mechanism part C to both mechanism parts A and B put together, the upward biasing force of flat spring 39 replacing lift plate 36 is used similarly to the fifth embodiment. In the case of FIG. 24, beforehand, flat spring 39 is fixed with abutting portion 39*a* placed downward in its rotation. When hook groove 27*a* in the tip of governor link 27 riding on abutting portion 39*a* reaches the underside of lock pin 21*a*, the fixation of flat spring 39 is canceled so that the tip of governor link 27 is raised by restoring of flat spring 39, thereby inserting lock pin 21*a* into hook groove 27*a*.

Governor link 27 of FIG. 25 is formed at the tip end thereof with slope portion 27*d*. By using such shaped governor link 27, the means for fixing flat spring 39 as it is rotated downward, which is needed by the configuration of FIG. 24, is unnecessary. That is, the engagement of governor link 27 and control slider 27 is performed automatically by bringing governor housing 3 close to joint surface 1*b* of main body housing 1. The process reaching the engagement will be described in accordance with FIG. 25. First, governor link 27 inserted in main body housing is slid on abutting portion 39*a*. Soon, governor link 27 gets lock pin 21 riding on slope 27*d* in the tip thereof, as shown in FIG. 25(*a*). By further sliding governor link 27 deeply, abutting portion 39*a* is rotated downward automatically by the elasticity of flat spring 39 so as to allow lock pin 21 to relatively move on slope 27*d*, as shown in FIG. 25(*b*). Finally, when hook groove 27*a* reaches the just underside of lock pin 21*a*, flat spring 39 restores automatically so as to engage lock pin 21*a* in hook groove 27*a*.

In the above-mentioned first through sixth embodiments shown in FIGS. 14 through 25, the vertical swing of governor link 27 pivoted on governor arm 29 is used. However, according to the seventh embodiment shown in FIG. 26, governor link 27 is connected to control slider 21 by rotating governor link 27 with the length thereof serving as a fulcrum shaft, i.e., with rotary axis arranged in its insertion direction in governor link chamber 1*e*. In this embodiment, a side edge of governor link 27 on a side of hook groove 27*a* toward governor housing 3, replacing above-mentioned side edge 27*b*, is bent perpendicularly to the length of governor link 27, thereby forming a stopper portion 27*e*.

Figure 26:
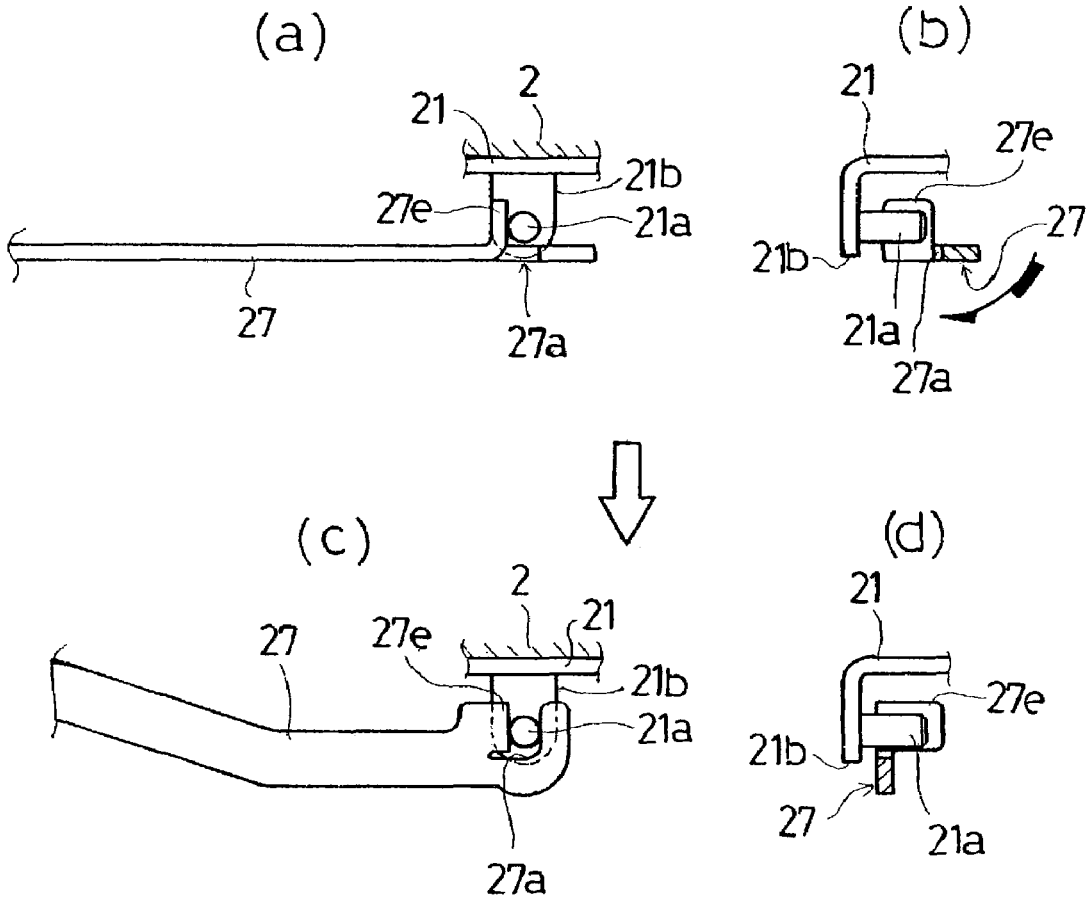
FIG. 26(*a*)–(*d*) illustrate an engagement process of governor link 27 with control slider 21 by rotating governor link 27 centering on the length thereof according to a seventh embodiment, wherein FIG. 26(*a*) is a fragmentary side view of governor link 27 which is positioned before its engagement prior to being engaged, FIG. 26(*b*) is a fragmentary front view partly in section of the same, FIG. 26(*c*) is a fragmentary side view of governor link 27 is being engaged with control slider 27, and FIG. 26(*d*) is a fragmentary sectional front view of the same.

When governor mechanism part C is attached to both combined mechanism parts A and B, at the beginning, as shown in FIG. 26(*a*), governor link 27 is set so as to erect stopper portion 27*e* vertically while hook groove 27*a* being horizontal. For this attitude, governor link 27 is rotated at 90 degrees from that in engagement shown in FIG. 26(*b*). If governor housing 3 is brought close to main body housing 1 while governor link 27 being inserted into governor link chamber 1*e*, soon, stopper portion 27*e* abuts against lock pin 21*a*, as shown in FIG. 26(*a*). At this time, governor link 27 is rotated at 90 degrees so as to be put into the attitude shown in FIG. 26(*b*), thereby making lock pin 21*a* fit in hook groove 27*a*.

Alternatively, not governor link 27 but governor housing 3 may be rotated at 90 degrees from its original attitude at the beginning. In this case, when stopper portion 21*a* of governor link 27 inserted into governor link chamber 1*e* of main body housing 1 comes to abut against lock pin 21*a*, the entire of governor housing 3 is rotated so as to engage hook groove 27*a* with lock pin 21*a*.

In fuel injection pump DP having the above-mentioned configuration indicated in FIGS. 3 to 5 and so on, head mechanism part B incorporates control sleeve 27 and control slider 21 serving as the linearly movable member for rotating control sleeve 17. After this head mechanism part B is attached to lower mechanism part A, governor link 27 extended from governor housing 3 is inserted into main body housing 1 so as to be connected to control slider 21 while governor housing 3 of governor mechanism part C is attached to main body housing 1 of lower mechanism part A. For connecting governor link 27 with control slider 21, governor link 27 must be so long as to be inserted deeply in governor link chamber 1*e* of main body housing 1 so as to bring the tip thereof into the vicinity of control sleeve 17 (which is disposed close to flange 1*a* oppositely to joint surface 1*b* toward governor housing 3). Furthermore, while governor mechanism part C is attached to both combined mechanism parts A and B, for engaging or disengaging hook groove 27*a* of governor link 27 with and from lock pin 21*a* of control slider 21, governor link 27 must be swung vertically as shown in FIGS. 14 to 25, or either governor link 27 or governor housing 3 must be rotated with the length of governor link 27 serving as a fulcrum shaft as shown in FIG. 27.

Figure 27:
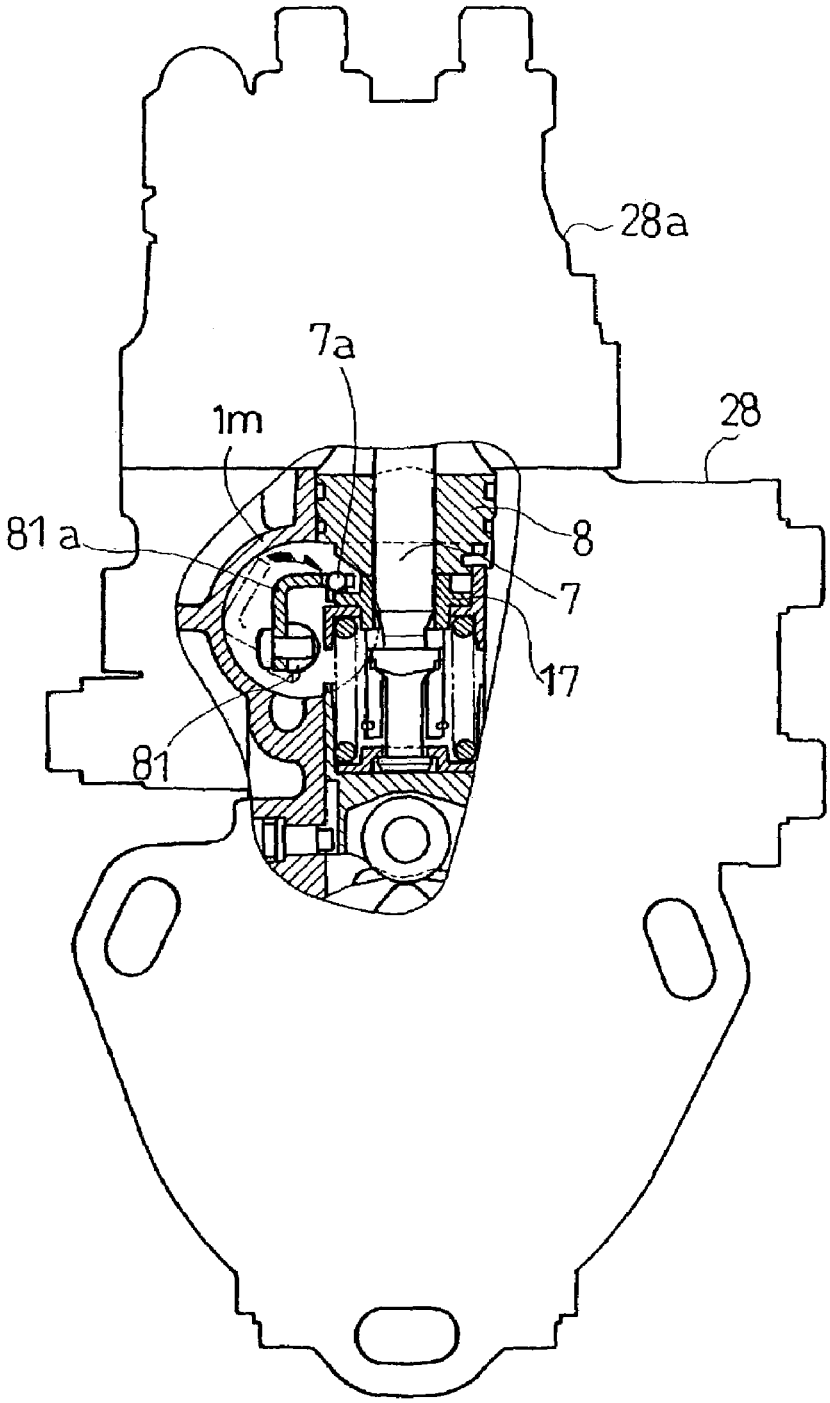
FIG. 27 is a front view partly in section of a distributor-type fuel injection pump DP' wherein a governor link 82 is connected to a slider rod 81 serving as a linearly movable member for rotating a control sleeve 17 attached in the lower mechanism part.
Figure 28:
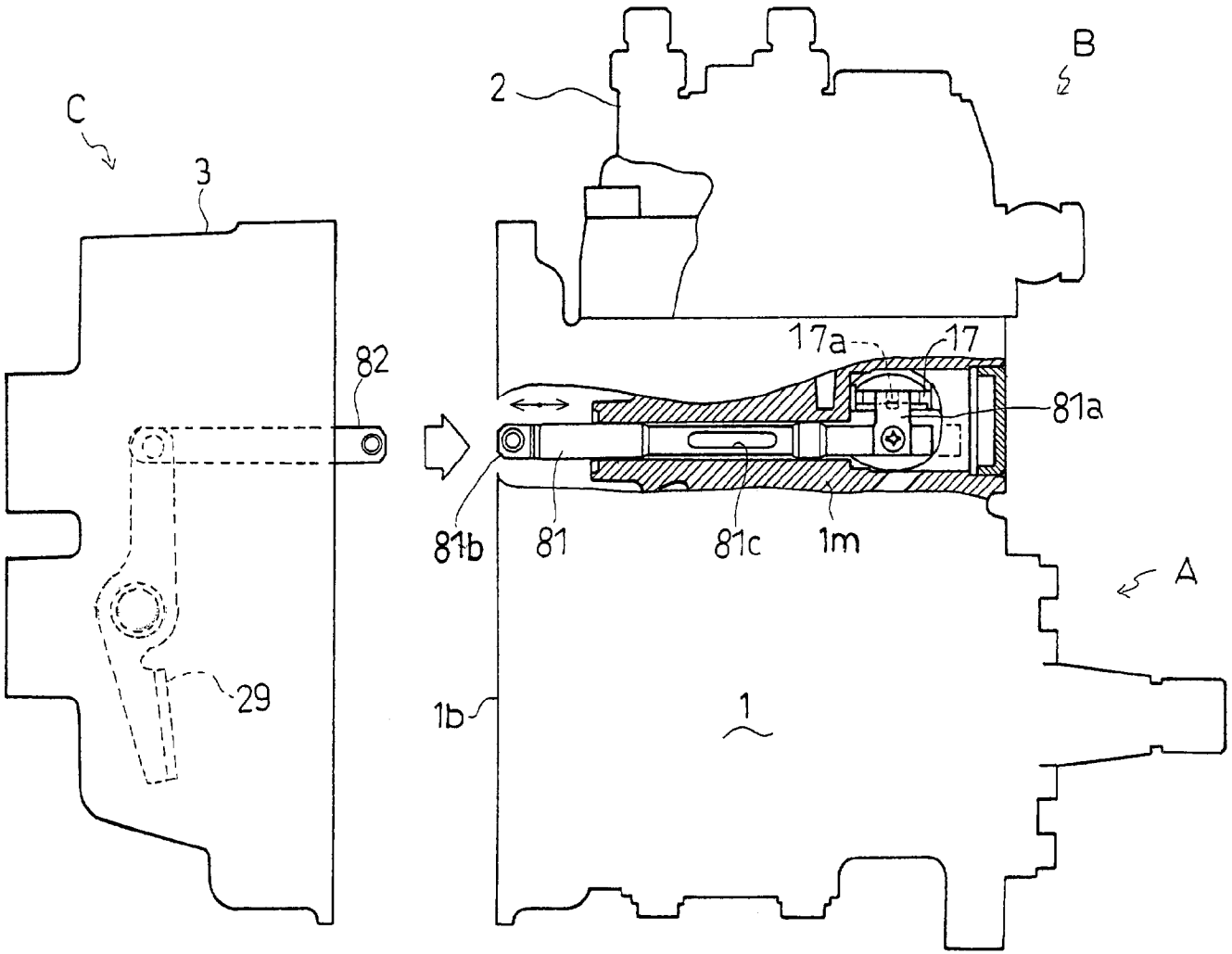
FIG. 28 is a side view partly in section of distributor-type fuel injection pump DP' while governor mechanism part C is being attached thereto.
Figure 29:
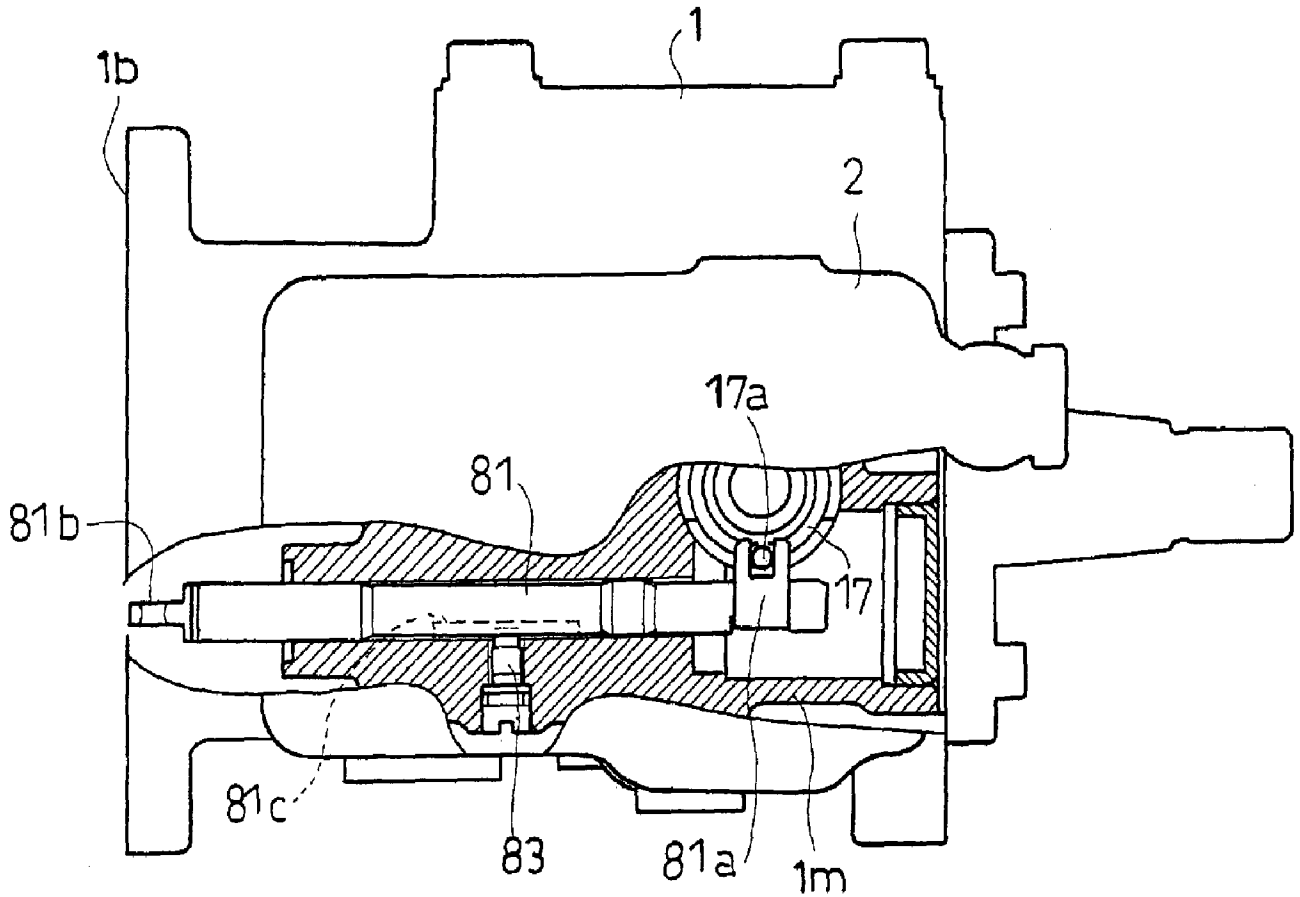
FIG. 29 is a plan view partly in section of distributor-type fuel injection pump DP' from which governor mechanism part C has been removed.

In a following distributor-type fuel injection pump DP' shown in FIGS. 27 to 29 (it is sufficient whether it is a mechanical governor type or an electronic governor type), lower mechanism part A incorporates a slide rod 81 serving as the linearly movable member for rotating control sleeve 17, and governor mechanism part C incorporates a governor link 82, which is so short as to be almost entirely contained in governor housing 3, instead of governor link 27.

During assembly of fuel injection pump DP', first, control sleeve 17 and slide rod 81 are connected at the combination process of lower mechanism part A and head mechanism part B. A governor (it may be either mechanical or electronic) can be completed by connecting governor link 82 extended from governor housing 3 with slide rod 81 without inserting governor link 82 deeply in main body housing 1 while governor mechanism part C is attached to both mechanism parts A and B which have been combined in the way.

Slide rod 81 is slidably and rotatably contained in a slide rod receipt portion 1*m* formed in main body housing 1 of lower mechanism part A so as to be laid substantially horizontally. Slide rod 81 has a doglegged fork arm 81*a* extended from the vicinity of an end portion thereof toward joint surface 1*b*, in perpendicular to axis of slide rod 81. On the other hand, a lock pin 17*a* projects upward from a top end of control sleeve 17. Fork arm 81*a* is rotated by rotating slide rod 81 centering on its axis, as shown in FIG. 27, thereby putting lock pin 17*a* into a slit in a tip of fork arm 81*a* (as the full line drawn in FIG. 27) or removing lock pin 17*a* from the slit (as the phantom line shown in FIG. 27).

As shown in FIGS. 28 to 29, the other end portion of slide rod 81 projects from slide rod receipt portion 1*m* of main body housing 1 so as to be extended extremely close to joint surface 1*b*. This end portion serves as a joint end portion 81*b*. Moreover, slide rod 81 is formed at an intermediate portion thereof with a guide slot 81*c* extended in parallel to the axis direction of slide rod 81. The die length and location of guide slot 81*c* are established so that the slide of slide rod 81 for governing control may be possible. A whirl-lock pin 83 can be inserted into slide rod receipt portion 1*m* of main body housing 1 so as to be engaged in guide slot 81*c*, as shown in FIG. 29.

On the other hand, in governor mechanism part C, a base end of governor link 82 is pivoted onto the top end of governor arm 29 in governor housing 3, and a tip of governor link 82 serves as a joint end portion 82*a*. Compared with above-mentioned governor link 27, governor link 82 is so short as to be almost entirely contained in governor housing 3.

On the occasion of assembling fuel injection pump DP' of the configuration shown in FIGS. 27 to 29, beforehand, in lower mechanism part A, slide rod 81 is rotated to be placed in the integrity as the phantom line shown in FIG. 24, and whirl-lock pin 83 is removed. In this situation, pump head 2 is attached and fastened to the upper portion of main body housing 1, and then, slide rod 81 is rotated so as to engage fork arm 81*a* with lock pin 17*a* of control sleeve 17, and further, whirl-lock pin 83 is inserted into main body housing 1 so as to be engaged into guide slot 81*c*. In this way, control sleeve 17 and slide rod 81 are engaged with each other during combining of both mechanism parts A and B.

Then, on the occasion of attaching governor mechanism part C to both combined mechanism parts A and B, governor housing 3 is made to approach joint surface 1*b* of main body housing 1 so that joint end portion 81*b* of slide rod 81 projecting from slide rod receipt portion 1*m* of main body housing 1 is connected to joint end portion 81*b*, the tip of above-mentioned slide member 30 inserted in governor housing 3 is made to abut against the lower portion of governor arm 29, and then, governor housing 3 is fit and fixed to main body housing 1, thereby completing the governor.

In distributor-type pump DP (including DP', so hereinafter) completed in this way, camshaft 4 is rotated synchronously with a crankshaft of an engine. By rotating cam 4*b* integrally with camshaft 4, fuel feed pump 6 actuates to feed fuel into fuel gallery 42 in pump head 2. Moreover, by rotating cam 4*a* integrally with camshaft 4, plunger 7 reciprocates through tappet 11 so as to charge fuel from fuel gallery 42 into later-discussed fuel-compression chamber 43 and discharge it to distributor shaft 9. By meshing of bevel gears 5 and 20, distributor shaft 9 is rotated synchronously to the rotation of camshaft 4. During this rotation, distributor shaft 9 distributes the fuel to plural delivery valves 18 one by one so as to make each delivery valve 18 deliver the fuel to each fuel injection valve in each engine cylinder.

As mentioned above, fuel injection pump DP is excellent in its ease of assembly as the whole, especially with respect to assembly of a governor having a complicated connection structure. Also, each parts (sub mechanical parts) A, B and C after disassembling is made to facilitate the assembly excellently. For example, lower mechanism part A has camshaft 4 which can be inserted into main body housing 1 while key 13 is previously provided thereon, or head mechanism part B is provided with slider guide 15 for guiding and supporting control slider 21 which has a configuration for preventing upper spring bracket 23 from falling out. Such excellence in assembly can contribute to automation most of all the processes for assembling fuel injection pump DP.

Description will now be given of a fuel course formed within head mechanism part B of fuel injection pump DP. Incidentally, the following description is given of the fuel course concerning the present invention, mainly of fuel gallery 42 and fuel-compression chamber 43 in plunger barrel 43. The description of the fuel course concerning distributor shaft 9, distributor barrel 10 and delivery valves 18 will be omitted because it may adopt the general structure.

As shown in FIG. 3, FIG. 5, etc., the overhead clearance of plunger 7 in plunger barrel 8 is offered as a fuel-compression chamber 43 for pressurizing the introduced fuel. The fuel introduced here is pressurized by plunger 7, discharged from a discharge port 8*c* provided at the upper portion of plunger barrel 8 to distributor shaft 9, and finally, distributed to each of delivery valves 18 so as to be delivered to each fuel injection valve of each engine cylinder.

In pump head 2, fuel-supply oil passage 41 and fuel gallery 42 are bored so as to communicate with each other. Fuel gallery 42 is formed so as to surround plunger barrel 8 and always open for free passage to inhalation port 8*a* formed in plunger barrel 8. In addition, as shown in FIG. 5, annular groove 8*d* may be formed on the periphery of plunger barrel 8 so as to be always open for free passage to fuel gallery 42 in pump head 2. In this case, annular groove 8*d* also serves as a portion of fuel gallery 42.

Oppositely to inhalation port 8*a* through plunger 7, plunger barrel 8 is provided with a leak port 8*b*, which is diametrically smaller than inhalation port 8*a*. Further, a fuel escaping circuit is formed, which is extended from leak port 8*b* through an on-off valve Ta serving as a portion of a later-discussed timer T so as to reach either fuel gallery 42 (including annular groove 8*d*) or a fuel tank in the exterior of the fuel injection pump, so that the fuel flowing out from fuel-compression chamber 43 through leak port 8*b* is supplied again as fuel to be injected.

Some examples will be described about the structure of this fuel escaping circuit. Referring to FIG. 5 etc., timer T is arranged in a valve chamber 45 formed in pump head 2. Further, in pump head 2 are formed a fuel passage 2*b* from leak port 8*b* to on-off valve Ta in valve chamber 45, and a fuel passage 2*c* from valve chamber 45 on a subsequent side of on-off valve Ta to annular groove 8*d*, so as to return fuel to fuel gallery 42 communicating with annular groove 8*d*.

Figure 30:
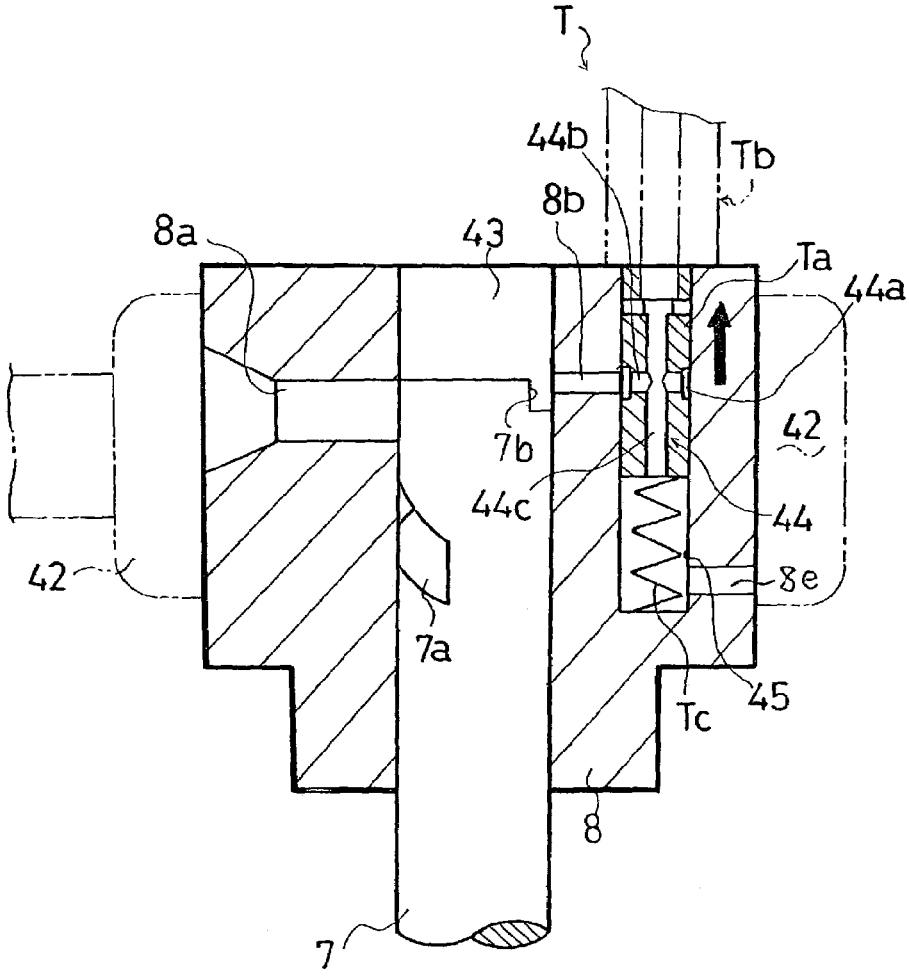
FIG. 30 is a fragmentary sectional side view of an on-off valve Ta while being open according to an embodiment wherein a fuel escaping circuit including a timer T is formed within a plunger barrel 8 so as to let fuel escape to a fuel gallery 42.
Figure 31:
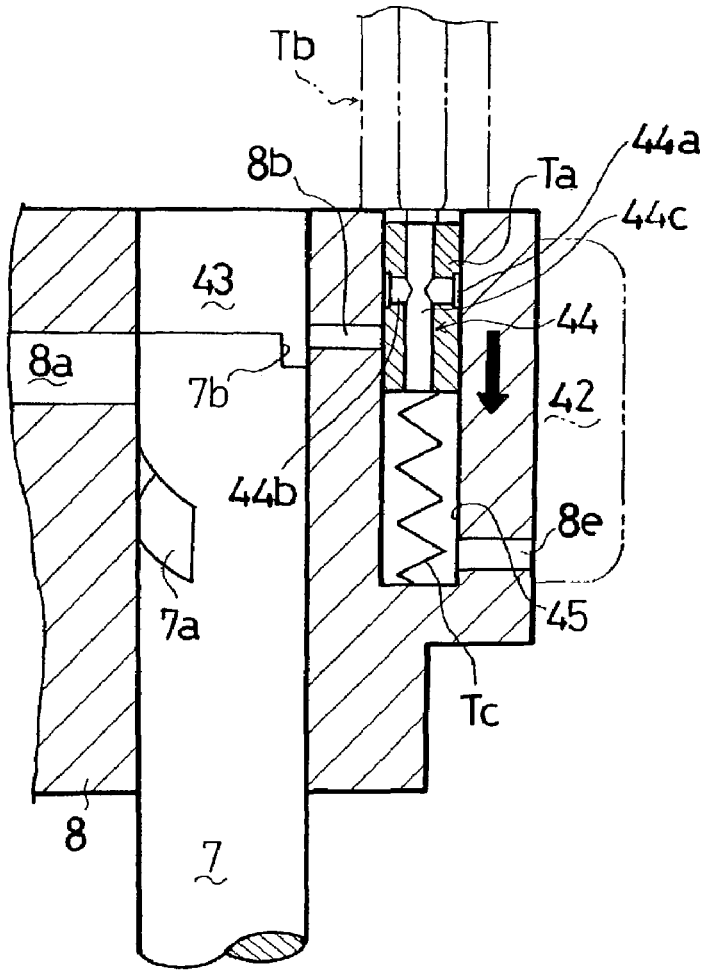
FIG. 31 is a fragmentary sectional side view of on-off valve Ta while being closed in the same way.

Referring to the fuel escaping circuit of FIGS. 30 and 31, it is the same that fuel is returned to fuel gallery 42. However, plunger barrel 8 incorporates timer T, and within plunger barrel 8 is formed the entire of fuel escaping circuit from leak port 8*a* to fuel gallery 42 through passage way 44 formed within on-off valve Ta, valve chamber 45 and fuel passage 8*e*. Alternatively, fuel passage 8*e* shown in FIGS. 30 and 31 may be replaced with annular groove 8*d* shown in FIG. 5 etc.

Figure 32:
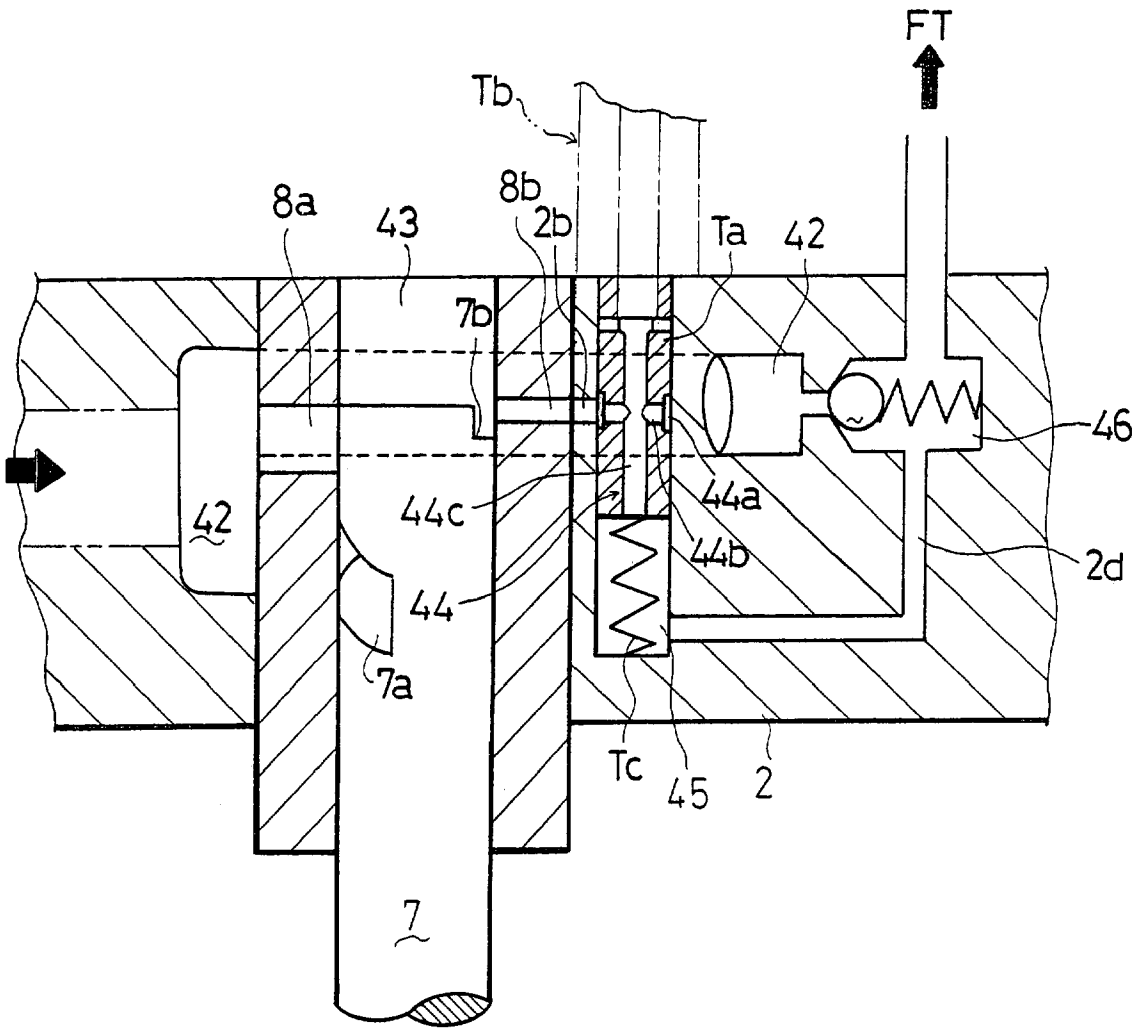
FIG. 32 is a fragmentary sectional side view of a configuration of a fuel escaping circuit including timer T, which can return fuel leakage to a fuel tank FT outside the fuel injection pump and join with excessive fuel in fuel gallery 42.

The fuel escaping circuit of FIG. 32 has a configuration for recovering the surplus fuel in fuel gallery 42 as well as the configuration for returning fuel to a fuel tank FT in the exterior of the fuel injection pump. In this regard, in pump head 2 is formed a fuel passage 2*d* from an oil sump which is formed within valve chamber 45 subsequently to on-off valve Ta (valve chamber 45 formed within pump head 2 according to this embodiment may be formed within plunger barrel 8 as shown in FIGS. 30 and 31). At the outside of pump head 2, a fuel tube 21 is piped from fuel passage 2*d* so as to be connected to fuel tank FT. A check valve chamber 46 is formed in the midway of fuel passage 2*d* so as to communicate with fuel gallery 42. A check valve 70 is arranged in check-valve chamber 46. Check valve 70 checks indraft of fuel from fuel gallery 42 to check-valve chamber 46. When the internal pressure of fuel gallery 42 becomes more than regulation, check valve 70 introduces the overflowing fuel from fuel gallery 42 into check-valve chamber 46, and collects it to fuel tank FT.

Description will now be given of the configuration of plunger 7, process of fuel injection by motion of plunger 7, and the control of fuel-injection time by opening and closing motion of on-off valve Ta of timer T concerning the process, in accordance with FIGS. 30 to 36.

Figure 33:
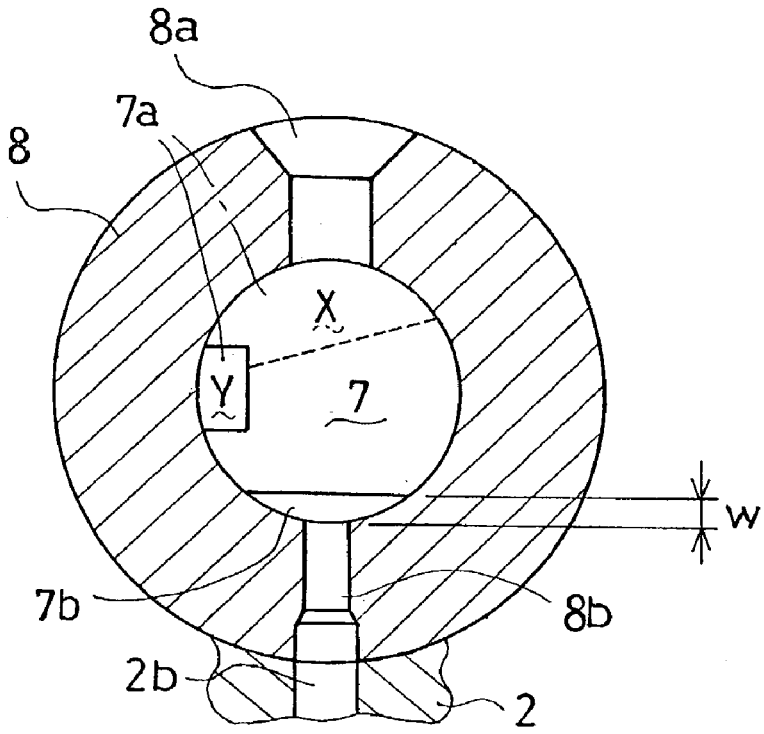
FIG. 33 is a sectional plan view partly in section of plunger barrel 8 and a plunger 7.
Figure 34:
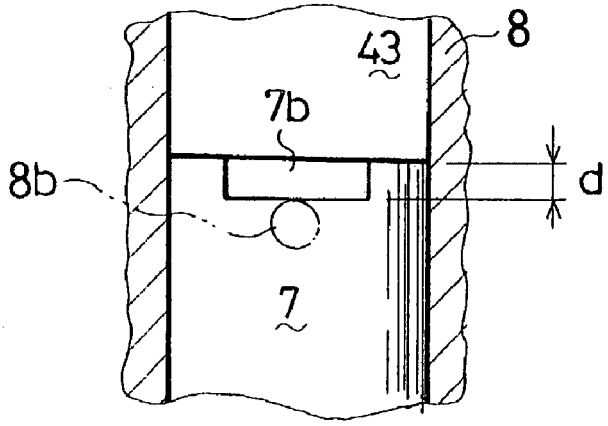
FIG. 34 is a fragmentary side view of a head portion of plunger 7 formed with a sub port 7*b* having an even depth.
Figure 44:
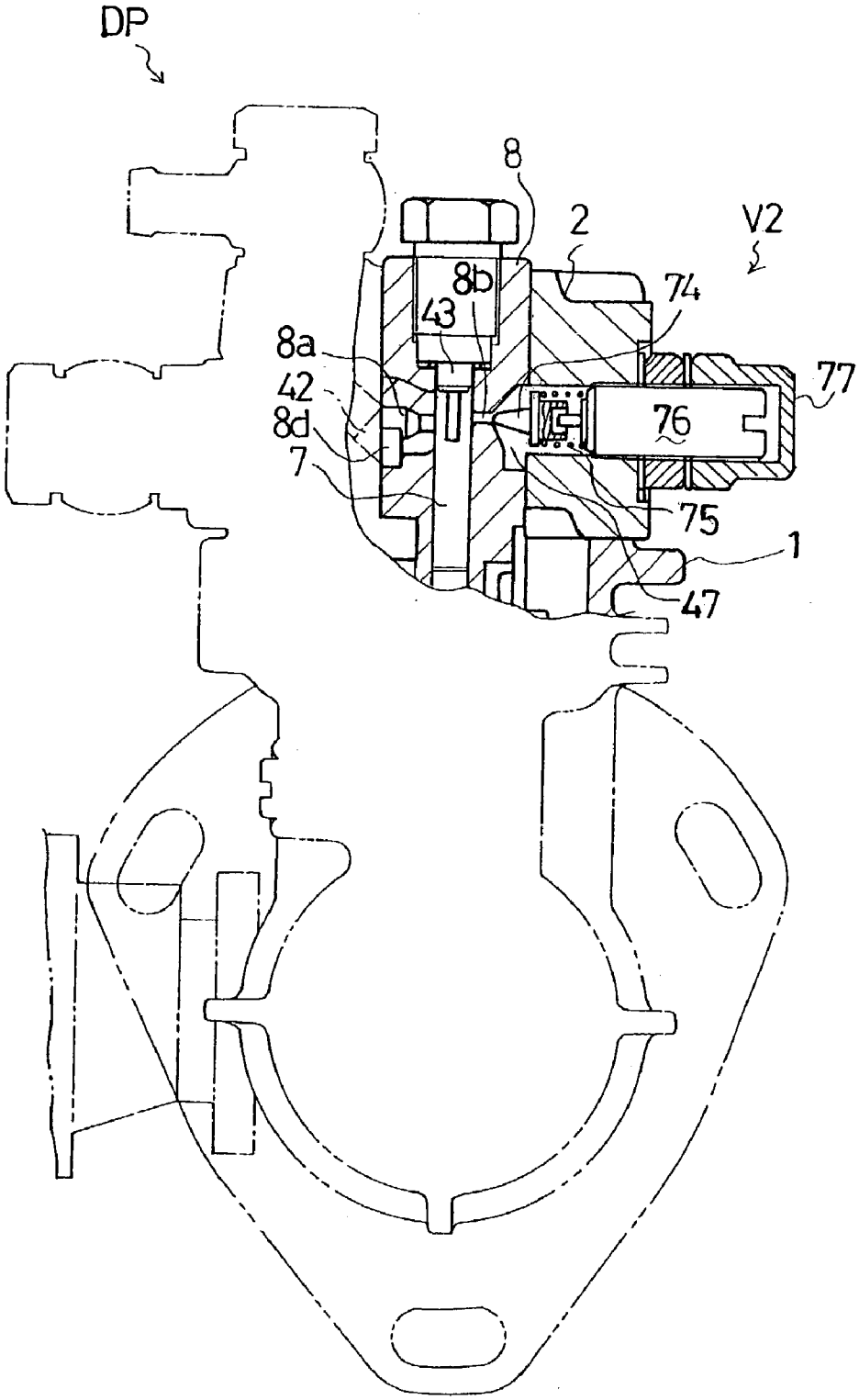
FIG. 44 is a front view partly in section of the fuel injection pump including flow control means V2 serving as a second embodiment of the fuel leak flow control means, which is opened by pressure of leakage from sub port 8*b*.
Figure 45:
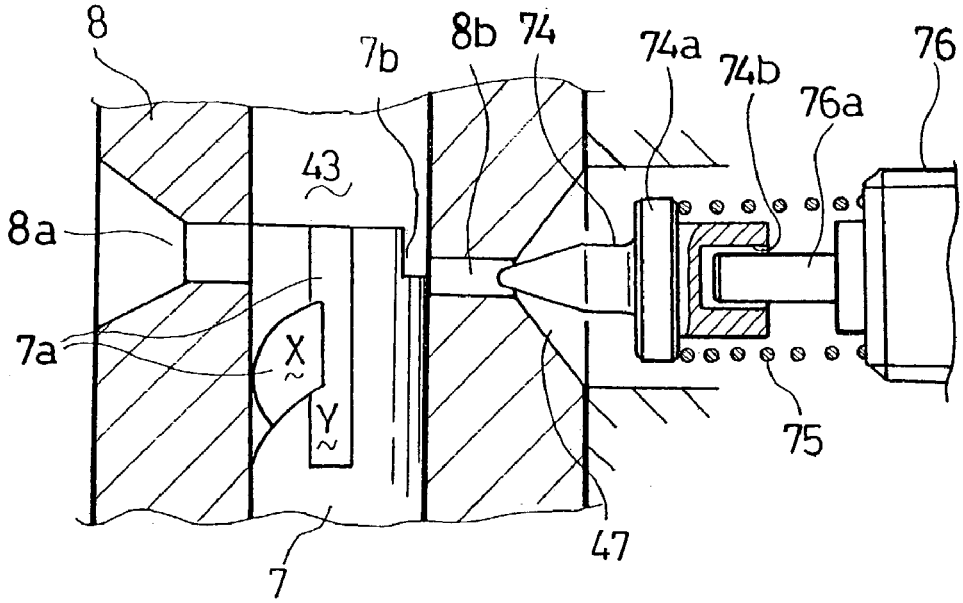
FIG. 45 is an enlarged fragmentary plan view of a second embodiment of the same.

As shown in FIG. 3 or FIG. 33, plunger (main) lead 7*a* for making inhalation port 8*a* and fuel-compression chamber 43 open for free passage is formed in plunger 7. As shown in FIG. 33, or as shown in FIGS. 44 and 45 concerning a later-discussed embodiment for adjusting flow from sub port 8*b*, for details, main lead 7*a* consists of a spiral groove X, which is formed in the side surface of plunger 7, and a fluting Y, which is formed from an end of spiral slot X to the head of plunger 7. If spiral groove X comes to communication with inhalation port 8*a*, fuel in fuel-compression chamber 43 flows into spiral groove X through fluting Y and further flows out into fuel gallery 42 through inhalation port 8*a*, thereby terminating the fuel-discharging stroke as discussed later. Furthermore, as shown in FIGS. 33 and 34 etc., substantially oppositely to main lead 7*a*, the head of plunger 7 facing fuel-compression chamber 43 is notched in a shape of a step so as to form sub lead 7*b* which can be open for free passage to leak port 8*b*.

When plunger 7 reaches its bottom dead center, the head thereof is positioned below inhalation port 8*a*. At this time (the fuel-inhaling stroke), fuel in fuel gallery 42 flows into fuel compression chamber 43 through inhalation port 8*a*. While plunger 7 rises from the bottom dead center, the head periphery of plunger 7 comes to close inhalation port 8*a* (finalizing the fuel-inhaling stroke). On the other hand, fuel-compression chamber 43 is brought into communication with leak port 8*b* through sub lead 7*b*. FIG. 30 and FIG. 32 show the location of plunger 7 at this time, and the integrity of both ports 8*a* and 8*b*.

If on-off valve Ta is opening at this time as shown in FIG. 30, the fuel in fuel-compression chamber 43 flows out from leak port 8*b* so that the pressure of fuel discharged from discharge port 8*c* does not rise to a regulation value. That is, the stroke (fuel-discharging stroke) for discharging the regular amount of fuel to delivery valves 18 does not start immediately after finalizing of the fuel-inhaling stroke. This stroke for making fuel in fuel-compression chamber 43 escape in a fixed period after the fuel-inhaling stroke finalizing is called a "discharging-delay stroke".

If plunger 7 further goes up, soon, the side surface of plunger 7 below sub lead 7*b* closes leak port 8*b* (finalizing the discharging delay stroke), and the discharge of fuel of the regulation amount is started (starting the fuel discharging stroke). Incidentally, since leak port 8*b* is diametrically smaller than inhalation port 8*a* so as to restrict the escape of fuel, the pressure of fuel discharged from fuel-compression chamber 43 rises to the regular value immediately after plunger 7 closes leak port 8*b*. By this discharge of the regular amount of fuel, high-pressured fuel injection from delivery valves 18 to the fuel injection valves is performed. This fuel-discharging stroke is ended when main lead 7*a* of plunger 7 comes to be open for free passage to inhalation port 8*a*. Then, plunger 7 reaches the top dead center.

If plunger 7 is actuated while on-off valve Ta is closed as shown in FIG. 31, the fuel-discharging stroke is started simultaneously with the end of fuel-inhaling stroke, without passing through the discharging-delay stroke.

Incidentally, even in the discharging-delay stroke, fuel under the regular amount is discharged from discharge port 8*c*, thereby performing low-pressured fuel injection in the engine cylinders. However, henceforth, "feeding" and "fuel injection" point out those of regularly pressurized fuel. For example, "fuel injection start time" shall be the injection start time of the fuel discharged from discharge port 8*c* under the regular pressure.

Thus, while the cam angle, which measures the stroke of plunger 7, is within the angle range leading to that corresponding to the top dead center, the fuel-discharging stroke of plunger 7 for performing fuel injection is started and ended. The starting period thereof can be advanced by opening of on-off valve Ta and delayed by closing thereof.

In addition, plunger 7 is rotated around its axis by the governor so as to adjust the timing when main port 7*a* comes to open to inhalation port 8*a*, i.e., the end time of fuel-discharging stroke, thereby adjusting the fuel injection period for determination of the amount of injected fuel. If the sectionally horizontal area of sub lead 7*b* (that is, a lead width w in the radial direction of plunger 7 shown in FIG. 33) and arrangement thereof are suited so as to make sub lead 7*b* of rising plunger 7 communicate with leak port 8*b* in the whole of rotational range of plunger 7 by the governor, the discharging-delay stroke can be performed regardless of the amount of injected fuel. Alternatively, it may be configured so that sub lead 7*b* of rising plunger 7 does not open to leak port 8*b* if plunger 7 is within a certain range of its rotation. Therefore, when the governor controls the amount of injected fuel to a certain range, the discharging-delay stroke does not appear so that fuel is injected at an early stage regardless of the state of on-off valve Ta. In this case, for example, if leak port 8*b* is offset from the vertical movement zone of sub lead 7*b* at the rotational location of plunger 7 set at the time of engine starting, the start of fuel injection becomes early when the engine starts. If the amount of injected fuel is changed after the engine gets warm, leak port 8*b* becomes possible to open to sub lead 7*b*, thereby enabling the start of fuel injection to be delayed, and extremely enabling later-discussed timer T to be omitted.

Furthermore, the end time of the discharging delay distance which corresponds at the fuel injection start time becomes so late that the position of leak port 8*b* is made high, and sub lead 7*b* is made deep. Then, according to the embodiment of FIG. 34, the whole bottom surface of sub lead 7*b* is formed in a fixed depth d (between the left and right ends thereof in FIG. 34). In this case, although the end time of fuel-discharging stroke in which main lead 7*a* opens for free passage to inhalation port 8*a* changes with rotation of plunger 7 by the governor, the end time of discharging-delay stroke, i.e., fuel injection start time, does not change.

Figure 35:
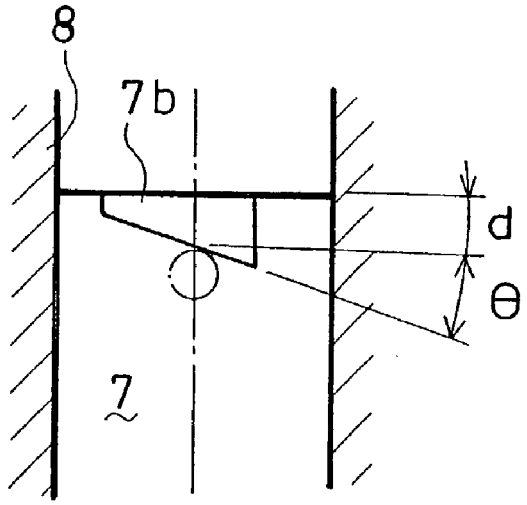
FIG. 35 is a fragmentary side view of the same portion formed with sub port 7*b* whose bottom surface is sloped in one direction.
Figure 36:
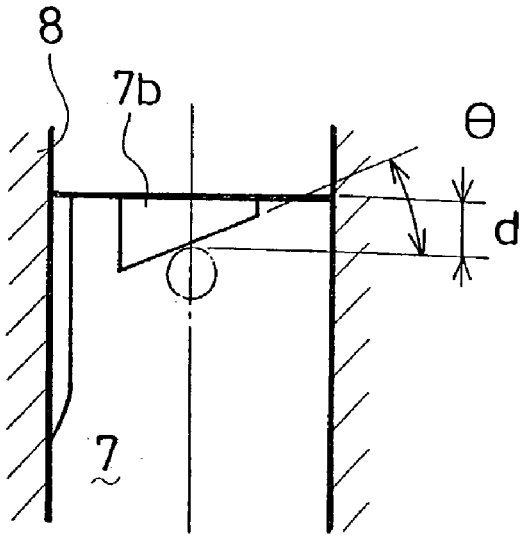
FIG. 36 is a fragmentary side view of the same portion formed with sub port 7*b* whose bottom surface is sloped oppositely to that of FIG. 35.

Alternatively, the depth of bottom surface of sub lead 7*b* may vary as shown in FIGS. 35 and 36, so that the fuel injection period can be automatically controlled (however, it is only the case where on-off valve Ta is opened so as to make the discharging-delay stroke appear.) with the control of the amount of injected fuel (that is, adjustment of a period of the fuel discharging-delay stroke).

In FIG. 35, the depth of the central position of sub lead 7*b* is set to d, and the bottom surface thereof inclines downward to the right side in a degree of θ. Therefore, the right end bottom is deeper than d, and the left end bottom is shallower than d.

On the other hand, in FIG. 36, although the depth of the central position of sub lead 7*b* is set to d, the bottom surface thereof inclines upward to the right side in a degree of θ. Therefore, the right end bottom is shallower than d, and the left end bottom becomes deeper than d.

If leak port 7*b* of the form as shown in FIG. 35 or 36 is provided, the period and end time of the discharging-delay stroke can be adjusted by rotation of plunger 7 for regulation of the amount of injected fuel by the governor. That is, when the deep portion of sub lead 7*b* stands face to face against leak port 8*b* with sliding of plunger 7, the end time of discharging-delay stroke defining the start of fuel injection becomes late. On the other hand, when the shallow portion of sub lead 7*b* stands face to face against leak port 8*b*, the end time of discharging-delay stroke is advanced so that the start of fuel injection becomes early.

In addition, it is considerable that both plungers 7 having respective sub leads 7*b* which incline oppositely to each other may be prepared so as to correspond to reversing of the spiral direction of main lead 7*a* or of the rotational direction of plunger 7 with the governor control. Moreover, it may be determined which plunger 7 is applied when it is decided which is suitable whether the discharging-delay stroke is lengthened or shortened (whether the amount of escaping fuel is increased or decreased) with the variation of the fuel-discharging stroke period (with the variation of the amount of injected fuel).

Description will be given of a fundamental structure of timer T in accordance with FIGS. 30 to 32. Timer T is so configured that on-off valve Ta, a valve actuator Tb and a biasing member Tc are fit in valve chamber 45 formed within either plunger barrel 8 or pump head 2. In valve chamber 45, on-off valve Ta is sandwiched between valve actuator Tb and biasing member Tc so as to be balanced in location by the biasing force of biasing member Tc and the pressing force of valve actuator Tb which are opposite to each other. The interior portion of valve chamber 45 subsequent to on-off valve Ta is always open for free passage into fuel gallery 42 or fuel tank FT through a fuel passage (a fuel passage 8*e* in the case of FIGS. 30 and 31).

Incidentally, in FIGS. 30 to 32, biasing member Tc is disposed under on-off valve Ta so as to bias on-off valve Ta upward while valve actuator Tb being above on-off valve Ta, however, according to a later-discussed structure of FIG. 40, biasing member Tc is disposed above on-off valve Ta, and valve actuator Tb under on-off valve Ta. Only an important point is that on-off valve Ta is controlled in location according to the degree of actuation of valve actuator Tb while being pinched by valve actuator Tb and biasing member Tc.

A passageway 44 is formed in on-off valve Ta. One opening end of passageway 44 is open to the interior of valve chamber 45 subsequent to on-off valve Ta, and the other opening end is switched between the state where it is open to leak port 42 and the state where it is shut from leak port 42 according to the actuation of valve actuator Tb.

In short, on-off valve Ta is acceptable only if it can move in valve chamber 45 and be controlled in location so as to connect and disconnect primary leak port 8*b* and subsequent valve chamber 45 through passageway 44. Typical on-off valve Ta which is acceptable to later-discussed various embodiments of timer T shown in FIGS. 37 to 43 is entirely cylindrical and axially slidably disposed in cylindrical valve chamber 45, as shown in FIGS. 30 to 32. Passageway 44 consists of an axial hole 44*c* penetrating on-off valve Ta axially, an annular port 44*a* formed on the outer periphery of on-off valve Ta annularly, and a connection path 44*b* extended in the radial direction of on-off valve Ta for connection of axial hole 44*c* and annular port 44*a*. In such passageway 44, axial hole 44*c* is always open at one end thereof (a bottom end in the case of FIGS. 30 to 32) into valve chamber 45 below on-off valve Ta, and closed at the other end thereof (a top end in the case of FIGS. 30 to 32) by valve actuator or the body itself of on-off valve Ta. Annular port 44*a* can be opened for free passage to leak port 8*b*, when on-off valve Ta is at a predetermined sliding position.

If the pressing force of valve actuator Tb to on-off valve Ta is weak, on-off valve Ta is so located as to arrange annular port 44*a* thereof above leak port 8*b* because of the biasing force of biasing member Tc, as shown in FIG. 31. Therefore, on-off valve Ta cuts the fuel communication between leak port 8*b* and the fuel escape circuit from valve chamber 45 to fuel gallery 42 or the fuel tank, that is, it is put in the valve-closing state.

On the other hand, by increasing the pressing force of valve actuator Tb onto on-off valve Ta so as to slide on-off valve Ta downward against biasing member Tc, on-off valve Ta is so set as to make annular port 44*a* open to leak port 8*b*, i.e., on-off valve Ta is put into the valve-opening state.

If the purpose of reduction of NOx under exhaust gas and noise reduction at the time of an idling concerning diesel engines is considered, it is desirable that the cam angle leading to the top dead center is reduced as far as possible, that is, the fuel injection time is delayed if possible. However, at the time of engine start, rising of combustion efficiency for avoiding misfire in an engine cylinder of low-temperature is requested prior to the above-mentioned purpose. In this case, it is requested to advance the lead cam angle, that is, to make the fuel injection time early as far as possible. Moreover, after engine starting but before the engine sufficiently gets warm, delay of the fuel injection time causes white smoke or black smoke. Timer T is provided to correspond to both the requested times of fuel injection start which exchanges with change of the condition of engine operation.

In this regard, for a while from engine starting until the engine fully gets warm, on-off valve Ta is closed so that plunger 7 starts the fuel-discharging stroke simultaneously with the end of the fuel-inhaling stroke. On the other hand, after the engine fully gets warm, on-off valve Ta is opened so that, even if the fuel-inhaling stroke of plunger 7 ends, fuel in fuel-compression chamber 43 is leaked from leak port 7*b* for a while so as to delay the discharging stroke. Timer T has such structure.

Description will now be given of examples of timer T focusing on valve actuator Tb for controlling the vertical sliding of on-off valve Ta, i.e., for controlling opening-and-closing of on-off valve Ta. They are a first embodiment of FIGS. 37 and 38 (the same with that of FIG. 5), a second embodiment of FIG. 39, a third embodiment of FIG. 40, and a fourth embodiment of FIG. 41.

Incidentally, a fuel-escaping-circuit structure is common among the first to fourth embodiments. Valve chamber 45 is formed within pump head 2, and a fuel passage 2*b* from leak port 8*b* and a fuel passage 2*c* to annular groove 8*d* of plunger barrel 8 which is open to fuel gallery 42 are connected to valve chamber 45, thereby constituting the fuel escaping circuit. However, in each of the embodiments, the fuel escaping circuit including valve chamber 45 may be alternatively formed within plunger barrel 8 as shown in FIGS. 30 and 31, or the circuit structure for returning fuel to fuel tank FT may be applied as shown in FIG. 32. In the case where the fuel escaping circuit is formed within plunger barrel 8 as shown in FIGS. 30 and 31, it should be considered in each of the embodiments that leak port 8*a* is directly connected to valve chamber 45 without passing fuel passage 2*b* and fuel passage 2*c* is replaced with fuel passage 8*e*. Moreover, when the fuel-escaping-circuit structure of FIG. 32 is adopted, later-discussed fuel passage 2*c* is replaced with fuel passage 2*d*.

Figure 37:
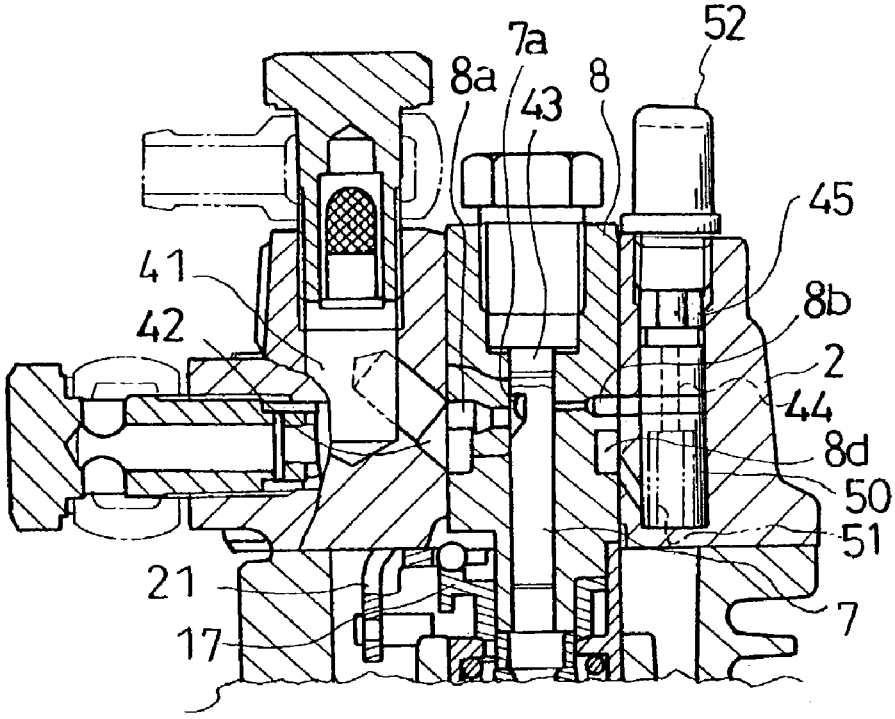
FIG. 37 is a sectional front view of an upper portion of fuel injection pump DP including a valve actuator Tb constituted by a thermostatic actuator 52, serving as a first embodiment of a timer T.
Figure 38:
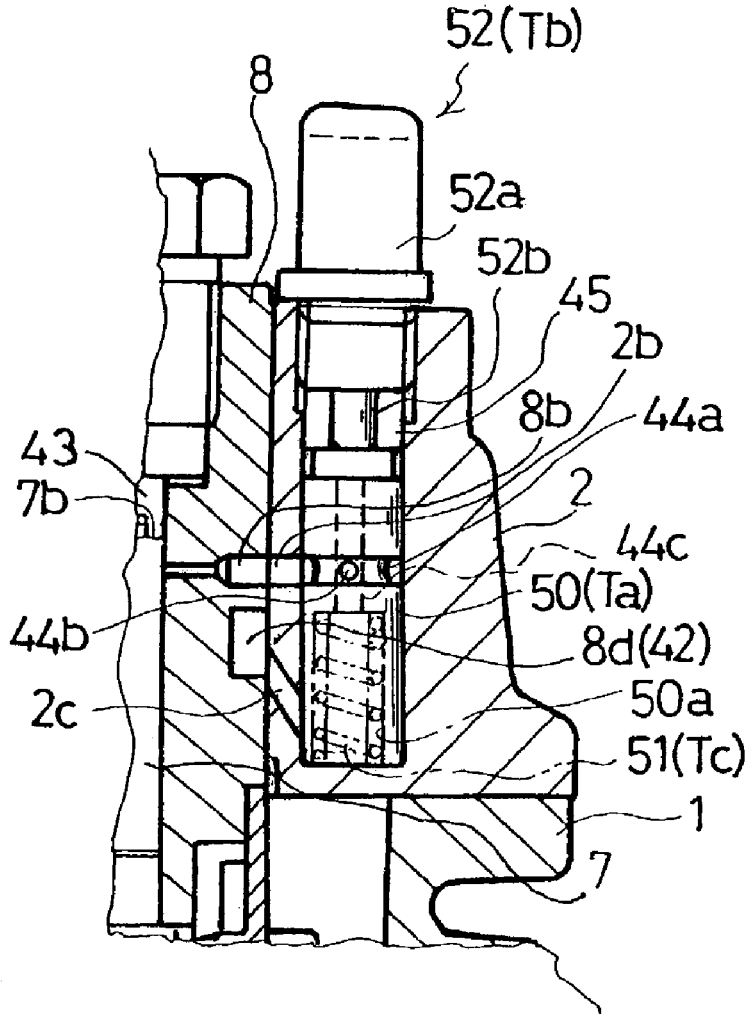
FIG. 38 is a partly enlarged sectional front view in detail of the first embodiment of timer T.
Figure 39:
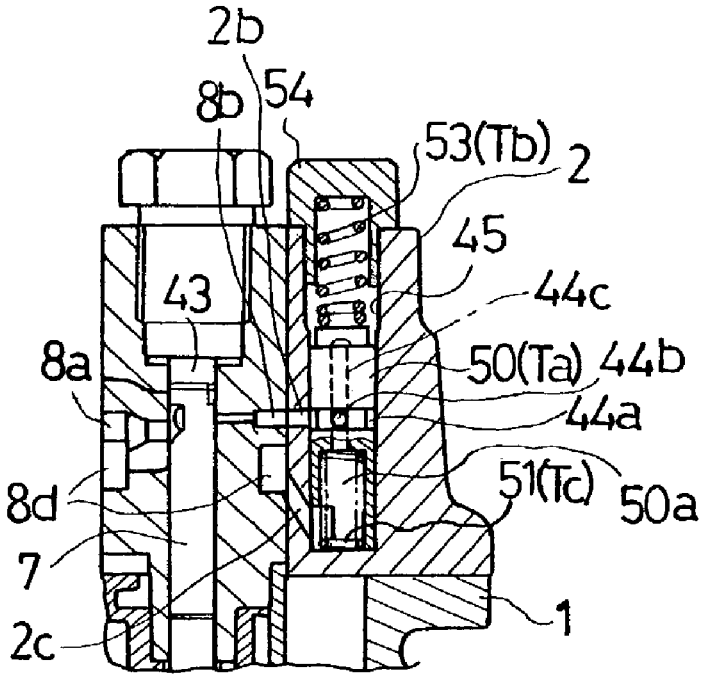
FIG. 39 is a sectional front view of an upper portion of the fuel injection pump including a shape memory spring 53 which is expanded and compressed by change of temperature, serving as a second embodiment of timer T.

The first embodiment illustrated by FIGS. 5, 37 and 38 and the fourth embodiment shown in the second embodiment illustrated by FIG. 39 have a common structure of on-off valve Ta and biasing member Tc in each timer T. Referring to this common structure, a cylindrical valve element 50 serving as on-off valve Ta is vertically slidably inserted in vertically cylindrical valve chamber 45. Valve element 50 is formed therein with a passageway 44 as mentioned above shown in FIGS. 30 to 32. A lower portion of valve element 50 serves as a downwardly opening recess 50*a*. A bottom end of axial hole 44*c* of passageway 44 is open at the ceiling of recess 50*a*. A coiled spring 51 is interposed between the ceiling of recess 50*a* and the bottom of valve chamber 45 so as to bias valve element 50 upward.

In this structure, when the vertical length of spring 51 is natural length, annular port 44*a* of passageway 44 in valve element 50 is located above fuel passage 2*b* from leak port 8*a* so that fuel passage 2*b* is intercepted from valve chamber 45 by the side surface of valve element 50 (refer to FIG. 31). When the bottom end of valve element 50 reaches the bottom of valve chamber 45 against spring 51, annular port 44*a* becomes open to leak port 8*b*. FIGS. 37 and 38 illustrate this situation. In addition, recess 50*a* is partly notched so that, even if the bottom end of valve element 50 reaches the bottom of valve chamber 45, the interior of recess 50*a* is open for free passage through the notch to fuel passage 2*c* between valve chamber 45 and fuel gallery 42.

In timer T of FIGS. 37 and 38, a thermostat type actuator 52 consisting of a thermostat portion 52*a* which is extended downward with a temperature rise and a push rod 52*b* projecting downward from thermostat portion 52*a* is provided as valve actuator Tb. Thermostat portion 52*a*, for example, may enclose wax pellets which expand with a temperature rise, or may be made of bimetal.

If pump head 2 gets warm, thermostat portion 52*a* is warmed in connection with it so that push rod 52 moves below so as to push down valve element 50. Soon, annular port 44*a* of valve element 50 comes to match with fuel passage 2*b*, thereby opening the fuel escaping circuit for free passage from leak port 8*b* to fuel gallery 42 (or the fuel tank).

Moreover, when pump head 2 gets cold and a temperature-sensing member (like wax) in thermostat portion 52*a* contracts, push rod 52*b* moves upward so that valve element 50 is slid upward by the biasing force of spring 51, thereby intercepting fuel passage 2*b* from valve chamber 45 by the side surface of valve element 50.

Valve actuator Tb of timer T shown in FIG. 39 is a shape-memory spring 53 made of only the temperature-sensing member itself, which expands with a temperature rise. Spring 53 is arranged above valve element 50 in valve chamber 45. A cap bolt 54 is screwed into pump head 2 above valve chamber 45 so as to receive the top end of spring 53. Thus, timer T of the second embodiment shown in FIG. 39 is so configured that, in valve chamber 45, shape-memory spring 53 serving as valve actuator Tb and spring 52 serving as biasing member Tc sandwich valve element 50.

When pump head 2 gets warm, shape-memory spring 53 is extended, and the lower end of valve element 50 arrives at the bottom of valve chamber 45, annular port 44*a* of valve element 50 matches with fuel passage 2*b*. When pump head 2 gets cold and shape-memory spring 53 contracts, valve element 50 is slid by spring 51 so as to make the side surface thereof close fuel passage 2*b*.

Therefore, in timer T as the first embodiment shown in FIGS. 37 and 38 and the second embodiment shown in FIG. 39, in the state where an engine is cold at the time of starting etc., pump head 2 of the fuel injection pump is also cold, thereby closing valve element 50 serving as valve actuator Tb. Plunger 7 starts fuel discharging at the early time of cam angle range leading to the top dead center, thereby preventing misfire and enhancing combustion efficiency.

After engine starting, while pump head 2 gets warm, either the temperature-sensing member in thermostat portion 52*a* of timer T shown in FIGS. 37 and 38 or shape-member spring 53 serving as the temperature-sensing member of timer T shown in FIG. 39 is expanded gradually so as to make valve element 50 slide downward against the biasing force of spring 51. However, valve element 50 is still closed for a while.

After a while after the engine starting, the engine and pump head 2 get warm sufficiently, the bottom of valve element 50 reaches the bottom of valve chamber 45, whereby valve element 50 becomes open so that plunger 7 starts discharging fuel at the late time in the cam angle range leading to the top dead center, thereby realizing the reduction of NOx under exhaust gas. Moreover, since the fuel injection period is delayed after the engine fully gets warm, reduction of white smoke is realized.

Figure 40:
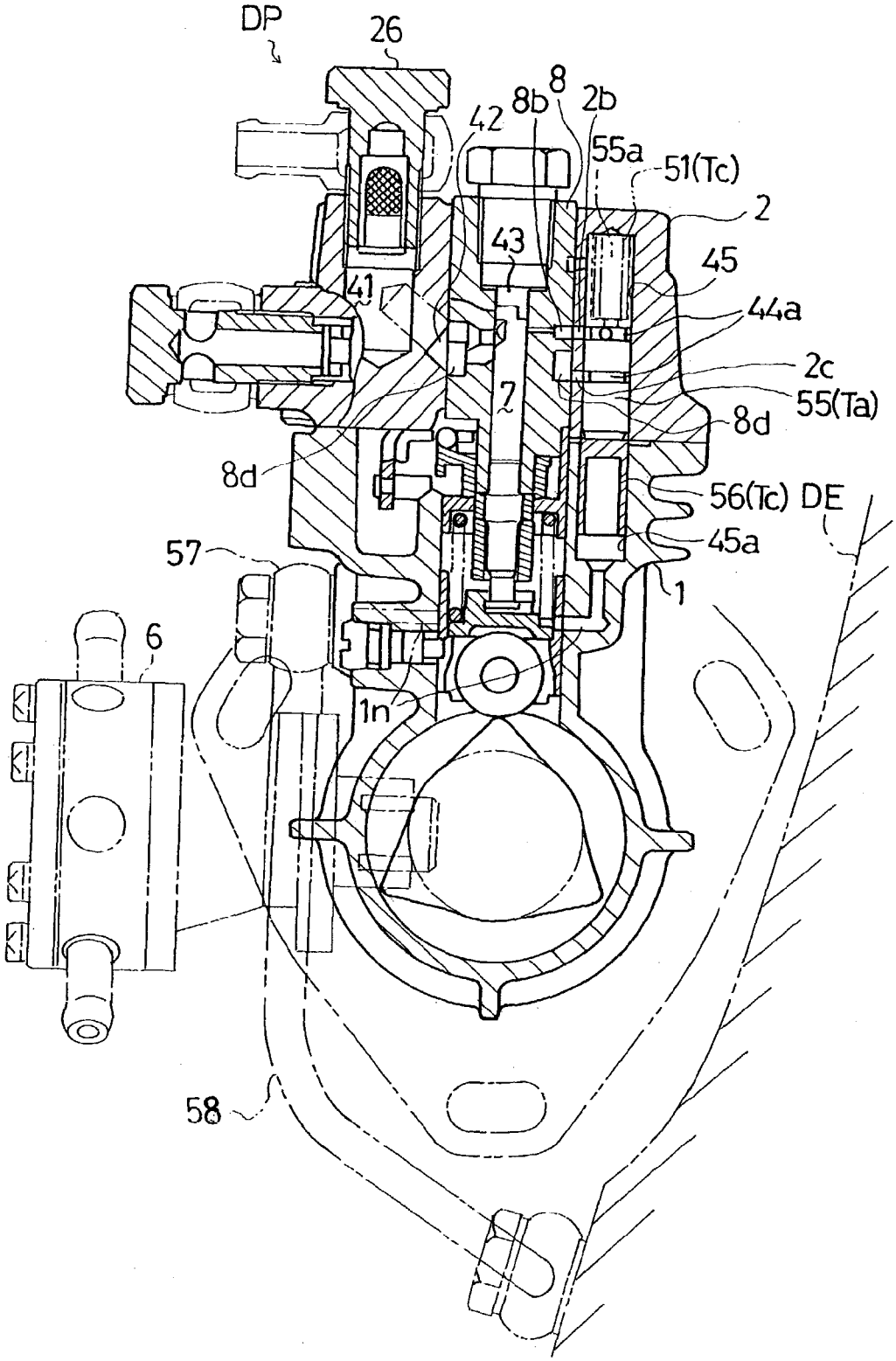
FIG. 40 is a sectional front view of an upper portion of fuel injection pump DP including a valve actuator Tb which actuates according to pressure variation of engine lube, serving as a third embodiment of timer T.

Although each of above-mentioned timers T of the first and second embodiments shown in FIGS. 37 to 39 uses temperature change of fuel injection pump P (pump head 2) accompanying an engine operation situation in order to control the opening-and-closing of on-off valve Ta, timer T of a third embodiment shown in FIG. 40 uses oil pressure change of engine lube. In addition, according to the embodiment shown in FIG. 40, biasing member Tc is arranged above on-off valve Ta, and valve actuator Tb below on-off valve Ta.

Lube in engine DE is introduced into fuel injection pump DP through a lube pipe 58. Although the lube introduced into fuel injection pump DP may be used lubriciously for a tappet portion and a bevel gear portion etc. However, in this embodiment, the lube must be introduced at least into a pilot oil chamber 45*a* in which a hydraulic piston 56 serving as valve actuator Tb is fit.

A pipe joint 57 for connecting lube pipe 58 is attached onto an outside end of main body housing 1. A pilot oil passage 1*n* is bored within main body housing 1 so as to be extended from pipe joint 57 and joined to pilot oil passage 45*a* which is also bored within main body housing 1.

Valve chamber 45 which is a sliding chamber of on-off valve Ta is formed within pump head 2 continuously coaxially to pilot oil chamber 45*a* and is diametrically as large as pilot oil chamber 45*a*. Hydraulic piston 56 serving as valve actuator Tb is slidably inserted in pilot oil chamber 45*a*. A valve element 55 serving as on-off valve Ta of this embodiment is slidably inserted in valve chamber 45 so that the bottom end of valve element 55 contacts the top end of hydraulic piston 56. The lube introduced in pilot oil chamber 45*a* from lube passage 1*n* is isolated from the fuel in valve chamber 45 (the inside of valve element 55) with hydraulic piston 56.

Passageway 44 of valve element 55 serves as that of valve element 50 plus one more annular port 44*a*. That is, a pair of annular ports 44*a* is formed in vertically parallel on the perimeter surface, and both annular ports 44*a* are open for free passage to each other through axial hole 44*c* etc. within valve element 55. Moreover, similarly to valve element 50, a recess 55*a* is formed so as to enclose spring 51 serving as biasing member Tc, and passageway 44 (especially, axial hole 44*c* thereof) is open for free passage to recess 55*a*.

In the third embodiment shown in FIG. 40, valve element 55 is arranged so as to turn recess 55*a* upward and passageway 44 downward. Since the inside of recess 55*a* cannot be used as a fuel outflow port to fuel passage 2*c* in this state, one annular port 44*a* is added to enable it to let fuel pass from fuel passage 2*b* to fuel passage 2*c* only through passageway 44 in valve element 55. If the upper end of valve element 55 contacts the ceiling of valve chamber 45, i.e., pump head 2, upper annular port 44*a* is opened to fuel passage 2*b* from leak port 8*b*, and lower annular port 44*a* is opened to fuel passage 2*c* to annular port 8*d* (fuel gallery 42).

Spring 51 is infixed between the ceiling of valve chamber 45 and the bottom of recess 55*a* so as to bias valve element 55 downward.

Lube of engine DE is increased in its fluidity and pressure as engine DE gets warm. The time of a stop of engine DE, and after starting, for a while, the lubricous oil pressure of engine DE is low. At this time, since there is little volume of the lube which permeates into pilot oil chamber 45*a* below hydraulic piston 56, the force for make hydraulic piston 56 push valve element 55 upward does not work so that valve element 55 is located by the downward biasing force of spring 51 so as to place upper annular port 44*a* below fuel passage 2*b* and lower annular port 44*a* below fuel passage 2*c*. Therefore, at the end of fuel-inhaling stroke of plunger 7, the fuel in fuel-compression chamber 43 does not flow out of leak port 42, so that the fuel-discharging stroke starts immediately with the end of fuel-inhaling stroke. That is, fuel is injected at an early stage.

If engine gets warm, the lube in engine DE increased in fluidity is introduced into pilot oil chamber 45*a* through lube pipe 58 and lube passage 1*n*. The pressure of this lube makes hydraulic piston 56 slide upward, and valve element 55 slides upward with it. Soon, the top of valve element 55 comes to abut against the ceiling of valve chamber 45 so that upper annular port 44*a* is opened for free passage to leak port 8*b* through fuel passage 2*b* and lower annular port 44*a* is opened for free passage to fuel gallery 42 through fuel passage 2*c*. Therefore, for a while from the end of fuel-inhaling stroke of plunger 7, fuel in fuel-compression chamber 43 flows out from leak port 8*b* to fuel gallery 42, thereby delaying the fuel-discharging stroke for discharging fuel to delivery valves 18. That is, the fuel injection time is set up late.

Each of above-mentioned timers T of the first and second embodiments has opening-and-closing of on-off valve Ta controlled by use of the variation of the fuel injection pump accompanying an engine drive. Strictly, this control is not correctly correspondent to the temperature in the engine. Timer T of the third embodiment shown in FIG. 40 adjusts the fuel injection time by use of variation of engine lube pressure which reacts to the temperature change in engine in instance, thereby enabling the adjustment of fuel injection time to substantially correctly correspond to the temperature condition in the engine.

Figure 41:
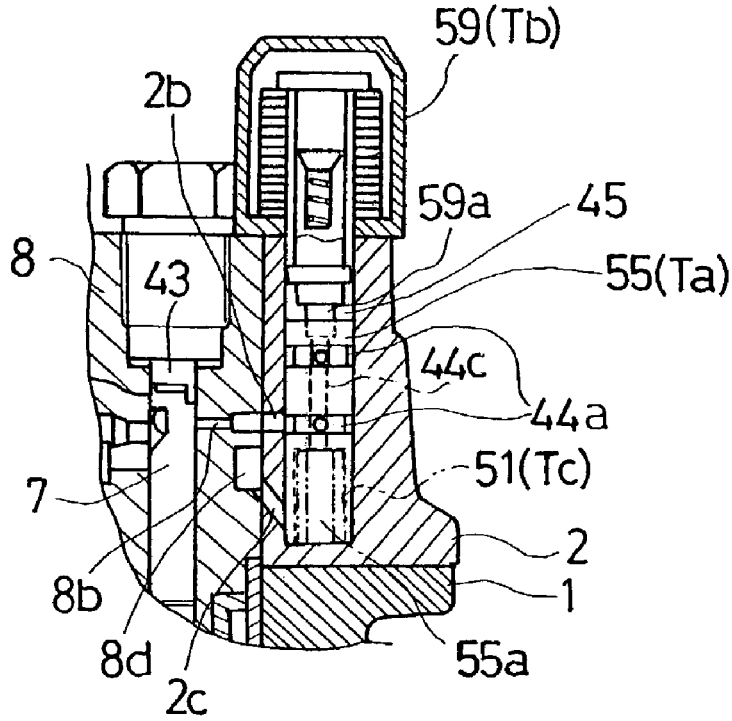
FIG. 41 is a sectional front view of an upper portion of the fuel injection pump including valve actuator Tb constituted by an electromagnetic solenoid 59, serving as a fourth embodiment of timer T.

With respect to timer T of a fourth embodiment shown in FIG. 41, spring 51 serving as biasing member Tc is arranged in the lower interior portion of valve chamber 45, an electromagnetic solenoid 59 serving as valve actuator Tb is arranged in the lower interior portion of valve chamber 45, and valve element 55, which is the same as that of FIG. 40 but vertically reversed, serving as on-off valve Ta is sandwiched therebetween. That is, recess 55*a* is arranged under valve element 55 so as to be open downward. Spring 51 is interposed between the ceiling of recess 55*a* and the bottom of valve chamber 45. A lower end of a spool 59*a* extended from electromagnetic solenoid 59 engages with the top of valve element 55.

Therefore, annular port 44*a* serving as the upper one in FIG. 40 comes below. Only this annular port 44*a* is used so as to be opened to fuel passage 2*b* when the lower end of valve element 55 reaches the bottom of valve chamber 45, and the other annular port 44*a* is not used. In addition, similarly to valve element 55 shown in FIG. 47 etc., recess 55*a* of valve element 55 is also partly notched. When the lower end of valve element 55 contacts the bottom of valve chamber 45, the interior of recess 55*a* is opened for free passage to fuel passage 2*c* through the notch.

In this way, valve element 55 may be vertically reversed so as to be applicable to both the configuration where biasing member Tc is above valve actuator Tb as shown in FIG. 40 and the configuration where valve actuator Tb is above biasing member Tc. Of course, in the embodiment of FIG. 41, it is also possible to use valve element 50 having single annular port 44*a*.

If electromagnetic solenoid 59 serving as valve actuator Tb is energized and excited, spool 59*a* is pulled up so that valve element 55 slides up by the upward biasing force of spring 51. If energization of electromagnetic solenoid 59 is cut, spool 59*a* is pushed out below so as to slide valve element 55 below.

In this embodiment, when electromagnetic solenoid 59 is excited, annular port 55*a* comes above fuel passage 2*b* so that the side surface of valve element 55 closes fuel passage 2*b*. By un-exciting electromagnetic solenoid 59, spool 59*a* is pushed out downward so as to make the lower end of valve element 55 reach the bottom of valve chamber 45, thereby opening annular port 44*a* to fuel passage 2*b*, and recess 55*a* to fuel passage 2*c*, whereby the open-valve state is established. However, alternatively, it is possible that on-off valve Ta is opened by exciting electromagnetic solenoid 59 and closed by un-exciting thereof by changing the port position of on-off valve Ta, the connection position of fuel passages 2*b* and 2*c* to valve chamber 45, or the length of valve chamber 45 or spool 59*a*.

The on-off operation of energization of electromagnetic solenoid 59 is automatically controlled on the base of temperature detection means, for example. Suppose that on-off valve Ta (valve element 55) is established so as to be closed by energizing (exciting) electromagnetic solenoid 59 and opened by un-energizing (un-exciting) it. When an engine is not warmed during lock ping or starting, electromagnetic solenoid 59 is energized based on that the temperature detection means detects the low temperature, thereby opening on-off valve Ta so as to advance the fuel injection time. If the engine gets warm and the temperature detection means detects temperature more than the fixed value, the energization of electromagnetic solenoid 59 is cut off so as to close on-off valve Ta, thereby delaying the fuel injection time.

Alternatively, instead of the temperature detection means, a certain energization period from a time of engine start may be set up so that when the period is passed, electromagnetic solenoid 59 is un-energized so as to open on-off valve Ta. What is necessary is to set up the length of the energization period so as to make it correspond for every engine.

Furthermore, valve actuator Tb constituted by electromagnetic solenoid 59 like this embodiment can control opening-and-closing of on-off valve Ta easily corresponding to various conditions of the same engine requiring different fuel injection start times as well as the temperature condition.

Moreover, electromagnetic solenoid 59 is attached from the exterior of pump head 2, thereby facilitating assembly thereof. It does not require a great change of the fuel injection pump structure, thereby enabling the on-off valve structure of the present invention to be realized easily.

The concrete embodiment of timer T is over. Description will now be given of some embodiments concerning flux-adjusting means for adjusting the amount of escaping fuel in accordance with FIGS. 42 to 48.

The fuel flux from leak port 8*b* to the fuel escaping circuit during the discharging-delay stroke is determined by the cross-sectional area of leak port 8*b* and other passages formed in the fuel injection pump. Moreover, there is a case where the optimal flux may change with difference of engine to be applied or another reason even in the same fuel injection pump. Furthermore, even if fuel injection pumps of the same scale are manufactured, variation of the flux may arise according to a processing error etc. Each of following flux adjusting mechanisms (flux adjusting valve devices V1, V2, V3 and V3') according to embodiments shown in FIGS. 42 to 48 is applicable if it is requested to adjust the amount of fuel escaping from leak port 8*b* by the above reason.

Figure 42:
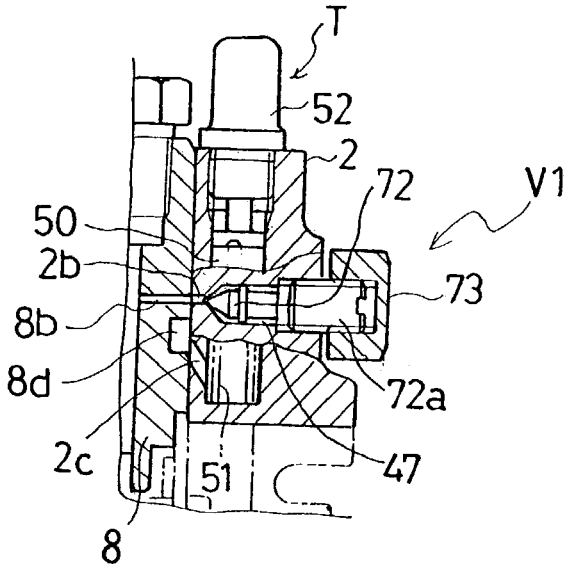
FIG. 42 is a front view partly in section of the fuel injection pump including flow control means V1 serving as a first embodiment of fuel leak flow control means, which is interposed between a sub port 8*b* and timer T.
Figure 43:
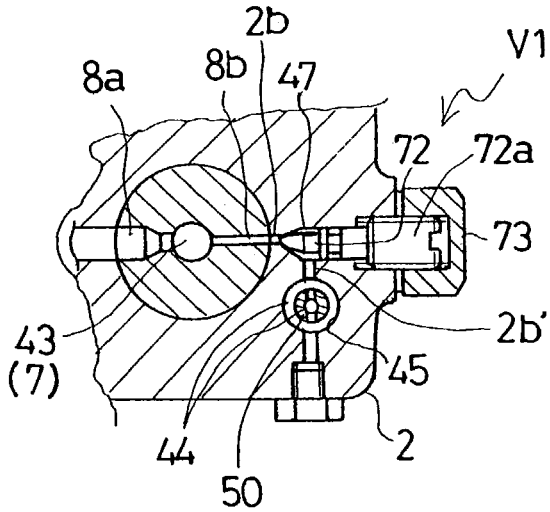
FIG. 43 is a fragmentary sectional plan view of the same.

According to the first embodiment of FIGS. 42 and 43, within pump head 2, a flux adjusting valve chamber 47 is formed, fuel passage 2*b* from leak port 8*b* is connected to valve chamber 47, and a fuel passage 2*b*' is formed from valve chamber 47 to on-off valve Ta in valve chamber 45. In valve chamber 45 is fit timer T having any one of the above-mentioned structures (in this embodiment, that shown in FIGS. 37 and 38). A fuel passage to either fuel gallery 42 or fuel tank FT outside the fuel injection pump is extended from the interior portion of valve chamber 45 subsequent to on-off valve Ta. In FIG. 42, fuel passage 2*c* is formed like FIG. 37 etc. to annular groove 8*d* which is open for free passage to fuel gallery 42.

In addition, one or both of valve chambers 45 and 47 may be formed within plunger barrel 8.

The portion of valve chamber 47 connected to fuel passage 2*b* is conic. A needle valve-like flux adjusting valve 72 is arranged coaxially to fuel passage 2*b* and inserted in valve chamber 47 so as to turn the tip thereof toward fuel passage 2*b*. The outside end of flux adjusting valve 72 projects outward from pump head 2 so as to be formed into a screw portion 72*a*, around which an adjusting nut 73 is screwed. Thus, flux adjusting valve device V1 is constituted. By rotational operation of adjusting nut 73, flux adjusting valve 72 is moved to or from fuel passage 2*b* so as to change the flux permission area of the junction of fuel passage 2*b* and valve chamber 47, thereby adjusting the amount of introductory fuel into valve chamber 47.

Thus, the fuel flux from leak port 8*b* to the fuel escaping circuit is adjusted so that the amount of escaping fuel during the discharging-delay stroke in a fuel injection pump can be adjusted corresponding to each engine, or that the amount of escaping fuel during the discharging-delay stroke can be unified even when there are process errors in the fuel passages like leak ports 8*b* among fuel injection pumps of the same scale.

Figure 46:
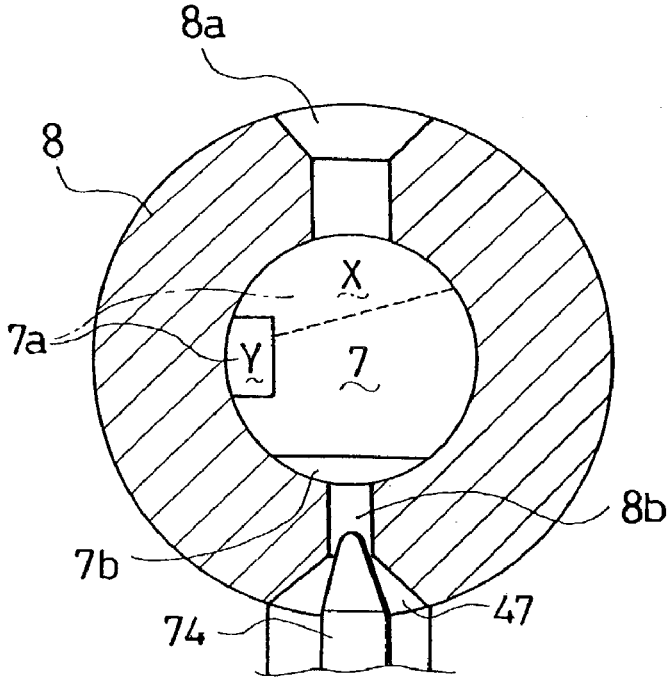
FIG. 46 is an enlarged fragmentary plan view of a third embodiment of the same.

In a second embodiment shown in FIGS. 44 to 46, valve chamber 47 is formed between the interior of plunger barrel 8 and the interior of pump head 2 so as to be directly connected to leak port 8*b* within plunger barrel 8. Flux adjusting valve device V2 is disposed between the interior of valve chamber 47 and the exterior of pump head 2. This flux adjusting valve device V2 consists of a needle valve-like shaped flux adjusting valve 74, a spring 74 for biasing flux adjusting valve 74, a screw shaft 76 having the approximately same diameter with that of valve chamber 47, and an adjusting nut 77 screwed around screw shaft 76. As shown in FIG. 44, screw shaft 76 is screwed through pump head 2 from the interior thereof to the exterior thereof. The portion of screw shaft 76 projecting out from pump head 2 is provided thereon with adjusting nut 77. By rotational operation of adjusting nut 77, the degree of penetration of screw shaft 76 into pump head 2 is adjusted.

Referring to FIG. 45, description will be given of the concrete structure of flux adjusting valve device V2 in valve chamber 47. A stopper pin 76*a* projects substantially coaxially from an inner end of screw shaft 76 toward leak port 8*a*. A tip of stopper pin 76*a* is inserted into a pin receptacle recess 74*b* formed in an end portion of flux adjusting valve 74. Spring 75 is interposed between screw shaft 76 and a spring receptacle plate portion 74*a* which is provided around an intermediate portion of flux adjusting valve 74. By biasing flux adjusting valve 74 with this spring 75, in pin receptacle recess 74*b*, between the tip of stopper pin 76*a* and the flux adjusting valve 74 is generated a fixed clearance, which serves as a stroke of flux adjusting valve 74.

The conic tip of flux adjusting valve 74 is turned coaxially toward leak port 8*b*. The tip of flux adjusting valve 74 which is biased to the most advancing position by spring 75 is located so as to plug the junction of valve chamber 47 and leak port 8*b* by rotational operation of adjusting nut 77, as shown in FIGS. 45 and 46.

If the pressure of fuel pushed out to leak port 8*b* from fuel-compression chamber 43 through sub lead 7*b* becomes more than the predetermined value, the fuel retreats flux adjusting valve 74 against the biasing force of spring 75 and introduced into valve chamber 47. If the opening degree of flux adjusting valve 74 is going to be reduced, adjusting nut 77 is rotated so as to increase the penetration degree of screw shaft 76 into pump head 2, thereby reducing the stroke of flux adjusting valve 74. In this way, by adjusting the opening degree of flux adjusting valve 74, the amount of fuel escaping from leak port 8*b* can be adjusted.

In addition, the fuel introduced in valve chamber 47 in this way may be returned to fuel gallery 42 or fuel tank FT. In this embodiment, as shown in FIG. 44, valve chamber 47 is directly opened to annular groove 8*d* of plunger 8 so as to return fuel in valve chamber 47 to fuel gallery 42. Alternatively, valve chamber 47 may be separated from annular groove 8*d* and a recovery circuit from valve chamber 47 to fuel tank FT may be constituted. Additionally, as mentioned above, fuel may be returned from valve chamber 47 through on-off valve Ta of timer T to fuel gallery 42 or fuel tank FT. The same is said of the following embodiments shown in FIGS. 47 and 48 about this point.

Figure 47:
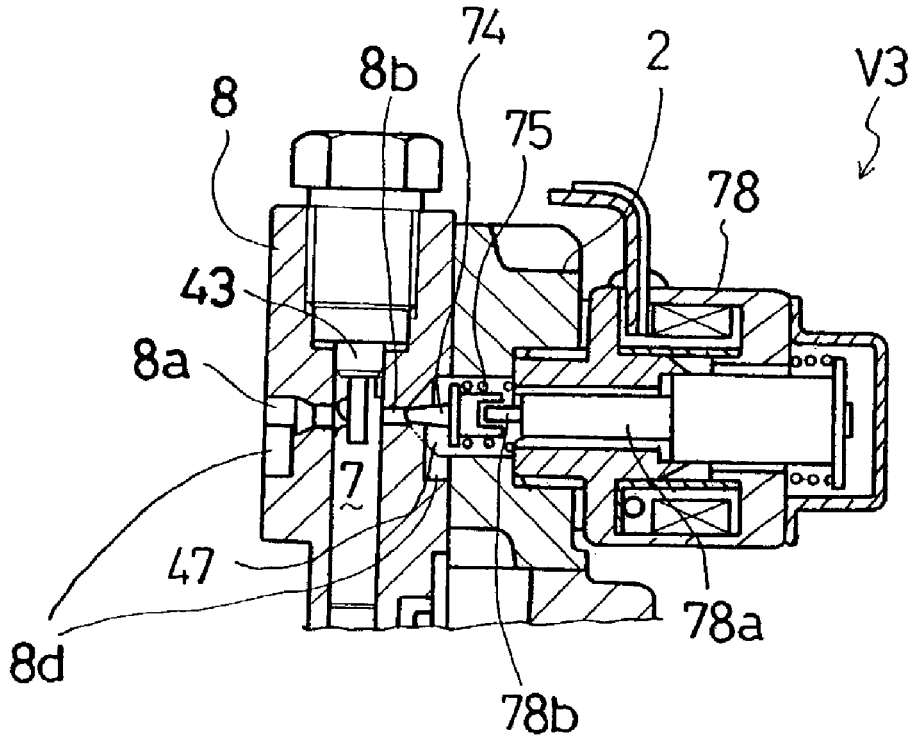
FIG. 47 is a front view partly in section of the fuel injection pump including flow control means V3 serving as a third embodiment of the fuel leak flow control means, whose opening degree can be adjusted by control of an electromagnetic solenoid 78.

According to a third embodiment shown in FIG. 47, similarly to the embodiment shown in FIGS. 44 to 46, valve chamber 47 is formed from leak port 8*b* within plunger barrel 8 to the interior of pump head 2. In valve chamber 47 is fit flux adjusting valve device V3, which includes flux adjusting valve 74 and biasing spring 75 that are identical with those of the above-mentioned flux adjusting valve device V3. However, instead of screw shaft 76 and adjusting nut 77, an electromagnetic solenoid portion 78 including a linear solenoid or the like serves as the means for adjusting the degree of opening. In this regard, a stopper pin 78*b* replacing stopper pin 76*a* protrudes on a tip of a core 78*a* provided in electromagnetic solenoid portion 78. Core 78*a* is biased toward the outside of pump head 2 by spring 78*c*.

If a voltage is applied to electromagnetic solenoid portion 78, core 78*a* slides (leftward in FIG. 47) against the biasing force of spring 78. Along with it, the tip of stopper pin 78*b* is moved in pin receptacle recess 74*b* of flux adjusting valve 74, thereby reducing the stroke of flux adjusting valve 74. Whereby, the opening degree of flux adjusting valve 74 can be made small. The sliding of core 78*a* against the biasing force is proportional to the voltage value (current value) applied to electromagnetic solenoid portion 78. In this way, this flux adjusting valve 74 is a proportional control valve.

By the voltage control of electromagnetic solenoid portion 78, flux control valve device V3 is used for adjusting the amount of fuel escaping from leak port 8*b* so as to correct the performance error of the fuel injection pump. Also, it can be used for controlling the fuel injection time corresponding to the engine operational conditions. That is, similarly to timer T having valve actuator Tb serving as electromagnetic solenoid 59, at the time of engine starting, by applying a voltage to electromagnetic solenoid portion 78, the stroke of flux adjusting valve 74 is set to zero so as to hold the closing-valve state for preventing fuel from leaking from leak port 8*b*, thereby advancing the fuel injection time. If the engine gets warm, the voltage applied to electromagnetic solenoid portion 78 is reduced or set to zero so as to enable flux adjusting valve 74 to be opened by the fuel escaping from leak port 8*b*, thereby delaying the fuel injection time.

Moreover, the voltage may be controlled corresponding to the variation of actual engine speed so as to enable the amount of fuel escaping from the leak port to be adjusted in connection with the regulation of injected fuel by the governor. Especially, if the governor is an electronic governor, it can be controlled on base of engine speed and engine load factors serving as parameters of the electronic governor control.

Figure 48:
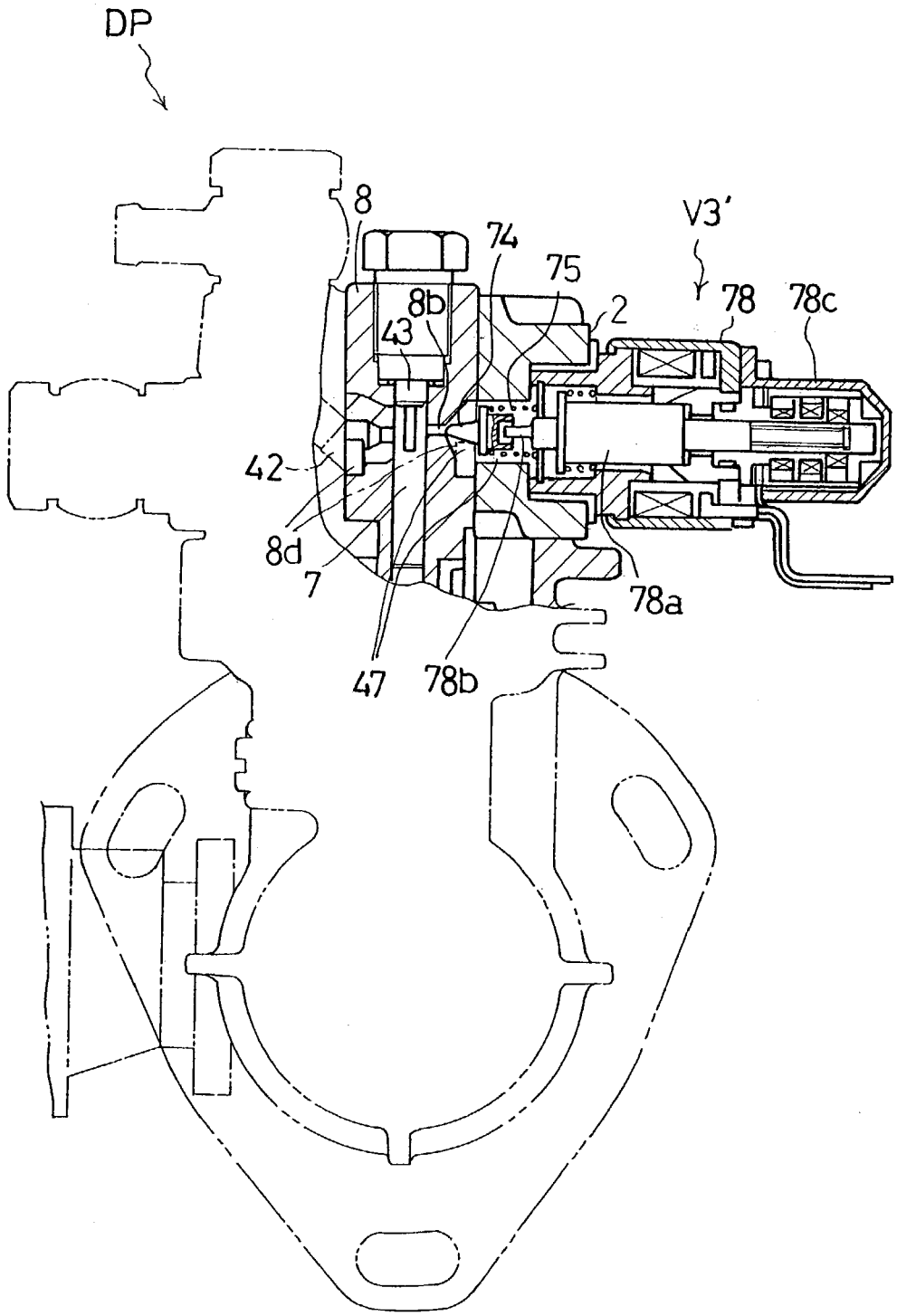
FIG. 48 is a front view partly in section of the fuel injection pump including flow control means V3' serving as a fourth embodiment of the fuel leak flow control means, whose opening degree can be adjusted by control of electromagnetic solenoid 78 having a positional detective sensor.

Furthermore, electromagnetic solenoid portion 78 of a flux adjusting valve device V3' shown in FIG. 48 is additionally provided with a position sensor 78*c* for detecting the position of core 78*a*. Therefore, the value detected by position sensor 78*c* (which enables the opening degree of flux adjusting valve 74, i.e., the fuel escaping from leak port 8*b* to be recognized) can be fed back to a controller for electromagnetic solenoid 78, so that the opening degree of flux adjusting valve 74 can be adjusted more minutely by exploiting the feature thereof as a proportional control valve.

Moreover, if it is applied to an electronic governor type fuel injection pump especially, the opening degree of flux adjusting valve 74 can be adjusted based on the electronic governor control. That is, the detected value of rotary speed or load of an engine, and the position value detected by position sensor 78*c* are input to a controller (for the electronic governor) which memorizes a control map indicating the relation of the optimal condition of the escaping fuel to the engine rotary speed or engine load. The detection values are compared with the map indicating the relation of the optimal condition of leaking fuel to the engine rotary speed or engine load, whereby the controller makes the electromagnetic solenoid slide so as to adjust the leak amount of fuel. On the contrary, based on the value detected by position sensor 78*c*, for example, when the detected value is an unusual value, it is also possible to control the governor so as to adjust the amount of injected fuel.

In this way, the relation value of effective stroke of plunger 7 to the amount of escaping fuel is rectified appropriately by tie up of the control of opening degree of flux adjusting optimizing the combustion condition of the engine. Thereby, engine durability can be improved while improving an engine performance.

Figure 49:
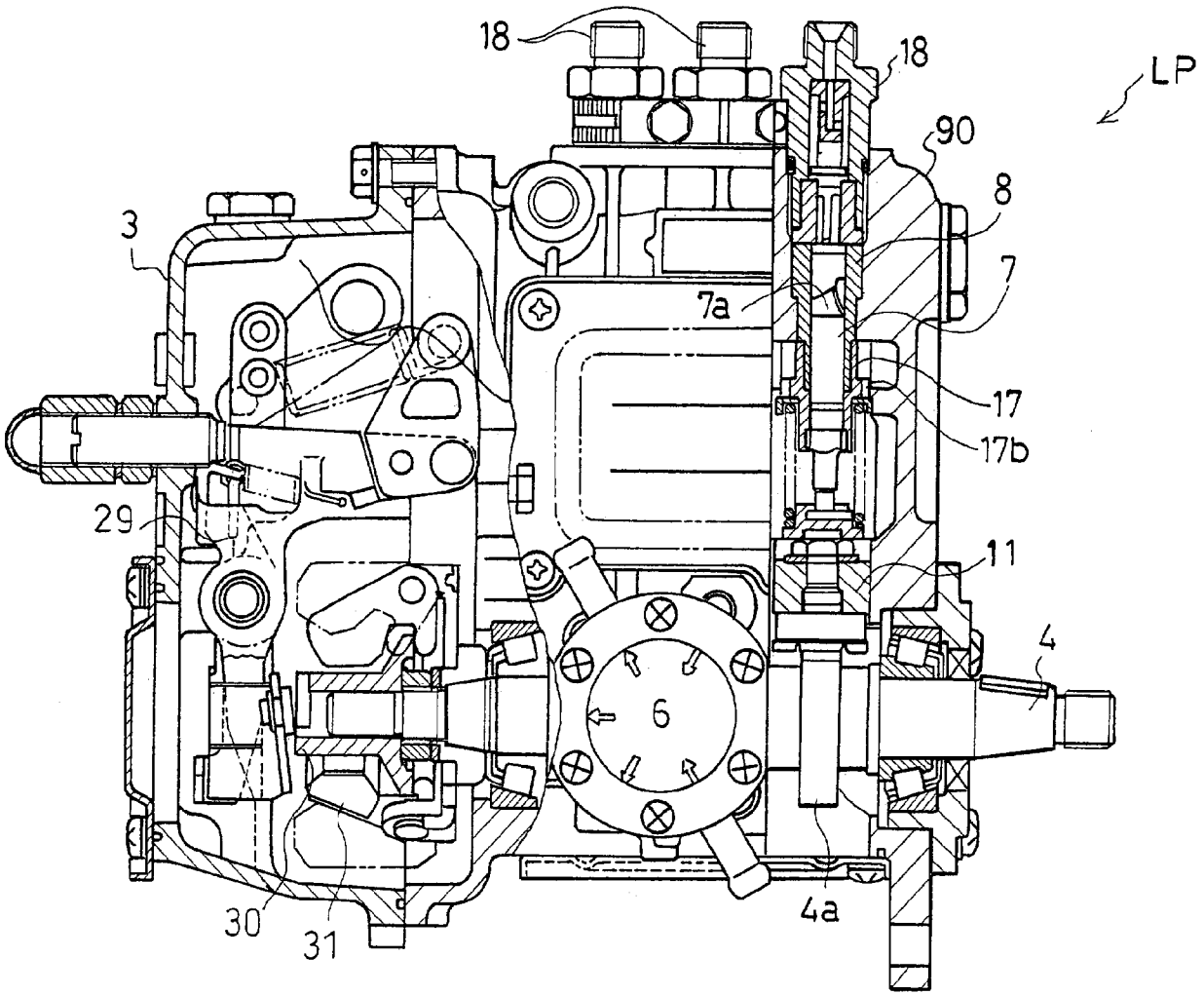
FIG. 49 is a sectional side view of a train-type fuel injection pumpP.
Figure 50:
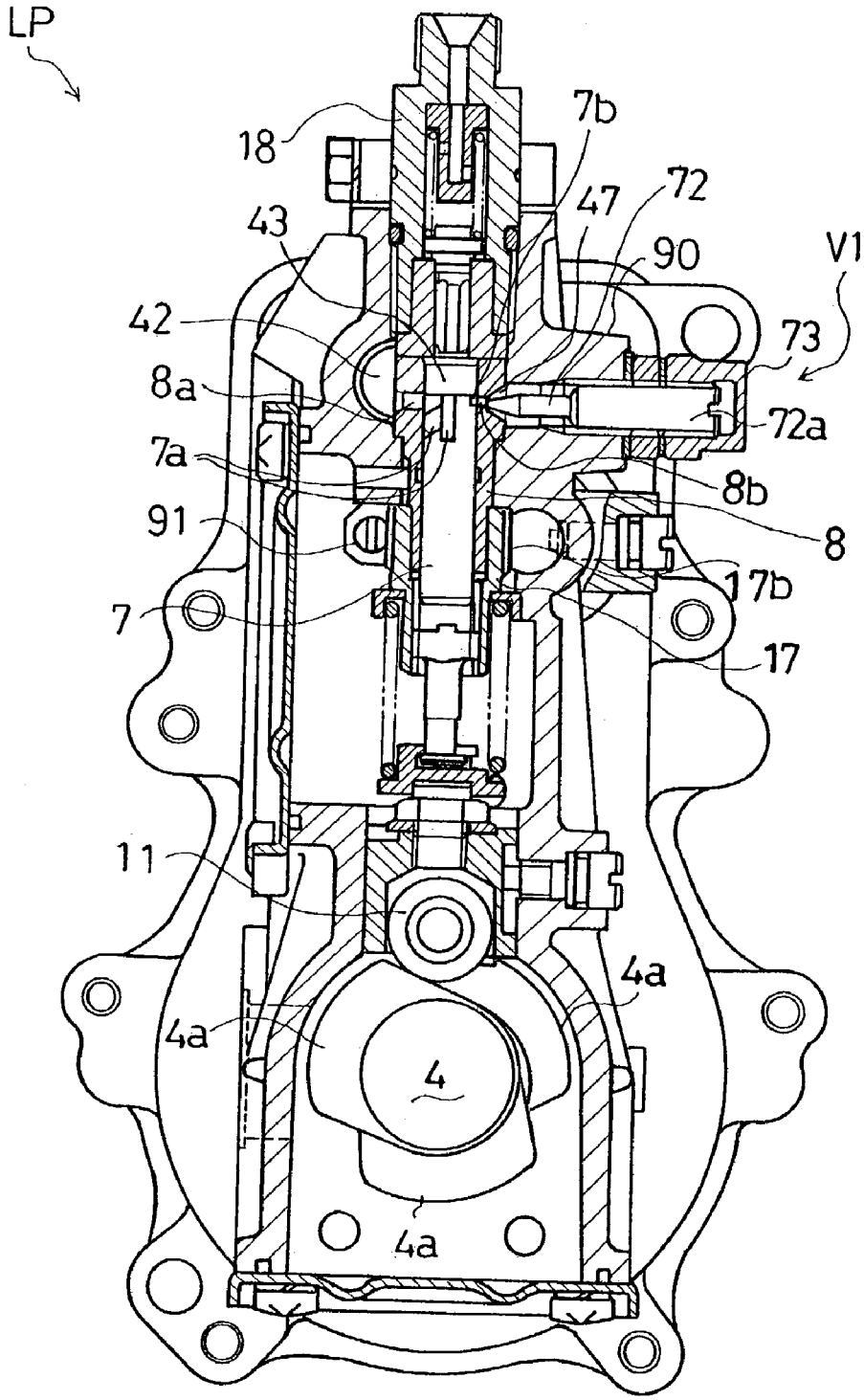
FIG. 50 is a sectional front view of train-type fuel injection pumpP including flow control means V1.
Figure 51:
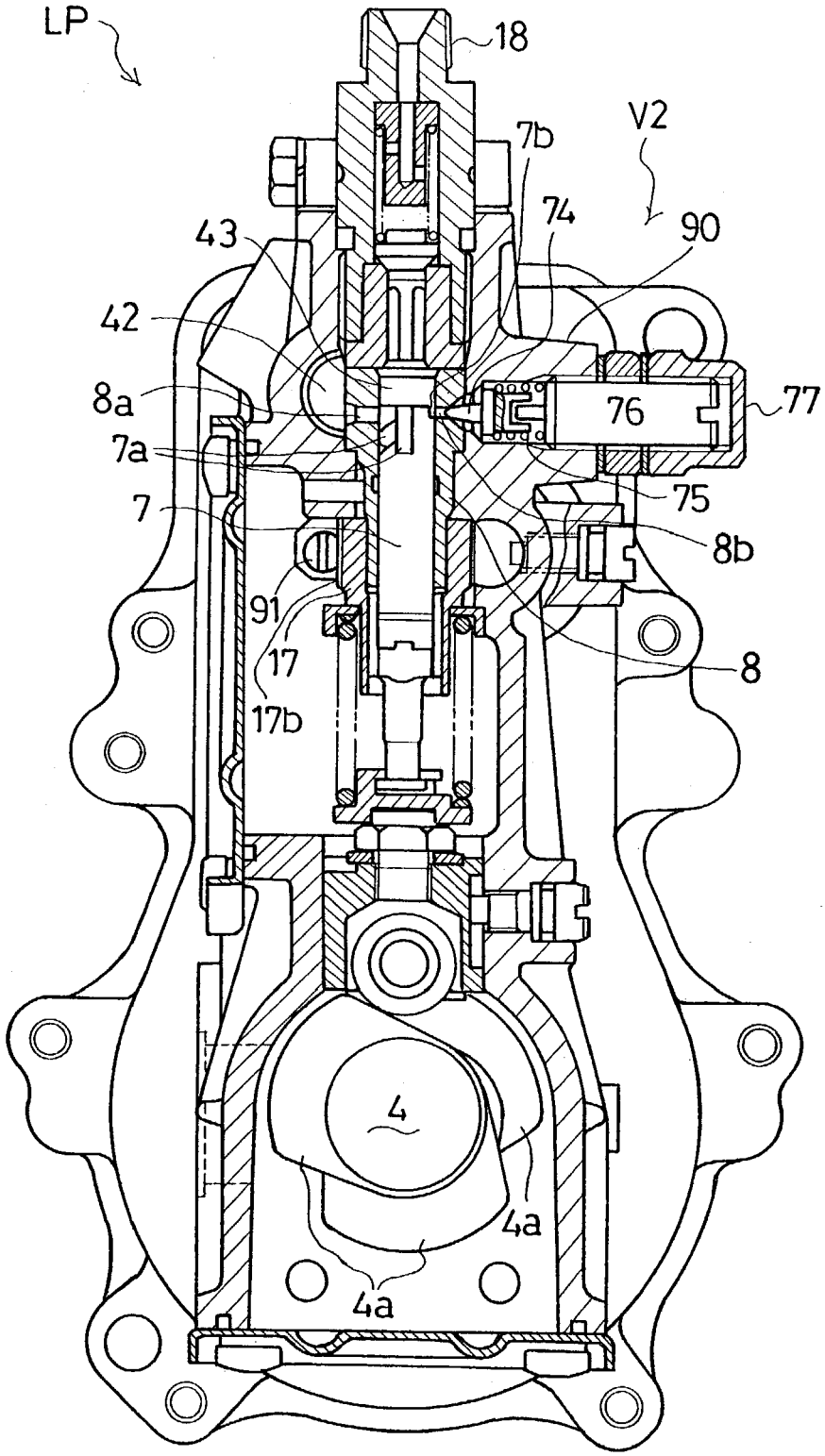
FIG. 51 is a sectional front view of train-type fuel injection pumpP including flow control means V2.

Furthermore, description will be given of an embodiment of a train-type fuel injection pump P having a plurality of plungers 7 in a line as shown in FIGS. 49 to 51 wherein each of the plungers is provided with such flux adjusting mechanism. First, train-type fuel injection pump P according this embodiment is of the Bosch type having delivery valves 18 directly arranged coaxially on the top of respective plungers 7, wherein a plurality of combinations of plunger 7 and delivery valve 18 are arranged in a row within a pump body housing 90, and a plurality of cams 4*a* formed on camshaft 4 are arranged below respective plungers 7. In this embodiment, governor arm 29, governor sleeve 30 and governor weight 31 are arranged in governor housing 3 joined to one side of pump body housing 90 so as to constitute a centrifugally controlled governor. However, an electronic governor may be constituted. Anyway, a pinion 17*b* replacing above-mentioned lock pin 17*a* is formed on control sleeve 17 attached on each plunger 7 rotatably together with plunger 7. A control rack 91 replacing control slider 21 engages with pinions 17*b*. Governor arm 29 may be connected with this control rack 91 directly or through a link.

In pump body housing 90, fuel-compression chamber 43 is formed between each plunger 7 and each delivery valve 18. Each plunger barrel 8 is formed with inhalation port 8*a* and leak port 8*b*. Main lead 7*a* and sub lead 7*b* are formed in plunger 7, and the fuel escaping circuit is formed for letting fuel escape from each fuel-compression chamber 43 to fuel gallery 42 or fuel tank FT through sub lead 7*b*, leak port 8*b* and fuel adjusting valve chamber 47. In this embodiment, valve chamber 47 is formed between plunger barrel 8 and the interior of pump body housing 90. Sub port 8*b* is opened for free passage through valve chamber 47 to annular groove 8*d* of plunger barrel 8 which is open to fuel gallery 42. In FIG. 50, flux adjusting valve device V1 as shown in FIGS. 42 and 43 is arranged in valve chamber 47. In FIG. 51, and flux adjusting valve device V2 as shown in FIGS. 44 to 46 is arranged in valve chamber 47. In addition, it is also possible to provide flux adjusting valve device V3 or V3', and it is also possible to arrange timer T in the downstream fuel passage of each flux adjusting valve V2. This timer T may be only one arranged in the junction of fuel escaping passages from all valve chambers 47 for respective plungers.

Hence, in a fuel injection pump having a plurality of plungers (e.g., a train-type fuel injection pump), by forming the fuel injection circuit having the flux adjusting valve for each plunger, the amount of fuel escaping from each plunger can be adjusted. Therefore, even if process errors of the plungers cause variation of passage area among the fuel escaping passages, the escape of fuel can be unified among plural plungers of one fuel injection pump, thereby unifying fuel injection characteristics among cylinders of an engine adopting the fuel injection pump. Other characteristics in control of fuel injection start time are as the above-description about distributor-type fuel injection pump DP.

What is claime is:

1. A fuel injection pump, comprising three parts;

a lower mechanism part;

a head mechanism part installed with a rotatable plunger, a control sleeve which is rotatable integrally with said plunger, and a linearly movable member for rotating said control sleeve; and a governor mechanism part installed with a governor link, wherein the fuel injection pump is completed by attaching said governor mechanism to both combined lower and head mechanism parts after said lower mechanism part and said head mechanism part are combined with each other, and wherein said governor link extended from said governor mechanism part is removably latched to said linearly movable member by pushing the governor link to the linearly movable member in a latching direction generally perpendicular to a linearly movable direction of the linearly movable member, said governor link being pushed in the latching direction by a pushing member provided in the lower mechanism part during the attachment of said governor mechanism part to said both combined mechanism parts.

2. The fuel injection pump according to claim 1, wherein said governor link is pivoted by said governor mechanism, and wherein said governor link inserted and located in said both combined mechanism parts is swung for connection and disconnection of said governor link with and from said linearly movable member.

3. The fuel injection pump according to claim 1, wherein either said governor link inserted and located in said both combined mechanism parts or said whole governor mechanism part is rotated with the length of said governor link serving as a fulcrum shaft so as to connect or disconnect said governor link with and from said linearly movable member.

4. A fuel injection pump comprising three parts;

a lower mechanism part;

a head mechanism part installed with a rotatable plunger, a control sleeve which is rotatable integrally with said plunger, and a linearly movable member for rotating said control sleeve, said control sleeve including a lock pin, and said linearly movable member being arranged rotatably and including a fork arm, wherein said linearly movable member is rotated so as to make said fork arm detachably engage with said lock pin during combination of said lower mechanism part and said head mechanism part; and a governor mechanism part installed with a governor link wherein the fuel injection pump is completed by attaching said governor mechanism to both combined lower and head mechanism parts after said lower mechanism part and said head mechanism part are combined with each other, and wherein said governor link extended from said governor mechanism part is removably connected to said linearly movable member during the attachment of said governor mechanism part to said both combined mechanism parts.

5. A fuel injection pump comprising:

a plunger barrel;

a fuel-compression chamber formed in said plunger barrel;

a plunger reciprocally and rotatably inserted in said plunger barrel so as to make a head of said plunger face said fuel-compression chamber;

a fuel gallery;

a delivery valve, wherein, by reciprocation of said plunger, fuel is inhaled from a fuel gallery into said fuel-compression chamber and discharged from said fuel-compression chamber to said delivery valve;

an inhalation port provided in said plunger barrel, said in halation port being open to said fuel gallery;

a leak port provided in said plunger barrel;

a fuel escape circuit, said leak port being open to said fuel escape circuit;

a sub lead formed in said head of plunger, wherein, during the sliding of said plunger toward said fuel-compression chamber, a fuel-inhaling stroke for open said inhalation port for free passage to said fuel-compression chamber is finalized, a discharging-delay stroke for connecting said leak port and said fuel-compression chamber for free passage through said sub lead to make fuel in said fuel-compression chamber escape to said fuel escaping circuit is passed, and then, a fuel-discharging stroke for discharging fuel in a predetermined pressure for injection from said fuel-compression chamber to said delivery valve is started; and an on-off valve arranged in the midway of said fuel escaping circuit so that, by closing said on-off valve, said fuel-discharging stroke can be started immediately after the end of said fuel-inhaling stroke without said discharging-delay stroke, said fuel injection pump further comprising a timer for control of fuel injection time, wherein said timer is so configured that said movable on-off valve, a valve actuator and a biasing member are arranged in said valve chamber which is open for free passage to said fuel escaping circuit while said on-off valve is sandwiched between said valve actuator and said biasing member, and wherein said valve actuator including a temperature-sensing member whose shape is changed with variation of temperature moves said biasing member against the biasing force of said biasing member with a temperature rise, and wherein said on-off valve is closed when the temperature detected by said temperature-sensing member is under a certain value, and opened when it is not under the certain value.

6. A fuel injection pump comprising:

a plunger barrel;

a fuel-compression chamber formed in said plunger barrel;

a plunger reciprocally and rotatable inserted in said plunger barrel so as to make a head of said plunger face said fuel-compression chamber;

a fuel gallery;

a delivery valve, wherein, by reciprocation of said plunger fuel is inhaled from a fuel gallery into said fuel-compression chamber and discharged from said fuel-compression chamber to said delivery valve;

an inhalation port provided in said plunger barrel, said in halation port being open to said fuel gallery;

a leak port provided in said plunger barrel;

a fuel escape circuit, said leak port being open to said fuel escape circuit;

a sub lead formed in said head of plunger, wherein, during the sliding of said plunger toward said fuel-compression chamber, a fuel-inhaling stroke for open said inhalation port for free passage to said fuel-compression chamber is finalized, a discharging-delay stroke for connecting said leak port and said fuel-compression chamber for free passage through said sub lead to make fuel in said fuel-compression chamber escape to said fuel escaping circuit is passed, and then, a fuel-discharging stroke for discharging fuel in a predetermined pressure for injection from said fuel-compression chamber to said delivery valve is started; and an on-off valve arranged in the midway of said fuel escaping circuit so that, by closing said on-off valve, said fuel-discharging stroke can be started immediately after the end of said fuel-inhaling stroke without said discharging-delay stroke, said movable on-off valve constituting a timer for control of fuel injection time, said timer further comprising:

a biasing member; and a valve actuator including an actuation member actuated by variation of pressure of engine lube, said valve actuator moving said on-off valve against the biasing force of said biasing member as said lube pressure rises, wherein said movable on-off valve, said valve actuator and said biasing member are arranged in said valve chamber which is open for free passage to said fuel escaping circuit while said on-off valve is sandwiched between said valve actuator and said biasing member, and wherein said on-off valve is closed when said lube pressure is under a certain value, and opened when it is not under the certain value.

7. A fuel injection pump comprising:

a plunger barrel;

a fuel-compression chamber formed in said plunger barrel;

a plunger reciprocally and rotatably inserted in said plunger barrel so as to make a head of said plunger face said fuel-compression chamber;

a fuel gallery;

a delivery valve, wherein, by reciprocation of said plunger, fuel is inhaled from a fuel gallery into said fuel-compression chamber and discharged from said fuel-compression chamber to said delivery valve;

an inhalation port provided in said plunger barrel, said in halation port being open to said fuel gallery;

a leak port provided in said plunger barrel;

a fuel escape circuit, said leak port being open to said fuel escape circuit;

a sub lead formed in said head of plunger, wherein, during the sliding of said plunger toward said fuel-compression chamber, a fuel-inhaling stroke for open said inhalation port for free passage to said fuel-compression chamber is finalized, a discharging-delay stroke for connecting said leak port and said fuel-compression chamber for free passage through said sub lead to make fuel in said fuel-compression chamber escape to said fuel escaping circuit is passed, and then, a fuel-discharging stroke for discharging fuel in a predetermined pressure for injection from said fuel-compression chamber to said delivery valve is started; and an on-off valve arranged in the midway of said fuel escaping circuit so that, by closing said on-off valve, said fuel-discharging stroke can be started immediately after the end of said fuel-inhaling stroke without said discharging-delay stroke, said movable on-off valve constituting a timer for control of fuel injection time, said timer further comprising:

a biasing member; and a valve actuator including an actuation member actuated by variation of pressure of engine lube, said valve actuator moving said on-off valve against the biasing force of said biasing member as said lube pressure rises, wherein said movable on-off valve, said valve actuator and said biasing member are arranged in said valve chamber which is open for free passage to said fuel escaping circuit while said on-off valve is sandwiched between said valve actuator and said biasing member, and wherein said valve actuator is electromagnetically controlled so that said on-off valve is opened and closed by energization and un-energization of said valve actuator.

* * * * *